US011199003B2

(12) United States Patent
Kossman

(10) Patent No.: US 11,199,003 B2
(45) Date of Patent: Dec. 14, 2021

(54) INSULATED METAL PANEL AND CURTAIN WALL SYSTEMS

(71) Applicant: Curtis Kossman, Pittsburgh, PA (US)

(72) Inventor: Curtis Kossman, Pittsburgh, PA (US)

( * ) Notice: Subject to any disclaimer, the term of this patent is extended or adjusted under 35 U.S.C. 154(b) by 203 days.

(21) Appl. No.: 16/472,306

(22) PCT Filed: Dec. 12, 2017

(86) PCT No.: PCT/US2017/065907

§ 371 (c)(1),
(2) Date: Jun. 21, 2019

(87) PCT Pub. No.: WO2018/118536

PCT Pub. Date: Jun. 28, 2018

(65) Prior Publication Data

US 2021/0131099 A1 May 6, 2021

Related U.S. Application Data

(60) Provisional application No. 62/438,967, filed on Dec. 23, 2016.

(51) Int. Cl.

| | |
|---|---|
| ***E04B 7/08*** | (2006.01) |
| ***E04B 2/96*** | (2006.01) |
| ***E04B 1/32*** | (2006.01) |
| ***E04C 3/11*** | (2006.01) |
| ***E04C 3/40*** | (2006.01) |
| *E04B 1/58* | (2006.01) |
| *E04B 1/00* | (2006.01) |

(52) U.S. Cl.
CPC ..... *E04B 2/967* (2013.01); *E04B 1/3205* (2013.01); *E04B 1/3211* (2013.01); *E04B 2/962* (2013.01); *E04C 3/11* (2013.01); *E04C 3/40* (2013.01); *E04B 1/5831* (2013.01); *E04B 2001/0061* (2013.01); *E04B 2001/3241* (2013.01); *E04B 2001/3294* (2013.01)

(58) Field of Classification Search
None
See application file for complete search history.

(56) References Cited

U.S. PATENT DOCUMENTS 3,039,232 A * 6/1962 Dunn ..... E04D 5/146 52/396.04
3,093,935 A * 6/1963 Dunn ..... G03G 9/08 52/309.8
3,380,210 A * 4/1968 Neal ..... E06B 1/38 52/235

(Continued)

*Primary Examiner* — Basil S Katcheves
(74) *Attorney, Agent, or Firm* — Blynn L. Shideler; Krisanne Shideler; BLK Law Group

(57) ABSTRACT

Wall systems and buildings having such wall systems are disclosed. Such wall systems include parametric mullions each of which is constructed from a plurality of interconnecting components so that the wall systems may be disposed much closer to the building frame than conventional wall systems. Such wall systems may include panels disposed to form convex or concave facades. Such wall systems may also include decorative features superimposed over one or more panels or extending outward from the facade surface. The parametric mullions may be formed into trusses which may be used as part of a wall system or independently of such wall systems.

31 Claims, 41 Drawing Sheets

(56) References Cited

U.S. PATENT DOCUMENTS

| | | | | | |
|---|---|---|---|---|---|
| 3,423,892 | A * | 1/1969 | Rimington | E04B 2/78 | 52/241 |
| D245,106 | S * | 7/1977 | Scheid | D25/125 | |
| 4,648,231 | A | 3/1987 | Laroche | | |
| 4,891,920 | A * | 1/1990 | Pingston | E04B 2/7409 | 181/287 |
| 5,036,640 | A | 8/1991 | Niwata | | |
| 5,570,548 | A * | 11/1996 | Hopper | E06B 3/22 | 52/204.5 |
| 6,405,504 | B1 * | 6/2002 | Richardson | E06B 1/36 | 52/211 |
| 6,688,044 | B2 * | 2/2004 | Farrar | B60J 1/2094 | 49/375 |
| 6,711,870 | B1 * | 3/2004 | Richardson | E04D 3/14 | 52/775 |
| 9,683,367 | B1 * | 6/2017 | Ting | E04B 2/96 | |
| 2007/0113366 | A1 * | 5/2007 | Walworth | B60S 1/3856 | 15/250.32 |
| 2010/0293882 | A1 | 11/2010 | Labrecque | | |
| 2011/0113706 | A1 | 5/2011 | Krause | | |

* cited by examiner

INSULATED METAL PANEL AND CURTAIN WALL SYSTEMS

BACKGROUND

Field of the Invention

The present invention relates to insulated metal wall systems and curtain wall systems and buildings having such systems.

Background of the Invention

Insulated metal panel wall systems and curtain wall systems are used to cover the exterior and interior wall surfaces of a building. When used exteriorly, the systems are used to isolate the interior of the building from the outside environment and to enhance the building's aesthetic appeal. When used interiorly, the systems are used to divide interior spaces and to provide aesthetic appeal. An insulated metal panel wall system or a curtain wall system may be used to cover all or just a portion of the building's exterior or interior wall surfaces. Such systems are usually used to cover multiple stories.

Conventional insulated metal panel wall systems and curtain wall systems are non-structural in the sense that any contribution they make to the building's structural integrity is minor in comparison to the contribution of the building's frame. Generally, such systems do not carry any of the building's weight other than their own. Exterior insulated metal panel walls and curtain walls transfer wind loads to the building's frame.

Conventional insulated metal wall panel systems are attached to a frame system which in turn is attached to the building's frame. In general, such systems comprise column-like vertical elements, called mullions, which are attached in some manner to the building's frame. Such walls also comprise panels which are attached in some manner to the mullions. The panels may include insets which are transparent, e.g., glass panes, or non-transparent, e.g. insulated metal panes. In many instances, each of the mullions and each of the panels have to be specifically designed for the particular building on which the system is to be used.

Because insulated metal panel wall systems and curtain wall systems are attached to the building's frame, the systems must be able to accommodate any sway or movement experienced by the building due to wind, seismic, or other forces, while maintaining their ability to isolate the environment on one side of the wall from that on the other side of the wall. Exterior insulated metal panel systems and curtain wall systems also must be able to carry away impinging water, e.g. from rain, snow, and washing, and to help minimize heat transfer between the building's interior and the outside atmosphere.

SUMMARY OF THE INVENTION

It is an object of the present invention to provide insulated metal panel wall systems and curtain wall systems that lessen the design cost component of the wall system as applied to a building.

It is an object of the present invention to provide insulated metal panel wall systems and curtain wall systems that minimize the cost of construction of the insulated metal panel wall or curtain wall.

It is an object of the present invention to provide insulated metal panel wall systems and curtain wall systems that minimize the cost of installation of the insulated metal panel wall or curtain wall.

It is an object of the present invention to provide insulated metal panel wall systems that provide improved attachment structures for panels which comprise insulation slabs.

It is an object of the present invention to provide insulated metal panel wall systems and curtain wall systems that comprise pivot connections which permit panels to be fixed at any desired acute or obtuse angles from one another.

It is an object of the present invention to provide insulated metal panel wall systems and curtain wall systems that comprise parametric mullion systems and parametric mullions comprising interchangeable components.

It is an object of the present invention to provide parametric mullions which can be configured to be structural components of a building.

It is an object of the present invention to provide parametric mullions which allow the inventive parametric mullion to be anchored at the edge of a deck.

It is an object of the present invention to provide insulated metal panel wall systems and curtain wall systems which make it possible to maximize the amount of the deck surface available for use as part of the interior space of the building.

It is an object of the present invention to provide parametric mullions that can be located so as to minimize the moment the insulated metal panel wall or curtain wall exerts on the building to which it is attached.

It is an object of the present invention to provide insulated metal panel wall systems and curtain wall systems that reduced or eliminate the need to enhance the structural strength of the building frame to accommodate the moment couple load applied to a building by the insulated metal wall system or curtain wall system.

It is an object of the present invention to provide insulated metal panel wall systems and curtain wall systems that place the insulated metal panel wall or curtain wall panels flush to the building frame.

It is an object of the present invention to provide curtain wall systems that include conduits for the building's exterior wall electrical and communication wiring.

It is an object of the present invention to provide curtain wall systems that comprise framed decorative components which overlay the exterior of the selected portions of the wall surfaced formed by a system's panels and other decorative components which extend outwardly from the wall's facade.

It is an object of the present invention to provide insulated metal panel wall systems and curtain wall systems that utilize thermal breaks as structural elements of the panel attachment components.

It is an object of the present invention to provide insulated metal panel wall systems and curtain wall systems that comprise pivot connections between the system's parametric mullions and panels.

It is an object of the present invention to provide insulated metal panel wall systems and curtain wall systems that comprise parametric mullions adjustably anchored to a building's decks.

It is an object of the present invention to provide curtain wall systems that comprise one or more of the prefabricated building panels described in U.S. Pat. No. 9,273,463 B1 to the present inventor.

It is an object of the present invention to provide curtain wall systems that comprise one or more of the building environmental control systems described in U.S. Pat. No. 9,273,463 B1 to the present inventor.

It is an object of the present invention to provide insulated metal panel wall systems and curtain wall systems that accommodate deflections of the building's decks.

It is an object of the present invention to provide insulated metal panel wall systems and curtain wall systems that are capable of complying with the International Building Code requirements for wind and seismic loads.

It is an object of the present invention to provide curtain wall systems for cladding the exterior of a building that provide finished surfaces on their interior facing sides thus obviating the need for the application of drywall or other coverings to the building's exterior walls.

It is an object of the present invention to provide curved insulated metal panel walls and curved curtain walls or in segments.

It is an object of the present invention to provide multi-directionally curved insulated metal panel curtain walls or in segments.

It is an object of the present invention to provide insulated metal panel wall systems and curtain wall systems adapted to form a full or partial dome or variations thereof.

It is an object of the present invention to provide buildings comprising one or more of the inventive insulated metal panel wall systems and curtain wall systems and/or inventive parametric mullions described herein.

It is an object of the present invention to provide insulated metal panel wall systems and curtain wall systems that provide for the accommodation of electrical conduits within at least one of their panels.

It is an object of the present invention to provide insulated metal panel wall systems and curtain wall systems that utilize single-facial or bi-facial solar panels.

It is an object of the present invention to provide insulated metal panel wall systems and curtain wall systems that include air gap assemblies.

The present invention provides insulated metal panel wall system, curtain wall system, and parametric mullion embodiments that meet one or more of the foregoing objects. The present invention also includes methods of constructing and using such insulated metal panel wall systems and curtain wall systems and parametric mullions. The present invention also includes buildings which comprise one or more insulated metal panel wall systems and curtain wall systems and/or parametric mullions and a frame adapted to receive and support the one or more such insulated metal panel wall systems and curtain wall systems and/or parametric mullions.

BRIEF DESCRIPTION OF THE DRAWINGS

The criticality of the features and merits of the present invention will be better understood by reference to the attached drawings. It is to be understood, however, that the drawings are designed for the purpose of illustration only and not as a definition of the limits of the present invention. It is also to be understood that, unless otherwise expressly indicated, the drawings are not to scale so that the relative sizes and placements of the features depicted therein are not to be taken as absolute. It is also to be understood that the drawings do not necessarily contain all features of the object depicted as portions of the object which are not necessary for a person skilled in the art to fully understand the object may be omitted for clarity or ease of presentation.

FIG. 23C is a schematic cross-cut view that is similar to that of FIG. 23B except that it depicts different designs for the water deflector, the vertical frames, the catchment extension beams, and the air seal.

TABLE 1

Figure 7:
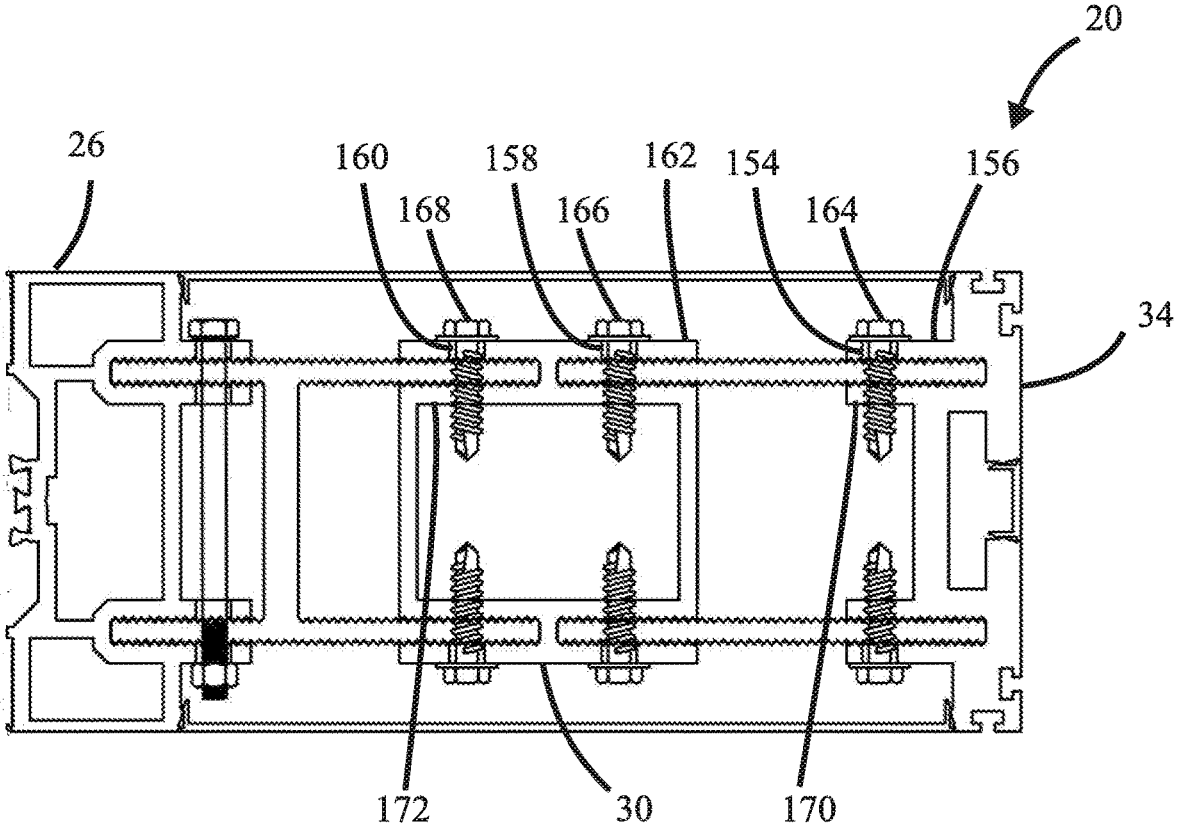
FIG. 7 is a schematic cross-sectional view of a column of an inventive parametric mullion taken at cutting plane 7-7 of FIG. 1.

| No. | Description |
|---|---|
| 10 | Mullion |
| 12 | Bottom anchor of 10 |
| 14 | Top anchor of 10 |
| 16 | Frame of building |
| 18 | [Not used] |
| 20 | Column of 10 |
| 22 | Arrow indicating outward direction |
| 24 | Line to indicate depth dimension |
| 26 | Catchment beam of 20 |
| 28 | H-beam of 20 |
| 30 | Box tube of 20 |
| 32a, b | Serrated plates of 20 |
| 34 | Double-T beam of 20 |
| 36 | Leg of 28 |
| 38 | Web of 28 |
| 40 | Serrated cavity of 26 |
| 42a, b | Side covers of 10 |
| 44 | Strip cover of 10 |
| 46 | Recess on face of 34 |
| 48-58 | [Not used] |
| 60 | Column |
| 62 | Catchment beam of 60 |
| 64 | H-beam of 60 |
| 66 | Double-T beam of 60 |
| 68a, b | Side covers of 60 |
| 70 | Strip cover of 60 |
| 72 | Column |
| 74 | Catchment beam of 70 |
| 76 | H-beam of 70 |
| 78 | Box tube of 70 |
| 80a, b | Serrated plates of 70 |
| 82 | Double-T beam of 70 |
| 84a, b | Legs of 76 |
| 86a, b | Side covers of 70 |
| 88 | Strip cover of 70 |
| 90 | Outward face of 26 |
| 92a, b | Connector slots of 26 |
| 94 | [Not used] |
| 96 | Second catchment beam |
| 98a, b | Cavities of 96 |
| 100 | Outward face of 96 |
| 102 | Connector slot of 96 |
| 104 | One of plurality of small slots of 96 |
| 106 | Deck |
| 108 | Anchor of 10 |
| 110a, b | First screws |
| 112 | Second screw |
| 114 | Third screw |
| 116a, b | First holes |
| 118 | Second hole |
| 120 | Base plate of 10 |
| 122a, b | Flanged connectors of 10 |
| 124a, b | Serrated washer plates |
| 126 | Anchor bolt |
| 128a, b | Base plate bolts |
| 130 | Base plate hole |
| 132 | Deck bolt |
| 134 | Deck bolt nut |
| 136 | Top surface of 120 |
| 138 | Base plate slot |
| 140 | Base plate bolt nut |
| 142 | Flanged connector outer face |
| 144 | H beam leg inner face |
| 146 | Inner face of 124b |
| 148 | Center hole of 124a |
| 150 | Slot of 28 |
| 152 | Bolt hole of 122a |
| 153 | Connector nut |
| 154 | First hole in FIG. 7 |
| 156 | Outer lateral face of 34 |
| 158 | Second hole in FIG. 7 |
| 160 | Third hole in FIG. 7 |
| 162 | Outer lateral face of 34 |
| 164 | First screw in FIG. 7 |
| 166 | Second screw in FIG. 7 |
| 168 | Third screw in FIG. 7 |
| 170 | Inner lateral face of 34 |
| 172 | Inner lateral face of 28 |

TABLE 1-continued

Figure 8:
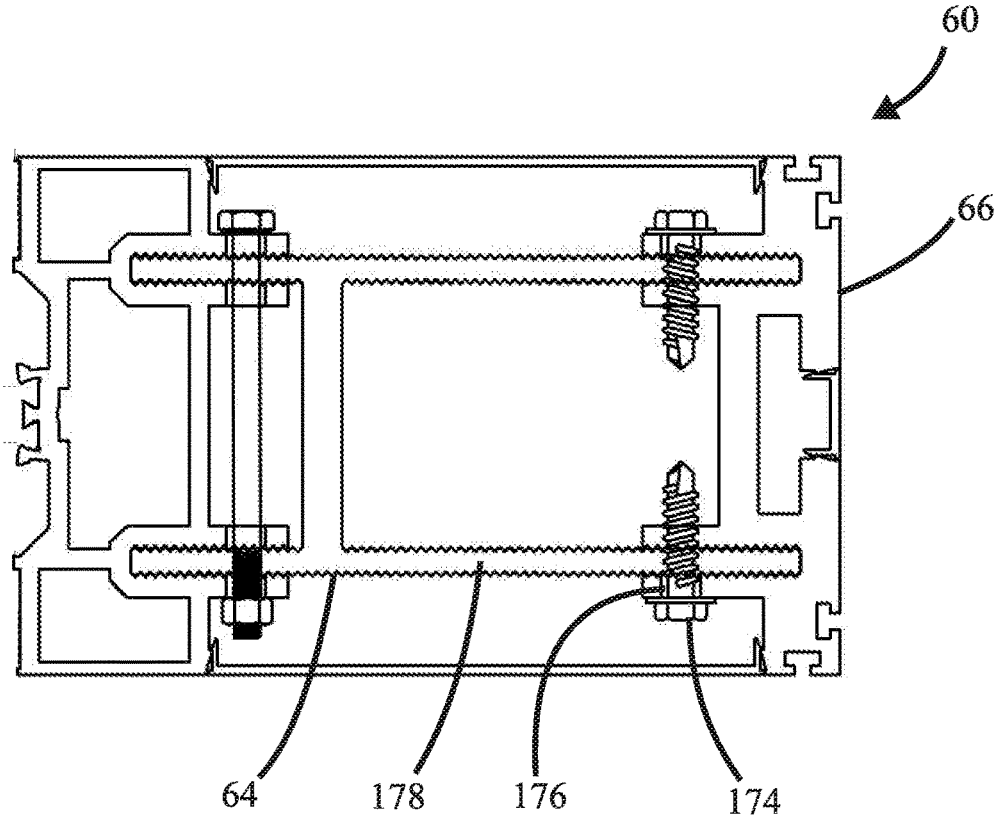
FIG. 8 is another schematic cross-section of the column of a parametric mullion of FIG. 3 that is taken at a location different from that which appears in FIG. 3.
Figure 9:
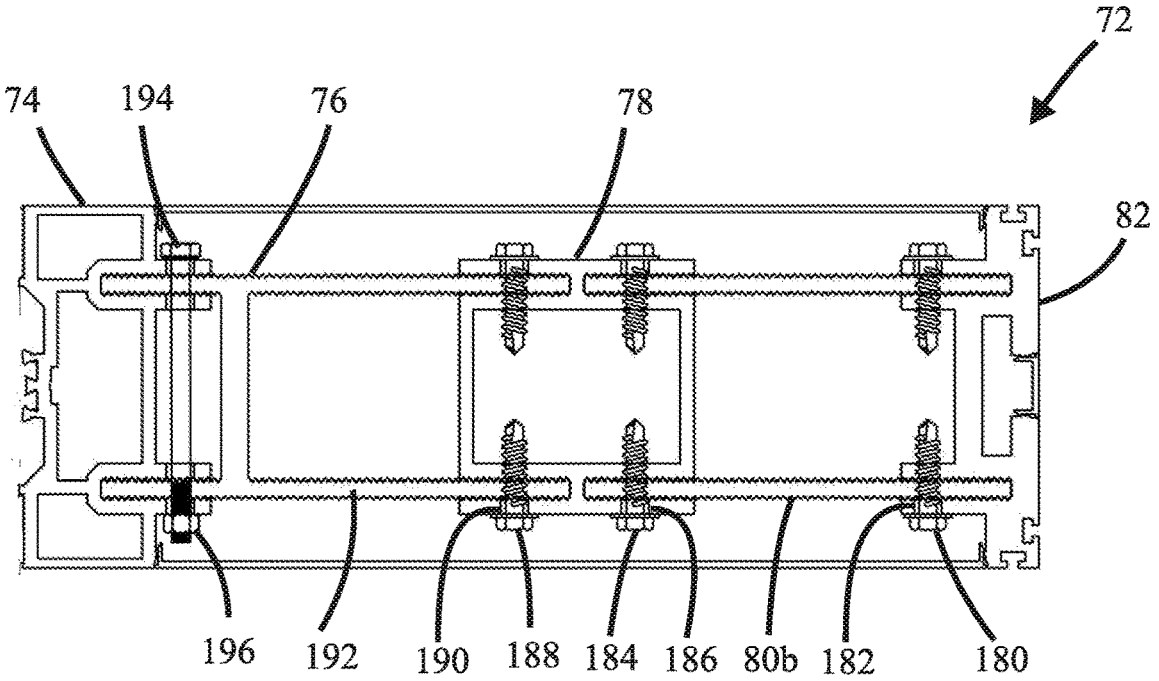
FIG. 9 is another schematic cross-section of the column of a parametric mullion of FIG. 4 that is taken at a location different from that which appears in FIG. 4.
Figure 10:
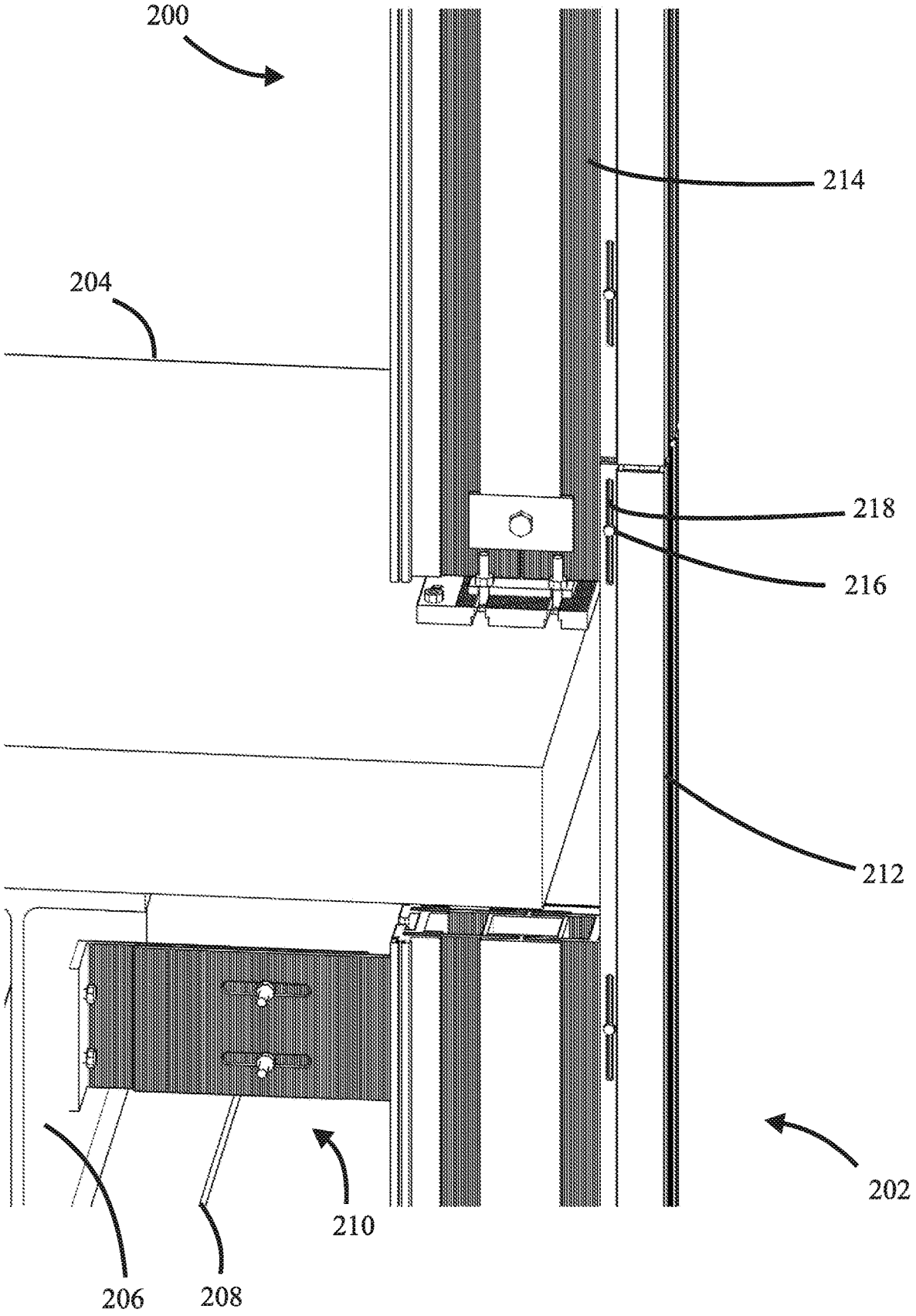
FIG. 10 is a schematic perspective view depicting portions of spliced-together parametric mullions on adjacent stories of a building according to an embodiment.
Figure 12A:
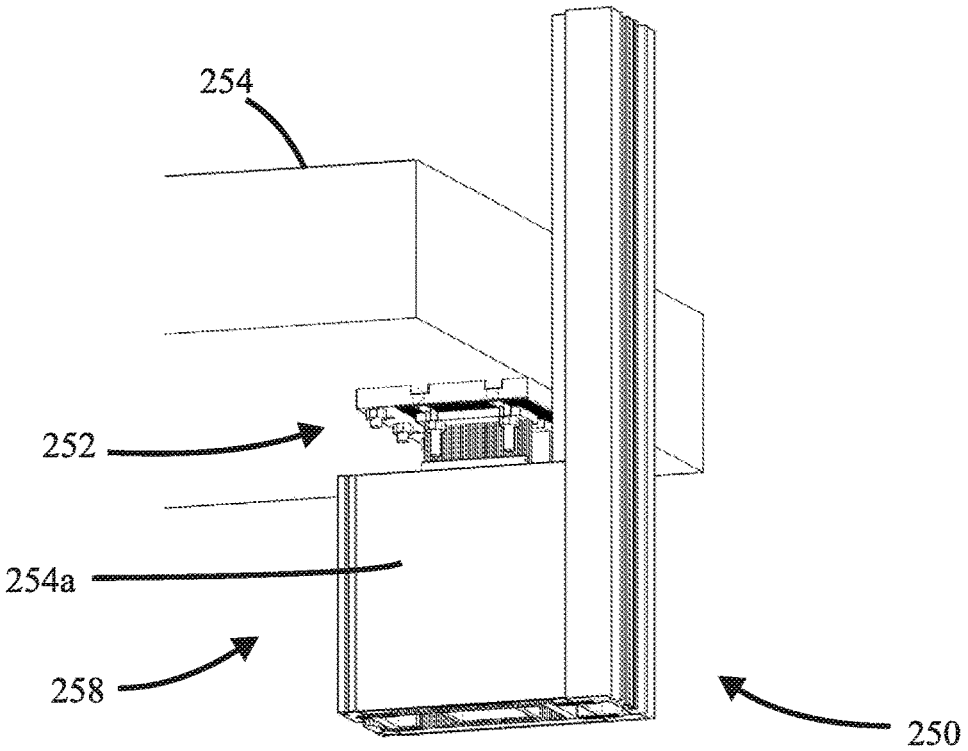
FIG. 12 A is a schematic perspective, partly cutaway view of just the top portion of a parametric mullion having its vertically-disposed top anchor attached to the underside of a deck.
FIG. 12B is a schematic, perspective, partly cutaway view of top portion of the parametric mullion as in FIG. 12A, except that one side cover (see FIG. 12A) is not shown (although another side cover is shown) and the remainder of the components of the parametric mullion are shown in a laterally exploded relationship to one another.
Figure 12B:
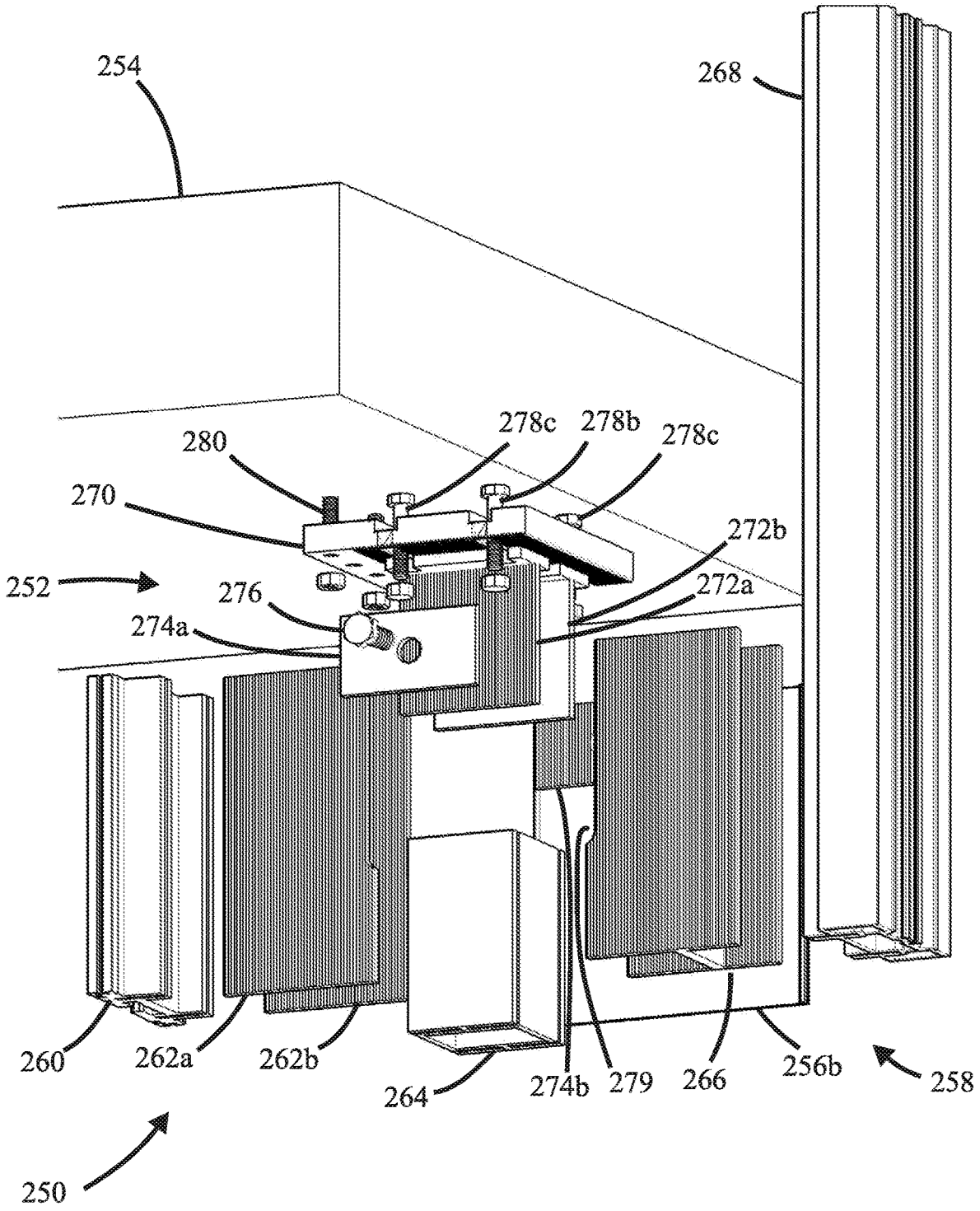
Figure 14:
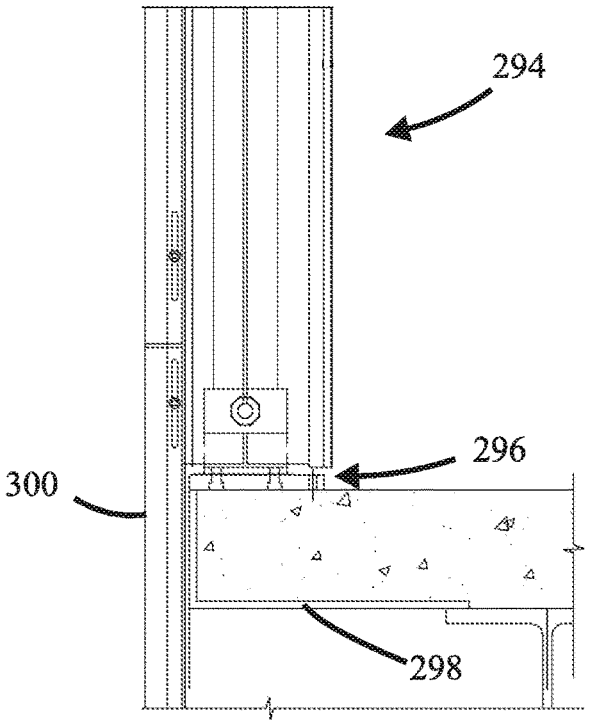
FIG. 14 shows a schematic side view of a parametric mullion (without its side covers) that is used as part of a parapet.
Figure 15:
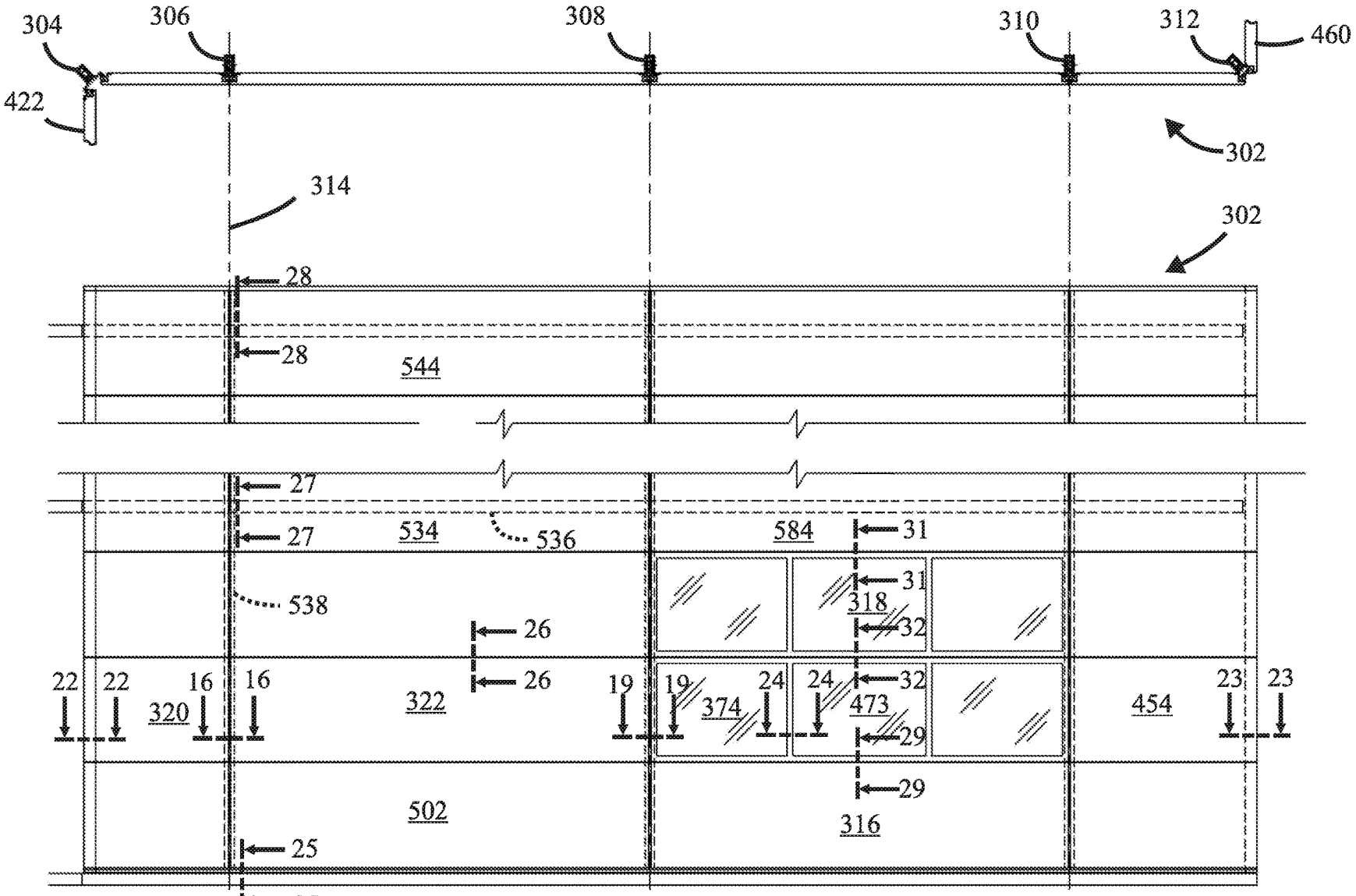
FIG. 15 shows in its lower section a schematic discontinuous front view of an embodiment of a portion of a insulated metal panel wall system and in its upper section a plan view of the insulated metal panel wall so as to illustrate the nature of the angles between adjacent panels of the insulated metal panel wall at five vertical parametric mullion stacks.

| No. | Description |
|---|---|
| 174 | Screw of FIG. 8 |
| 176 | Hole of FIG. 8 |
| 178 | Leg of 64 |
| 180 | First screw of FIG. 9 |
| 182 | First hole of FIG. 9 |
| 184 | Second screw of FIG. 9 |
| 186 | Second hole of FIG. 9 |
| 188 | Third screw of FIG. 9 |
| 190 | Third hole of FIG. 9 |
| 192 | Leg of 76 |
| 194 | Bolt of FIG. 9 |
| 196 | Nut for 194 |
| 198 | [Not used] |
| 200 | First mullion of FIG. 10 |
| 202 | Second mullion of FIG. 10 |
| 204 | Deck of FIG. 10 |
| 206 | Web of 208 |
| 208 | Girder |
| 210 | Top anchor of 202 |
| 212 | Catchment beam of 202 |
| 214 | H-beam of 200 |
| 216 | Fastener |
| 218 | First slot |
| 220 | Angle-bottom connector of 210 |
| 222 | Flange-bottom connector of 210 |
| 224 | Bottom plate of 220 |
| 226 | Flange of 222 |
| 228 | Flange cavity of 230 |
| 230 | Dual-T beam of 202 |
| 232 | Lateral face of 220 |
| 234 | Lateral face of 222 |
| 236 | Hole of 232 |
| 238 | Slot of 234 |
| 240 | Bolt |
| 242 | Nut |
| 244 | Serrated washer plate |
| 246-248 | [Not used] |
| 250 | Mullion of FIGS. 12A-12B |
| 252 | Top anchor of 250 |
| 254 | Deck |
| 256 | Side cover of 250 |
| 258 | Column of 250 |
| 260 | Double-T beam of 250 |
| 262a, b | Serrated plates of 250 |
| 264 | Box beam of 250 |
| 266 | H-beam of 250 |
| 268 | Catchment beam of 250 |
| 270 | Base plate of 252 |
| 272a, b | Serrated washer plates of 252 |
| 274a, b | Anchor bolts of 252 |
| 276 | Second bolts of 252 |
| 278a-c | Base plate bolts of 252 |
| 279 | Vertical slot of inner facing edge of 266 |
| 280 | Deck bolt of 254 |
| 281 | Mullion stack |
| 282 | Ground floor mullion |
| 284 | Second floor mullion |
| 286 | Third floor mullion |
| 288 | Ground floor |
| 290 | Second floor |
| 292 | Third floor |
| 294 | Mullion of FIG. 14 |
| 296 | Bottom anchor of 294 |
| 298 | Deck |
| 300 | Catchment beam |
| 302 | Insulated metal wall of FIG. 15 |
| 304 | First mullion stack of 302 |
| 306 | Second mullion stack of 302 |
| 308 | Third mullion stack of 302 |
| 310 | Fourth mullion stack of 302 |
| 312 | Fifth mullion stack of 302 |
| 314 | Unevenly dashed correlation line |
| 316 | First insulated metal panel of 302 |
| 318 | First glass panel of 302 |
| 320 | Second insulated metal panel of 302 |
| 322 | Third insulated metal panel of 302 |
| 324 | Mullion of 306 |
| 326 | Catchment beam of 324 |

TABLE 1-continued

Figure 16:
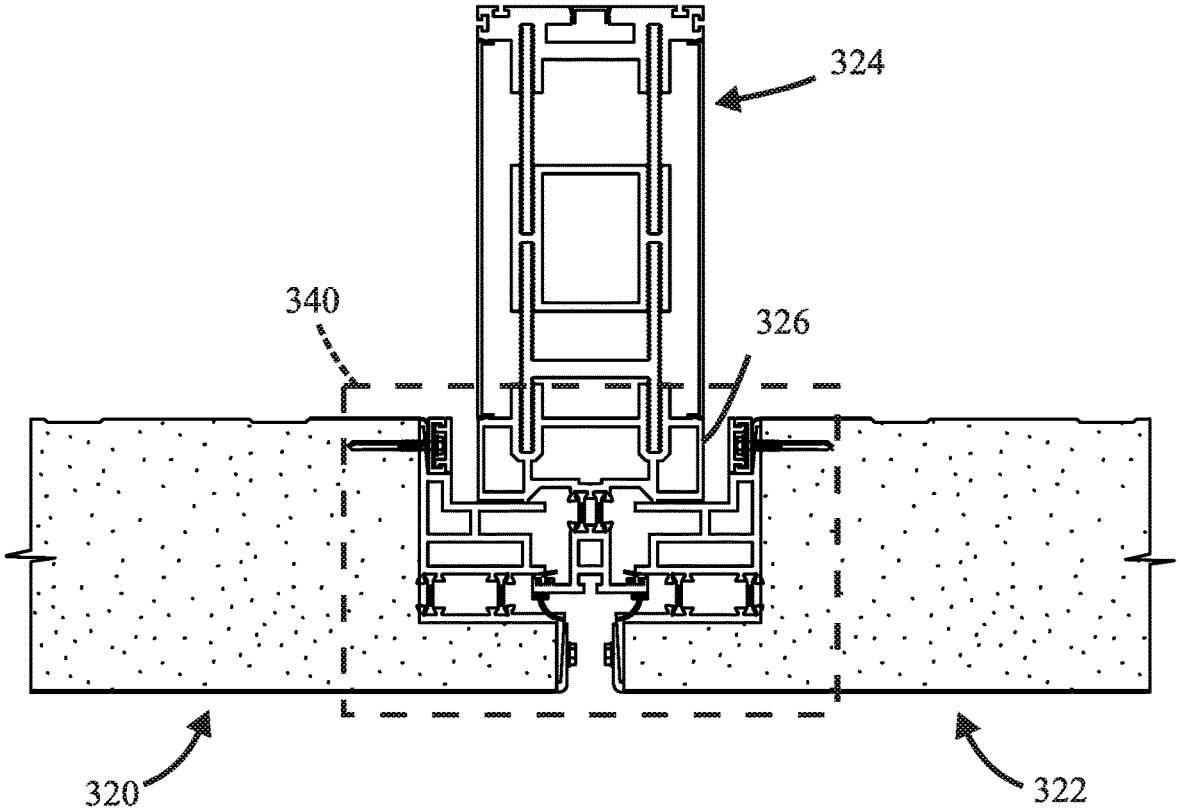
FIG. 16 is a schematic cross-sectional view taken at cutting plane 16-16 in FIG. 15.
Figure 18A:
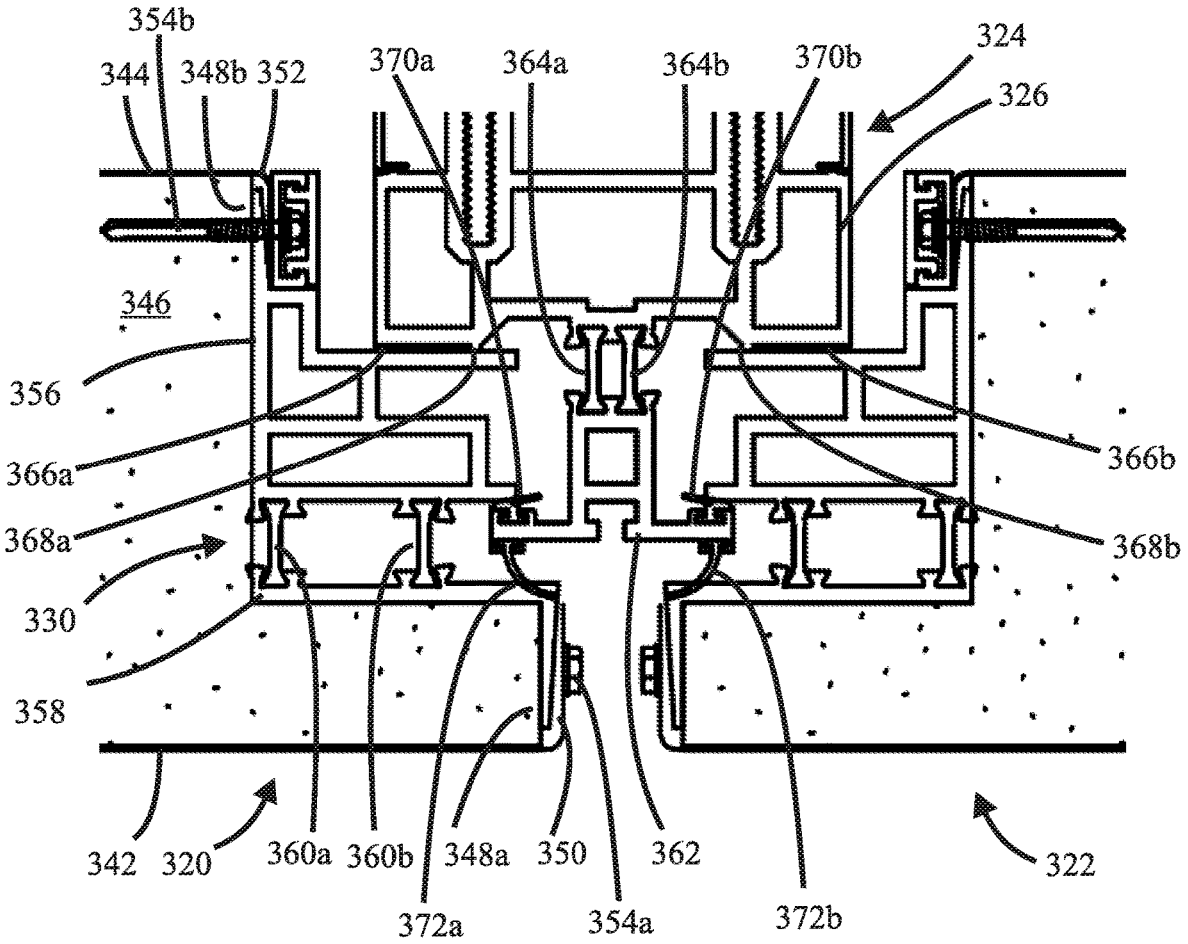
FIG. 18A is a closer view of the area contained within the dashed-line box in FIG. 16.
Figure 18B:
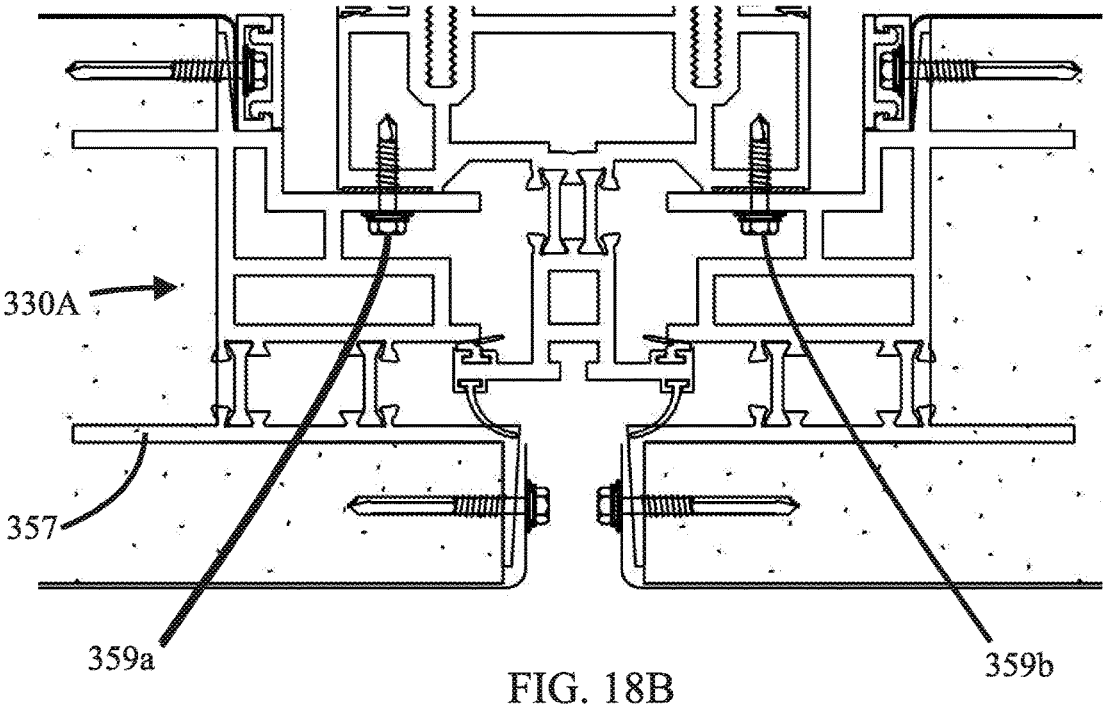
FIG. 18B shows the same schematic cross-sectional view that is shown in FIG. 18A in which the vertical member of the insulated metal panels have been replaced by alternate vertical members.
Figure 19:
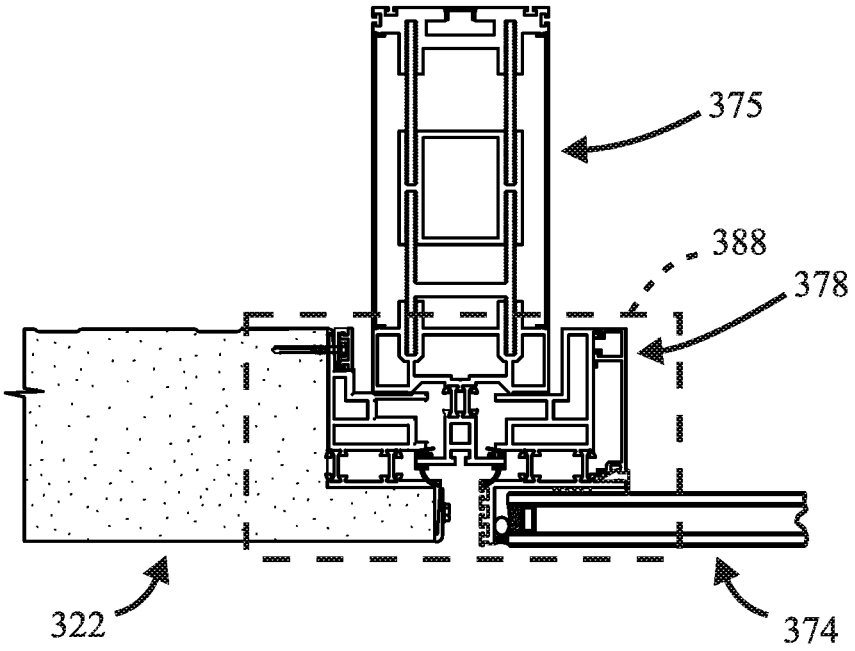
FIG. 19 is a schematic cross-sectional view taken at cutting plane 19-19 in FIG. 15.
Figure 23A:
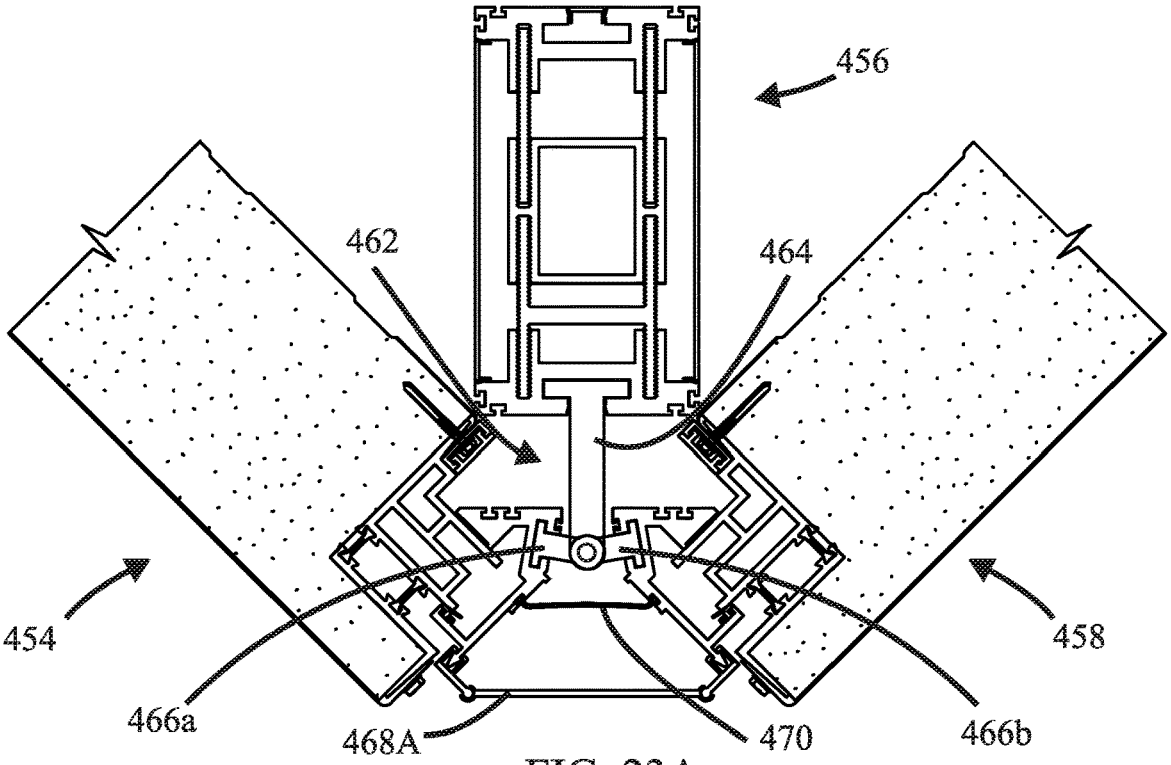
FIG. 23A is a schematic cross-cut view taken at cutting plane 23-23 in FIG. 15.

| No. | Description |
|---|---|
| 328 | First insulation inset of 320 |
| 330 | First vertical frame member of 320 |
| 330A | Alternate first vertical frame member of FIG. 18B |
| 332 | Insulated metal panel frame |
| 334 | First vertical member of 332 |
| 335 | Second vertical member 332 |
| 336 | Sill member of 332 |
| 338 | Head member of 332 |
| 340 | Dashed line box of FIG. 16 |
| 342 | Outward-facing shell of 320 |
| 344 | Inward-facing cover of 320 |
| 346 | Foam insulation slab of 320 |
| 348a, b | Beveled ends of 334 |
| 350 | Beveled end tab of 342 |
| 352 | Beveled end tab of 344 |
| 354a, b | Connecting screws |
| 356 | Inward member of 330 |
| 357 | Ridge |
| 358 | Outward member of 330 |
| 359a, b | Securing screws |
| 360a, b | First and second insulating connectors |
| 362 | Catchment extension beam |
| 364a, b | Third and fourth insulating connectors |
| 366a, b | Seal gaskets attached to 326 |
| 368a, b | Alignment grooves of 326 |
| 370a, b | Seal gaskets attached to 362 |
| 372a, b | Wipe gaskets attached to 362 |
| 374 | Second glass panel of 302 |
| 375 | Mullion of 308 |
| 376 | First glass pane inset of 374 |
| 378 | First vertical member of 380 |
| 380 | Frame of 374 |
| 382 | Second vertical member of 380 |
| 384 | First horizontal member of 380 |
| 386 | Second horizontal member of 380 |
| 388 | Enlargement box of FIG. 19 |
| 390 | Inward member of 378 |
| 392 | Outward member of 378 |
| 394a, b | Insulating connectors |
| 396 | Glazing member |
| 398 | Gasket |
| 400 | Adhesive strip |
| 402 | Water seal |
| 404 | Catchment beam of 375 |
| 406 | Strip seal of 404 |
| 408 | Alignment ridge of 406 |
| 410 | Catchment extension beam |
| 411 | Flanged insulating connector |
| 412 | Seal gasket |
| 414 | Wipe gasket |
| 416 | [Not used] |
| 418 | Mullion of 304 |
| 420 | Fourth insulated metal panel |
| 422 | Panel stack |
| 424 | Catchment beam of 418 |
| 426 | Flange connector portion of 428 |
| 428 | Inside corner T-bar connector |
| 430 | Rotatable connector of 428 |
| 432 | Catchment extension beam |
| 433 | Pin |
| 434 | Strip seal |
| 436 | Alignment ridge |
| 438 | Gasket |
| 440 | Inward member of 320 |
| 442 | Water deflector |
| 444 | Air seal |
| 446 | Cover |
| 448 | First member of 446 |
| 450 | Second member of 446 |
| 452 | Rotatable snap connection |
| 454 | Fifth insulated metal panel |
| 456 | Mullion of FIG. 23A |
| 458 | Sixth insulated metal panel |
| 460 | Panel stack containing 458 |
| 462 | Outside comer T-bar connector |
| 464 | Outwardly extending portion of 462 |
| 466a, b | Left and right rotatable connectors |
| 468A | Water deflector of FIG. 23A |

TABLE 1-continued

Figure 23B:
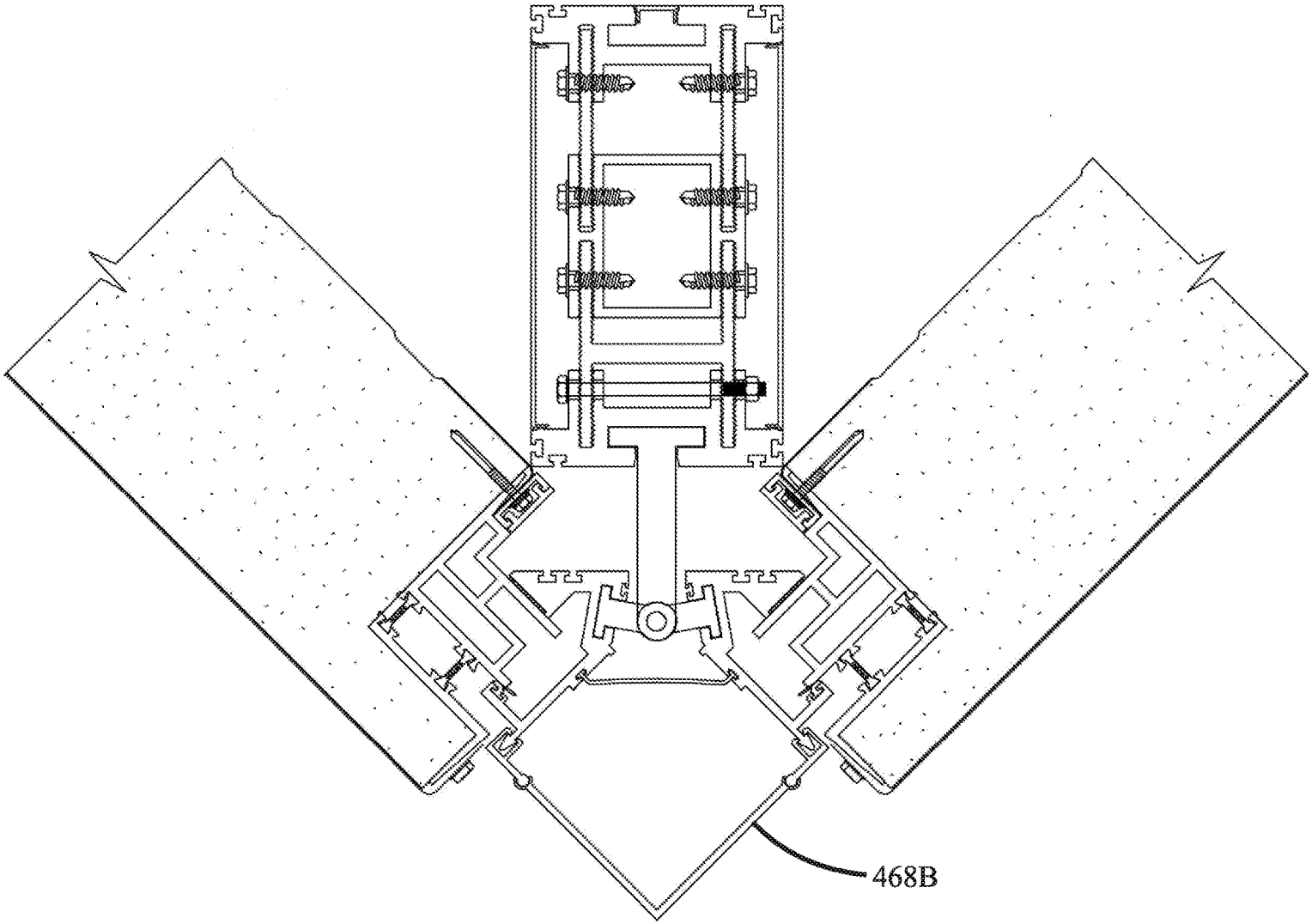
FIG. 23B is a schematic cross-cut view that is similar in every respect to that of FIG. 23A except that it depicts a different design for the water deflector.
Figure 29:
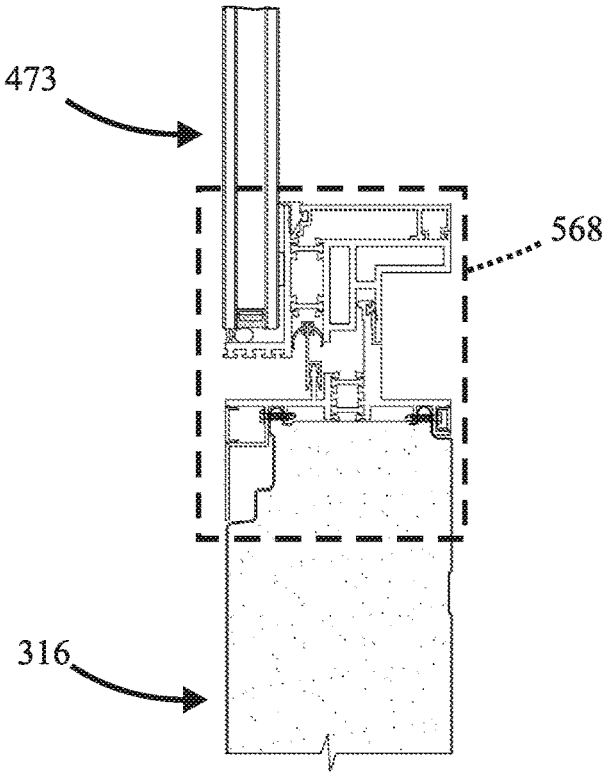
FIG. 29 is a schematic cross-sectional view taken at cutting plane 29-29 in FIG. 15.

| No. | Description |
|---|---|
| 468B | Water Deflector of FIG. 23B |
| 468C | Water Deflector of FIG. 23C |
| 469 | Alternate vertical member of FIG. 23C |
| 470 | Air seal of FIG. 23A |
| 471 | Ridge of 469 |
| 472 | Alternate attachment extension beam of FIG. 23C |
| 473 | Third glass panel of 302 |
| 474 | Second vertical frame member |
| 476 | Second glass pane inset |
| 478 | Third vertical frame member |
| 480 | Vertical joint extrusion |
| 482 | Catchment extension beam |
| 484 | Flanged insulating connector |
| 486-500 | [Not used] |
| 502 | Seventh insulated metal panel of 302 |
| 504 | Ground floor deck |
| 506 | Insulation inset of 504 |
| 508 | Base starter extrusion set of 302 |
| 510 | Inward extrusion of 508 |
| 512 | Outward extrisopm of 508 |
| 514 | Insulating connector |
| 516 | Flanged seal of 510 |
| 518 | Wiper seal of 512 |
| 520 | Screw to fasten 502 to 326 |
| 522 | Seventh insulated metal panel |
| 524 | Lower metal face of 522 |
| 526 | Upper metal face of 522 |
| 528 | Upward ridge of 322 |
| 530 | Trough of 522 |
| 532 | Caulking bead |
| 534 | Eighth insulated metal panel |
| 536 | Horizontal dashed line in FIG. 15 |
| 538 | Vertical dashed line in FIG. 15 |
| 540 | Deck |
| 542 | Parapet of 302 |
| 544 | Ninth insulated metal panel |
| 546 | Top flashing of 542 |
| 548 | [Not used] |
| 550 | Mullion |
| 552 | First screw |
| 554 | Cap extrusion of 542 |
| 556 | Second screw |
| 558 | Wedge |
| 560 | Third screw |
| 562 | Fourth screw |
| 564 | Sheathing of 302 |
| 566 | Roof membrane |
| 568 | Dashed line box of FIG. 29 |
| 570 | Head frame member of 316 |
| 571 | Screw |
| 572 | Cap |
| 573 | Outward member of 570 |
| 574 | Inward member of 570 |
| 575 | Insulating connector of 570 |
| 576 | Upward ridge of 476 |
| 577 | Cavity of 570 |
| 578 | Sill frame member of 473 |
| 579 | First vertical arm of 574 |
| 580 | Flanged bottom seal strip |
| 581 | Arrowhead connector ridge of 573 |
| 582 | Water deflector clip extrusion |
| 583a, b | Flanged bottom wipe gaskets |
| 584 | Tenth insulated metal panel |
| 585 | Sill frame member of 584 |
| 586 | Inward member of 585 |
| 587 | Outward member of 585 |
| 588 | Flanged insulating connector of 584 |
| 589 | Ridge of 586 |
| 590 | Foam insulation slab of 584 |
| 591 | Flanged bottom seal strip of 587 |
| 592 | Outward facing cover of 584 |
| 593 | Inward facing cover of 584 |
| 594 | Head frame member of 318 |
| 595 | Inward member of 594 |
| 596 | Outward member of 594 |
| 597 | Flanged insulating connector of 594 |
| 598 | Flanged bottom seal strip |
| 599 | Arrowhead connector ridge of 594 |

TABLE 1-continued

Figure 33:
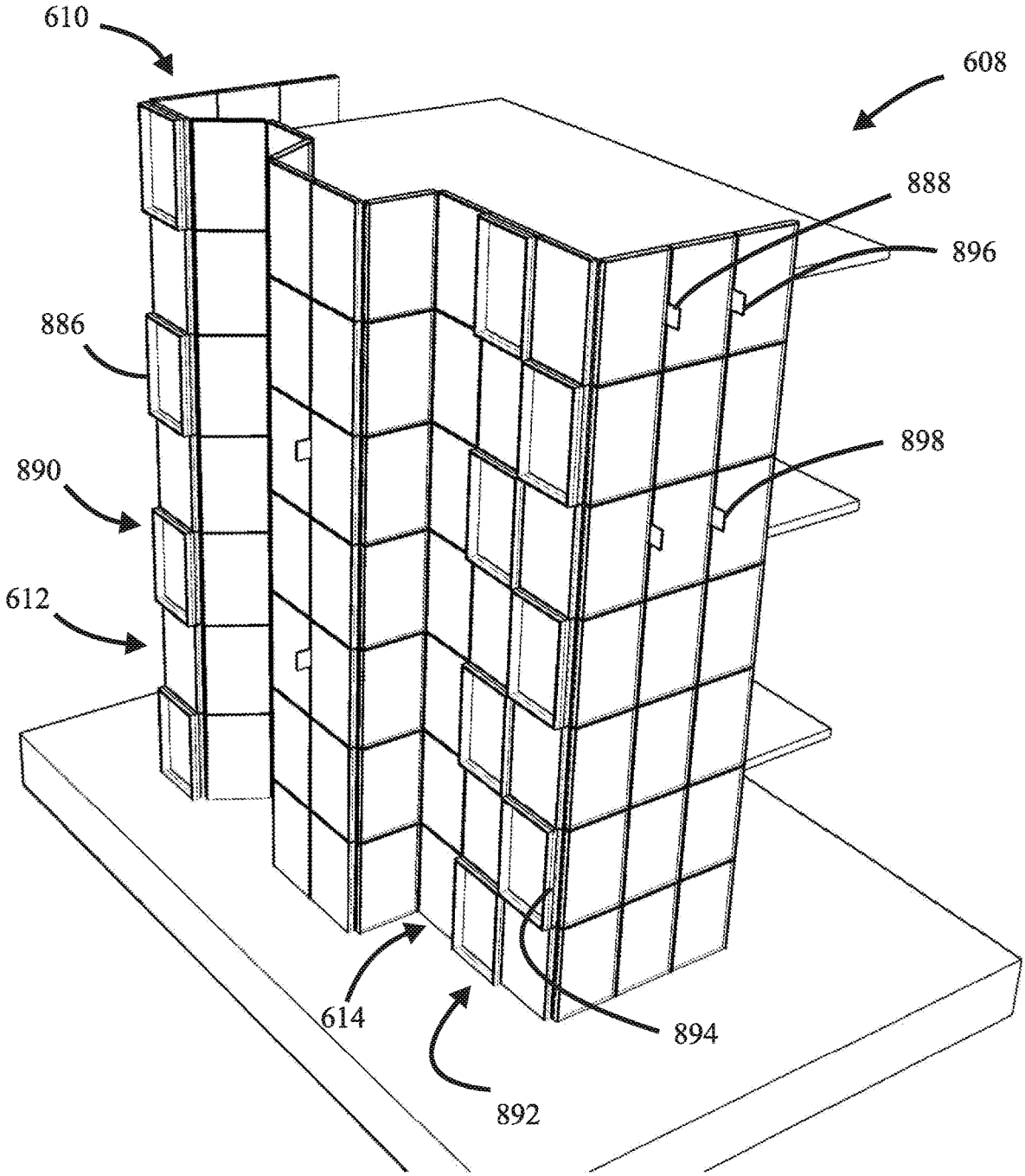
FIG. 33 is a schematic perspective view of an embodiment of a building having an embodiment of a curtain wall.
Figure 34:
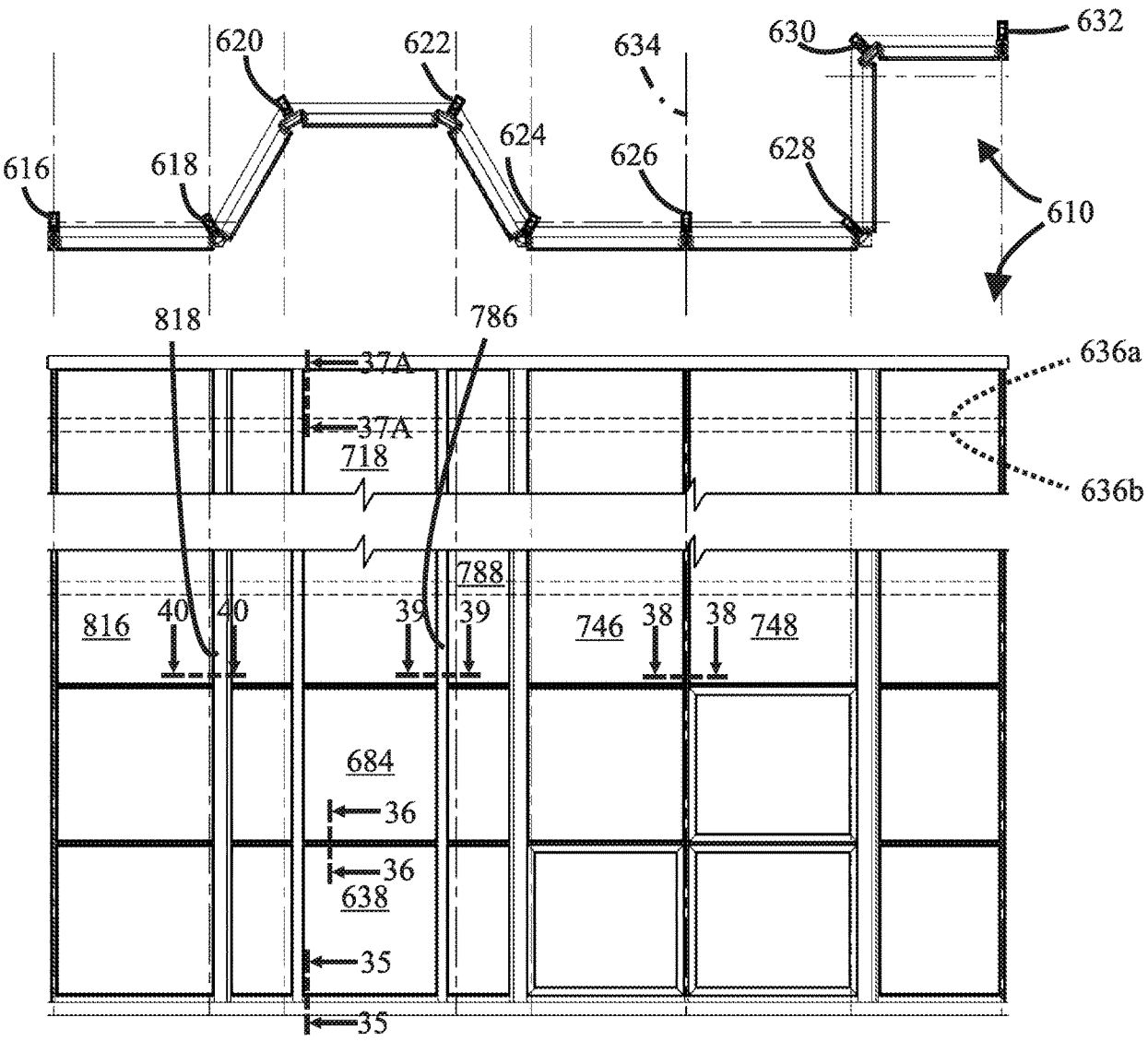
FIG. 34 shows in its lower section a schematic discontinuous front view of a curtain wall and in its upper section a plan view of the curtain wall so as to illustrate the nature of the angles between adjacent panels of the curtain wall at nine vertical parametric mullion stacks.
Figure 37A:
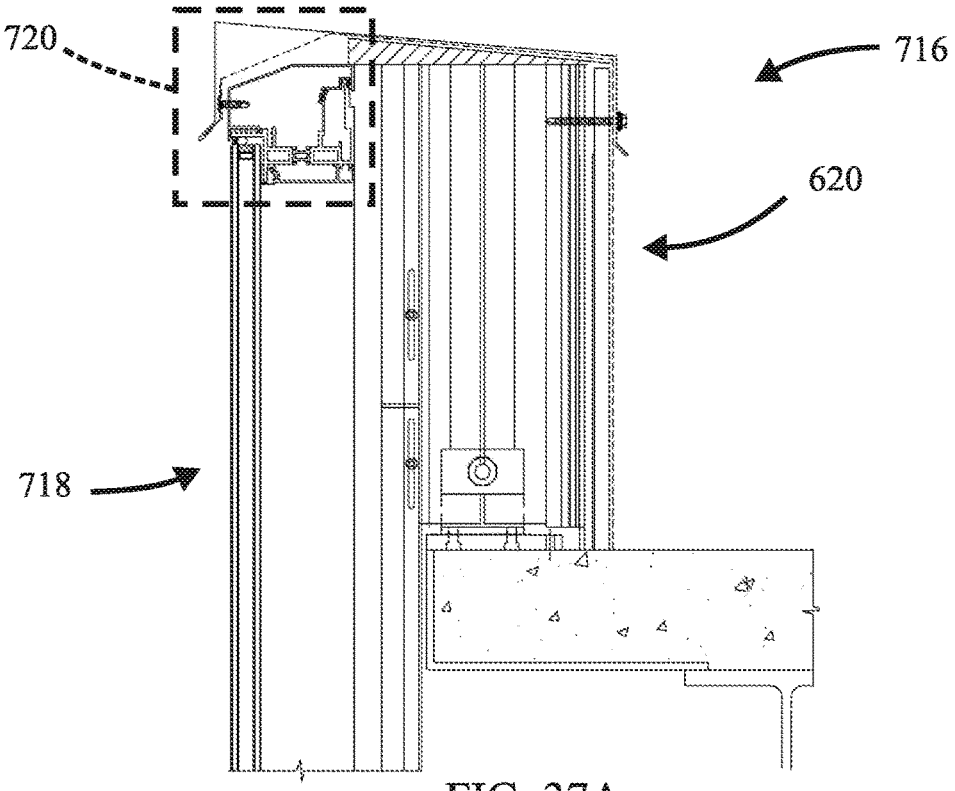
FIG. 37A is a schematic cross-sectional view taken at cutting plane 37A-37A in FIG. 34.

| No. | Description |
|---|---|
| 600 | Water deflector clip extrusion |
| 602 | Flanged bottom wipe gasket |
| 604 | Cover strip |
| 605 | Sill frame member of 318 |
| 606 | Header frame member of 473 |
| 608 | Building in FIG. 33 |
| 610 | Curtain wall of 608 |
| 612 | Leftmost panel column of 608 |
| 614 | Right-center panel column of 608 |
| 616 | First mullion column of 610 |
| 618 | Second mullion column of 610 |
| 620 | Third mullion column of 610 |
| 622 | Fourth mullion column of 610 |
| 624 | Fifth mullion column of 610 |
| 626 | Sixth mullion column of 610 |
| 628 | Seventh mullion column of 610 |
| 630 | Eighth mullion column of 610 |
| 632 | Ninth mullion column of 610 |
| 634 | Unevenly dashed line in FIG. 34 |
| 636a, b | Dashed horizontal lines indicating deck in FIG. 34 |
| 638 | First glass panel of 610 |
| 640 | Mullion of 620 |
| 642 | Screw |
| 644 | Ground floor deck of 608 |
| 646 | Base starter extrusion set of 610 |
| 648 | Inward extrusion of 646 |
| 650 | Outward extrusion of 646 |
| 652 | Insulating connector |
| 654 | Splash guard extrusion |
| 656 | Arrowhead ridge of 650 |
| 658 | Snap connector cavity of 654 |
| 660 | Glass pane insert of 638 |
| 662 | Bottom horizontal frame member of 638 |
| 664 | Inward member of 662 |
| 666 | Outward member of 662 |
| 668 | Insulating connector |
| 670 | Glazing bead of 662 |
| 672 | Sponge gasket of 662 |
| 674 | Channel of 664 |
| 676 | Vertical ridge of 650 |
| 678 | Flanged base seal |
| 680 | Arrowhead ridge of 666 |
| 682 | Snap connector cavity of 654 |
| 684 | Second glass panel of 610 |
| 686 | Glass inset of 684 |
| 688 | Bottom horizontal frame member of 684 |
| 690 | Top horizontal frame member of 638 |
| 692 | Panel head member of 690 |
| 694 | Outward member of 690 |
| 696 | Glazing bead of 690 |
| 698 | Insulating connector |
| 700 | Sponge seal |
| 701 | Rain deflector strip |
| 702 | Arrowhead ridge of 688 |
| 704 | Arrowhead ridge of 690 |
| 706 | Vertical arm of 692 |
| 708 | Elastomeric strip |
| 710 | Arrowhead ridge of 692 |
| 711 | Hole in 706 |
| 712 | Inward vertical member of 692 |
| 714 | Flanged bottom seal |
| 716 | Parapet of 610 |
| 718 | Third glass panel of 610 |
| 720 | Dashed-line box of FIG. 37A |
| 722 | Top horizontal frame member of 718 |
| 724 | Parapet cap extrusion |
| 726a, b | Lower fingers of 724 |
| 728 | Outward member of 722 |
| 730 | Channel of 724 |
| 732 | Vertical ridge of 734 |
| 734 | Inward member of 722 |
| 736 | Flanged base seal of 732 |
| 738 | Inward facing surface of 724 |
| 740 | Elastomeric strip |
| 742 | Parapet top flashing |
| 744 | Screw |
| 746 | Fourth glass panel |
| 748 | Fifth glass panel |

TABLE 1-continued

Figure 39:
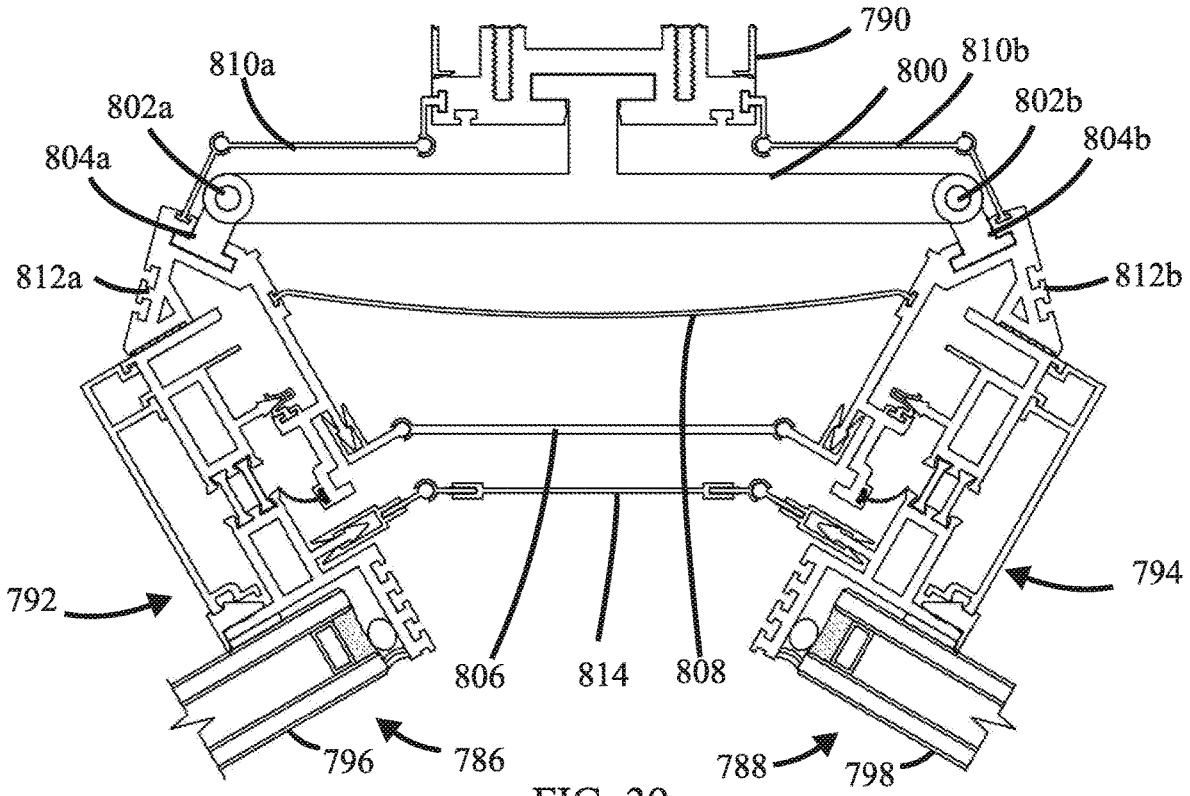
FIG. 39 is a schematic cross-cut view of taken approximately at cutting plane 39-39 in FIG. 34.
Figure 40:
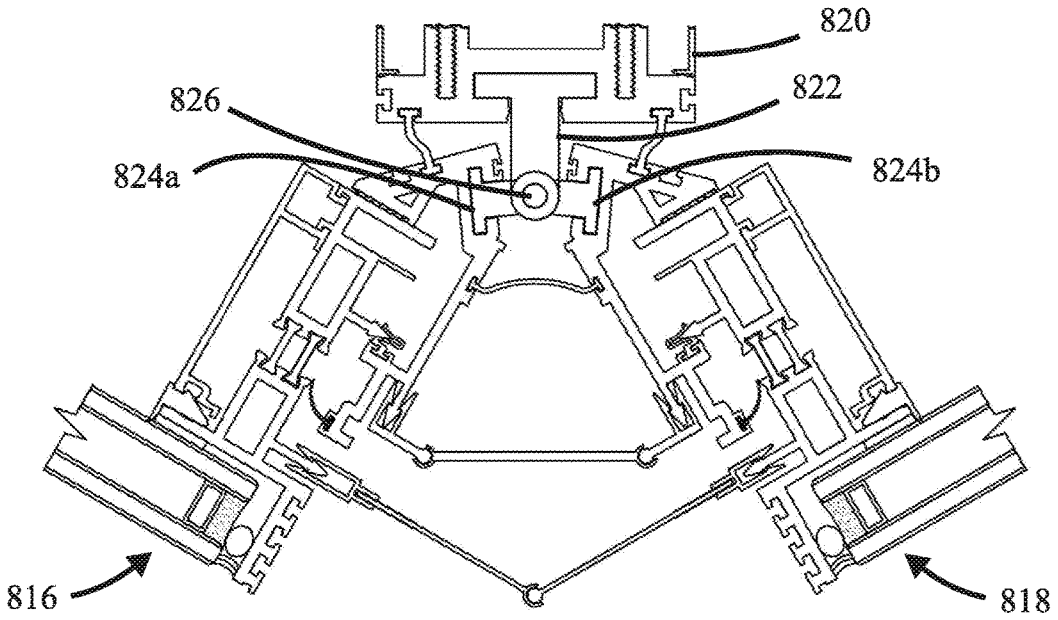
FIG. 40 is a schematic cross-cut view of taken approximately at cutting plane 40-40 in FIG. 34.
Figure 41:
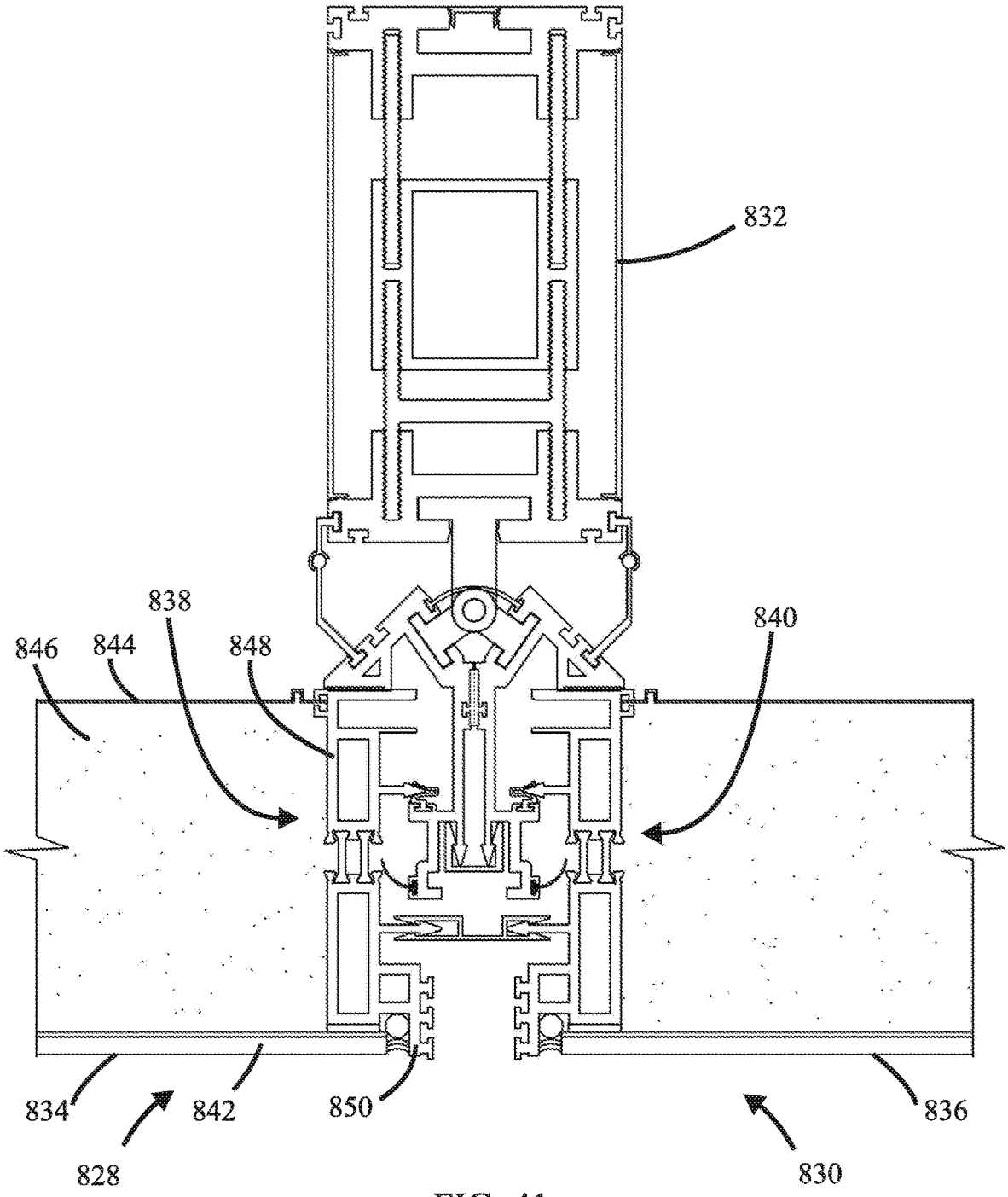
FIG. 41 is a schematic cross-cut view of the horizontal junction of a first spandrel panel, a second spandrel panel, and a parametric mullion.
Figure 42:
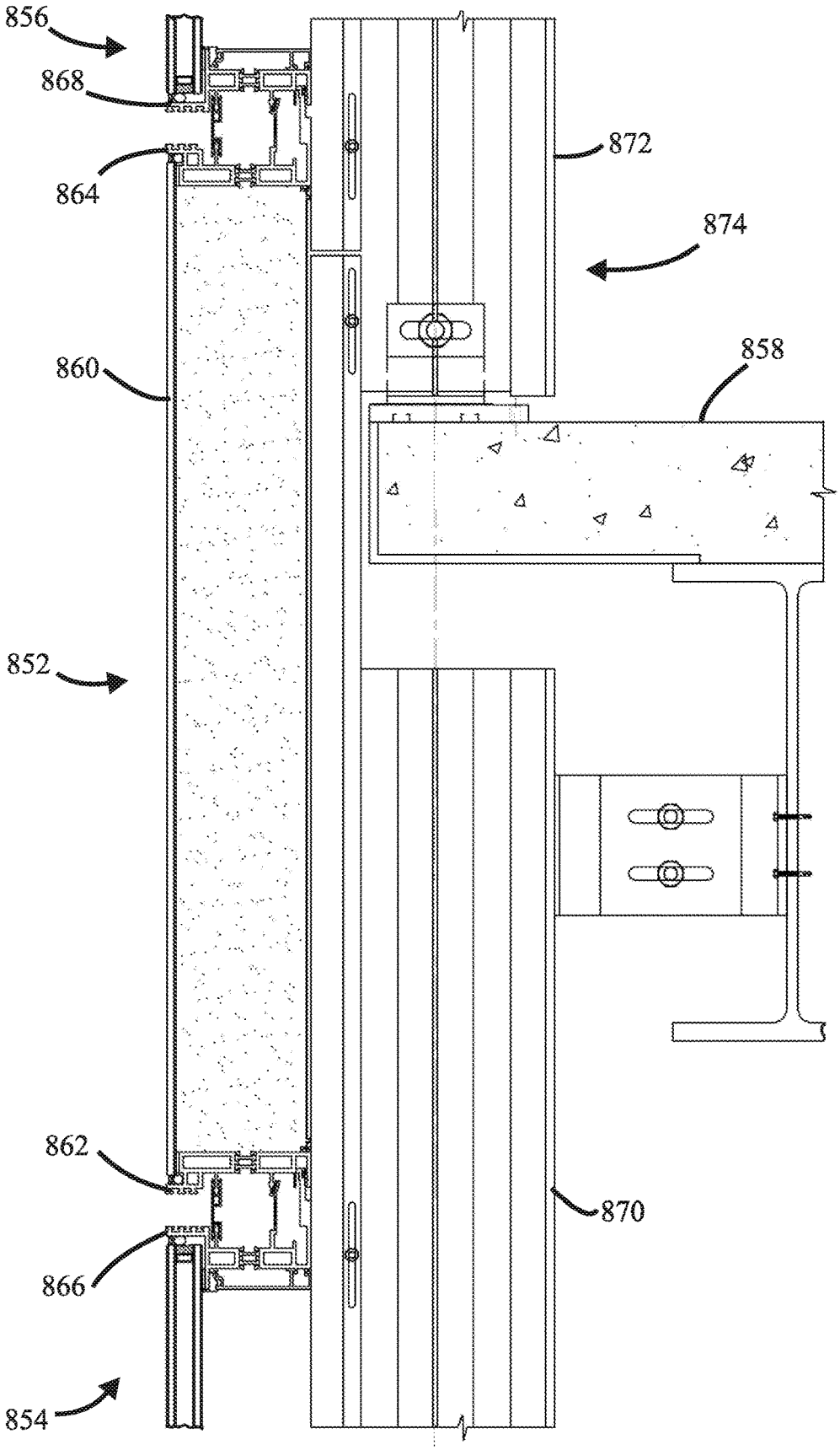
FIG. 42 is a schematic side view, partly in cross-section, of a spandrel panel connected to an upper glass panel and a lower glass panel in a manner meant to render the building frame in the vicinity of a deck invisible from a person viewing the outward facade of the curtain wall to which the panels belong.
Figure 43A:
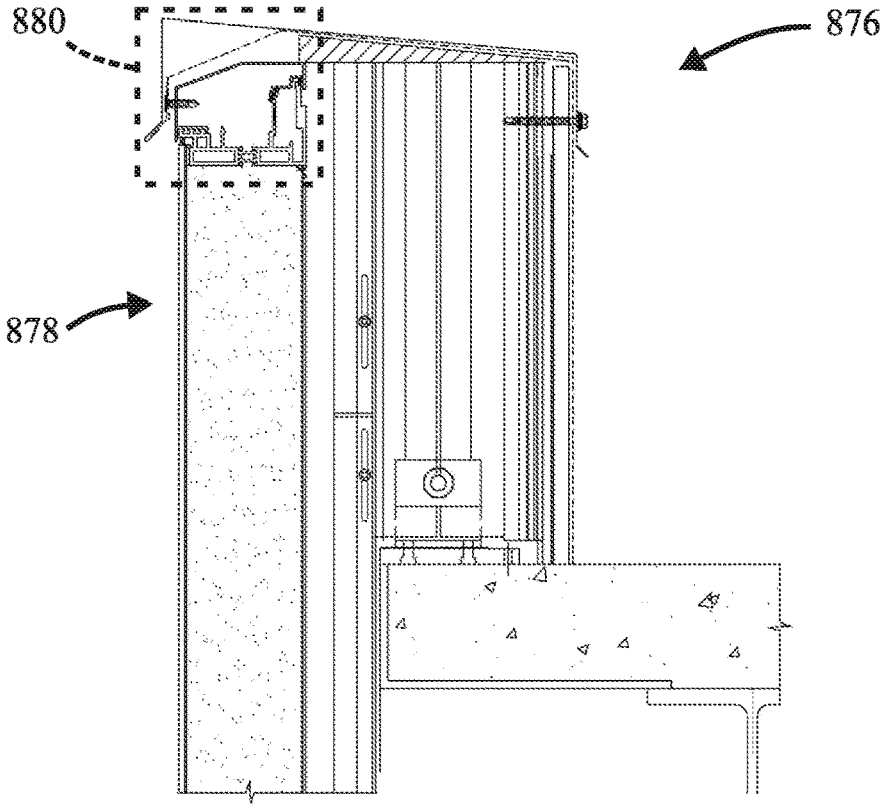
FIG. 43A is a schematic side view, partly in cross-section, showing a portion of a parapet of a curtain wall which has, at this location, a spandrel panel as its uppermost panel.
Figure 43B:
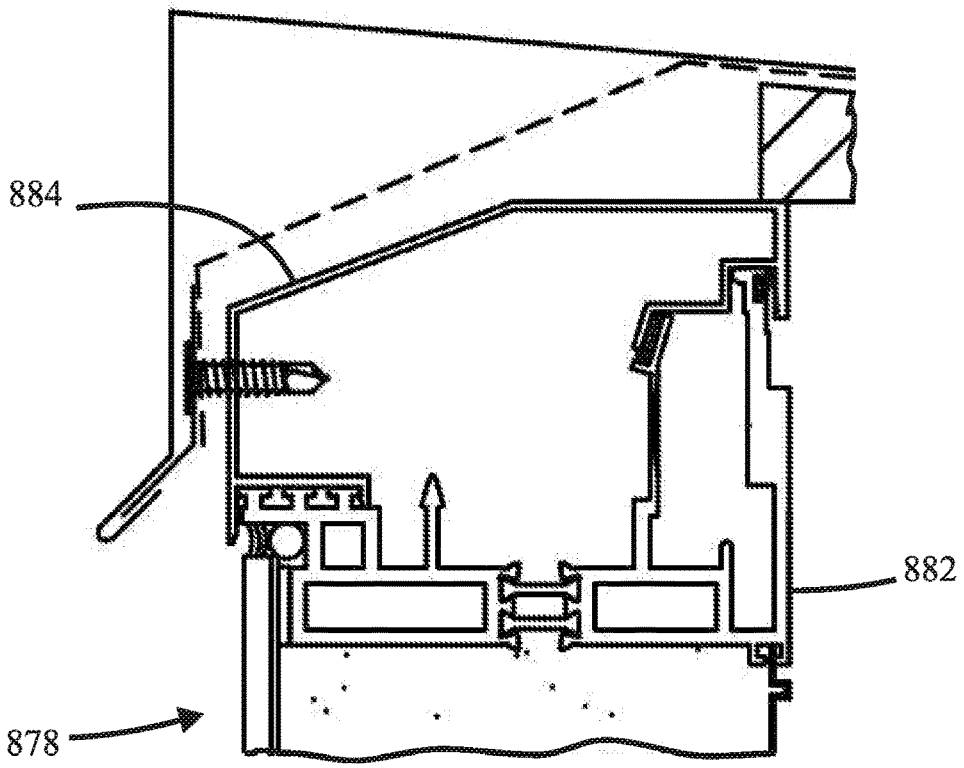
Figure 44:
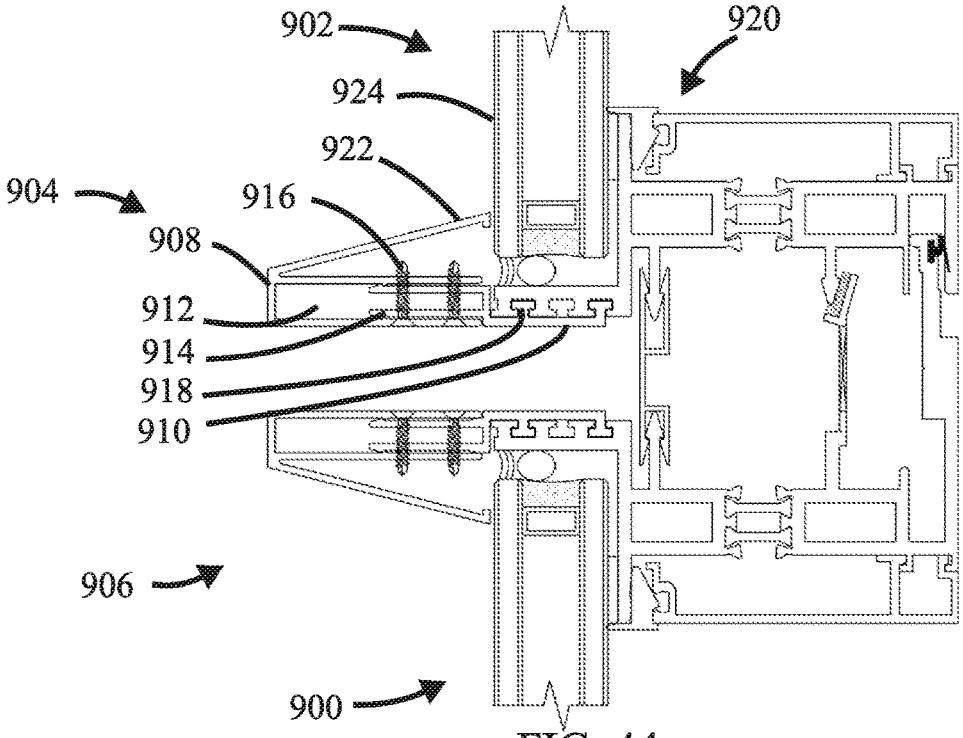
FIG. 44 is a schematic cross-sectional view of the vertical junction of lower and upper glass panels of a curtain wall.

| No. | Description |
|---|---|
| 750 | Mullion of 626 |
| 752 | Right vertical frame member of 746 |
| 754 | Glass inset of 746 |
| 756 | Left vertical frame member of 748 |
| 758 | Glass inset of 748 |
| 760 | Rain deflector strip |
| 762 | T-bar connector |
| 764 | Outward extending portion of 762 |
| 766 | Pin |
| 768a, b | Left and right rotatable connectors |
| 770a, b | Left and right catchment extension beams |
| 772 | End cover |
| 774 | Strip seal |
| 776 | Gasket seal |
| 778 | Wiper seal |
| 780a, b | Wiper seals |
| 782 | Cover |
| 784 | Catchment beam of 750 |
| 786 | Sixth glass panel of 610 |
| 788 | Seventh glass panel of 610 |
| 790 | Mullion in FIG. 39 |
| 792 | Right vertical frame member of 786 |
| 794 | Left vertical frame member of 788 |
| 796 | Glass inset of 786 |
| 798 | Glass inset of 788 |
| 800 | Inside comer T-bar connector |
| 802a, b | Pins |
| 804a, b | Rotatable connectors |
| 806 | Rain deflector |
| 808 | Air seal |
| 810a, b | Inward covers |
| 812a, b | Left and right catchment beams |
| 814 | Outward cover |
| 816 | Eight glass panel of 610 |
| 818 | Ninth glass panel of 610 |
| 820 | Mullion of FIG. 40 |
| 822 | Outside T-bar connector |
| 824a, b | Rotatable connectors |
| 826 | Pin |
| 828 | First spandrel panel |
| 830 | Second spandrel panel |
| 832 | Mullion of FIG. 41 |
| 834 | First spandrel inset |
| 836 | Second spandrel inset |
| 838 | Right vertical frame member of 828 |
| 840 | Left vertical frame member of 830 |
| 842 | Outward shell of 834 |
| 844 | Inward shell of 834 |
| 846 | Spray foam insulation of 834 |
| 848 | Inward member of 838 |
| 850 | Outward member of 838 |
| 852 | Spandrel panel of FIG. 42 |
| 854 | Lower glass panel of FIG. 42 |
| 856 | Upper glass panel of FIG. 42 |
| 858 | Deck |
| 860 | Spandrel insert of 852 |
| 862 | Bottom horizontal frame member of 852 |
| 864 | Top horizontal frame member of 852 |
| 866 | Top horizontal frame member of 854 |
| 868 | Bottom horizontal frame member of 856 |
| 870 | Lower mullion of 874 |
| 872 | Upper mullion of 874 |
| 874 | Mullion stack of FIG. 42 |
| 876 | Parapet of FIGS. 43A-B |
| 878 | Spandrel panel |
| 880 | Dashed-line box of FIG. 43A |
| 882 | Top horizontal frame member of 878 |
| 884 | Parapet cap extrusion |
| 886 | First ornamental panel frame |
| 888 | First ornamental attachment point |
| 890 | Intermittent column of ornamental panel frames |
| 892 | Staggered column of ornamental panel frames |
| 894 | First ornamental attachment point |
| 896 | Second ornamental attachment point |
| 898 | Third ornamental attachment point |
| 900 | Lower glass panel of FIG. 44 |
| 902 | Upper glass panel of FIG. 44 |
| 904 | Bottom horizontal ornamental frame member |

TABLE 1-continued

Figure 45:
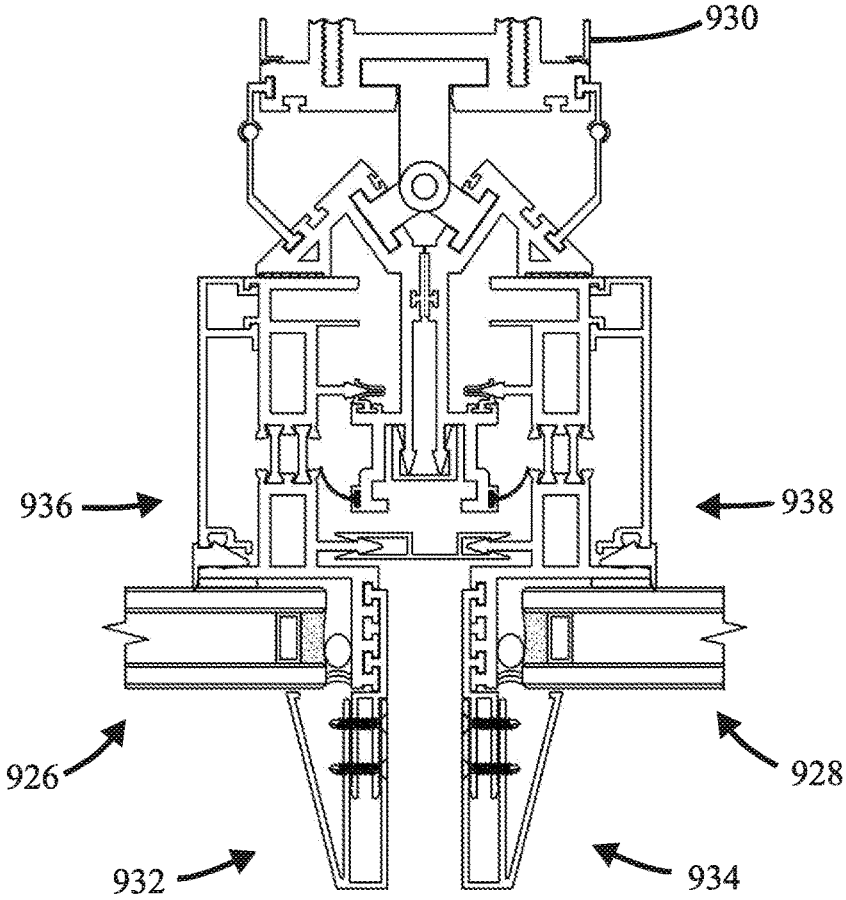
FIG. 45 is a schematic cut-away view of the horizontal junction of left and right glass panels and a parametric mullion of a curtain wall.
Figure 46:
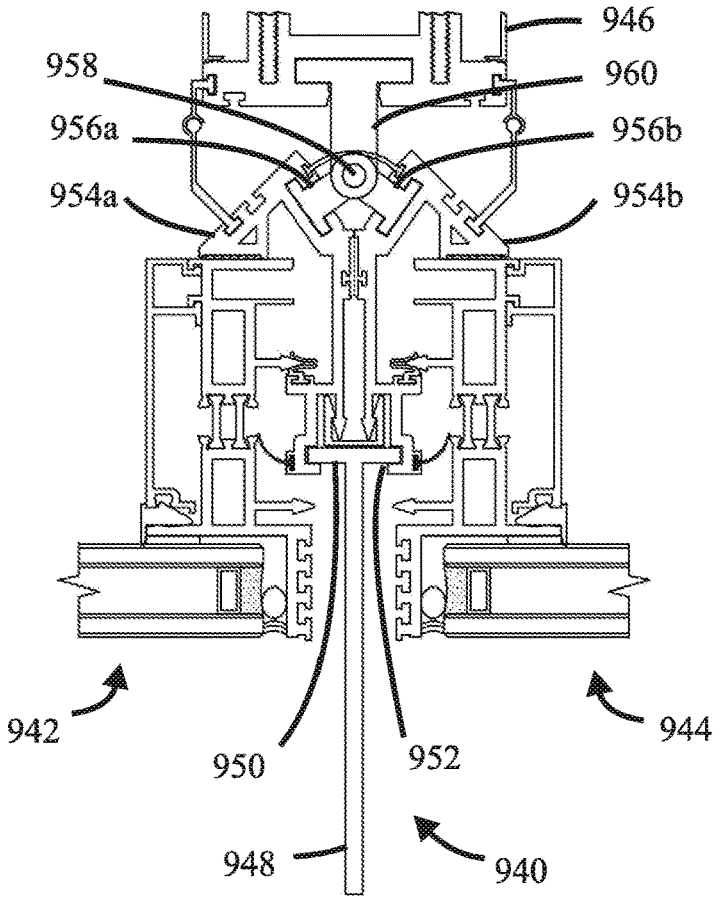
FIG. 46 is a schematic cut-away view of the horizontal junction of an ornamental attachment point, left and right glass panels, and a parametric mullion of a curtain wall.
Figure 50:
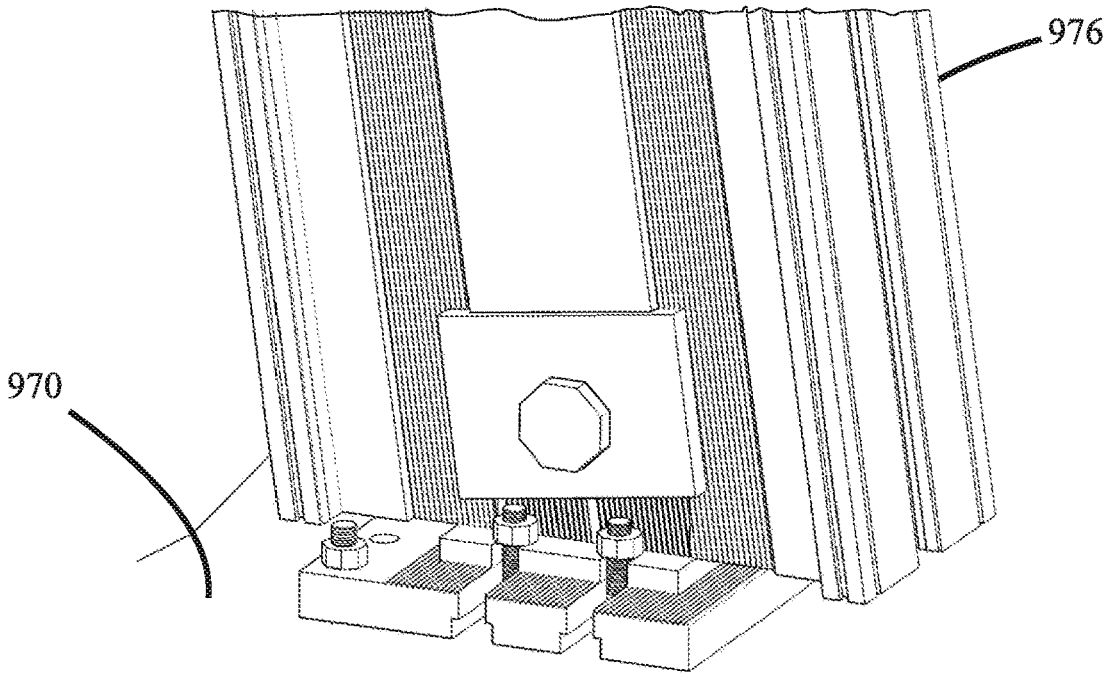
FIG. 50 is a schematic side perspective view showing the anchoring of lower parametric mullion of a parametric mullion stack to a foundation.
Figure 51:
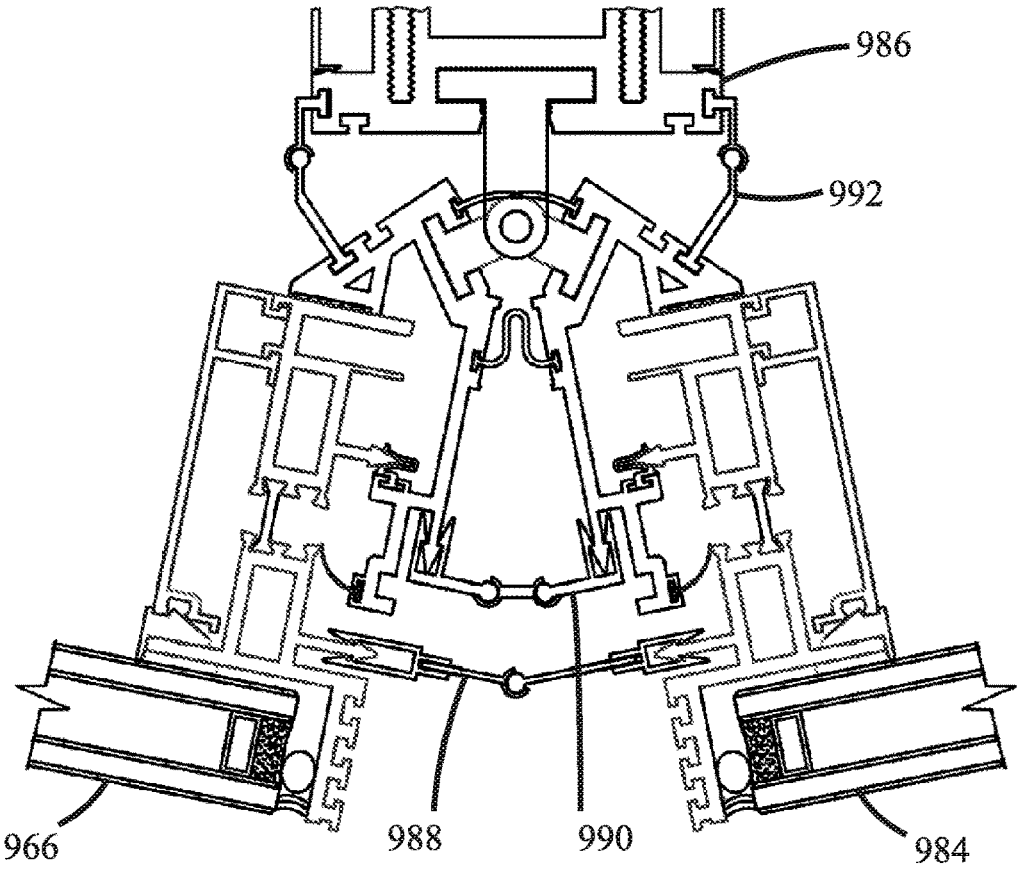
FIG. 51 is a schematic cross-cut view taken at cutting plane 51-51 in FIG. 47.
Figure 52:
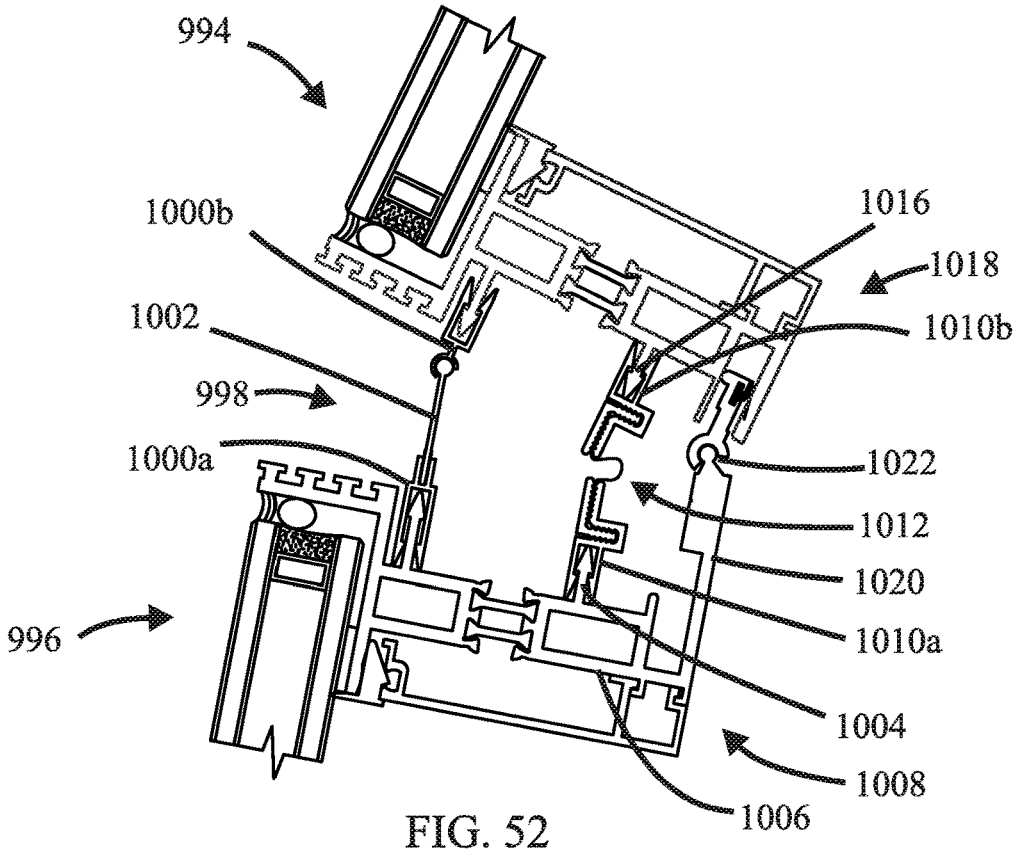
FIG. 52 is a schematic cross-sectional view taken at the cutting plane 52-52 in FIG. 47.
Figure 53:
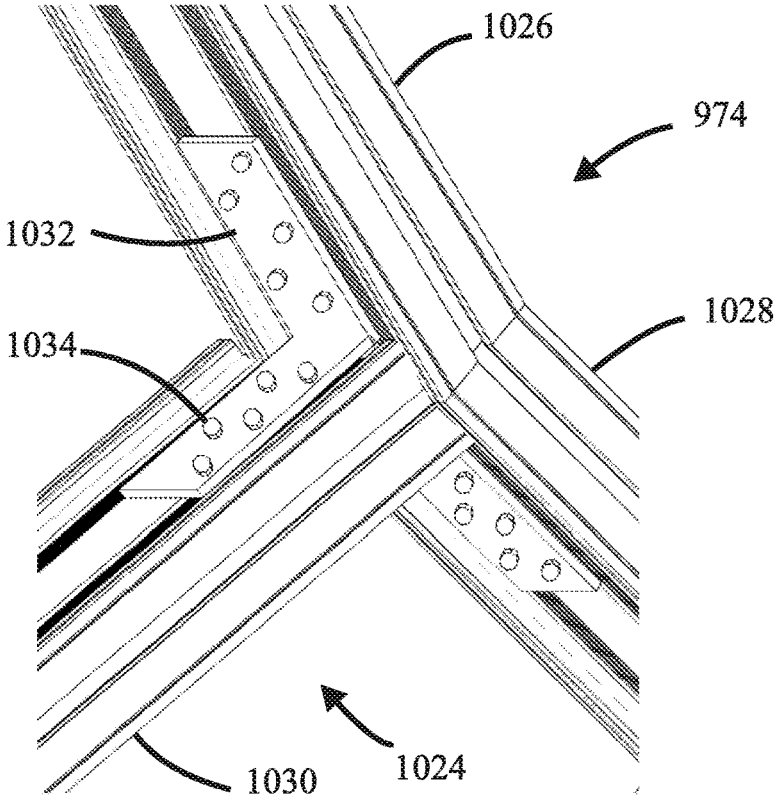
FIG. 53 is a schematic perspective view of the upper end of a parametric mullion stack terminating at the top ring shown in FIG. 48.
Figure 54:
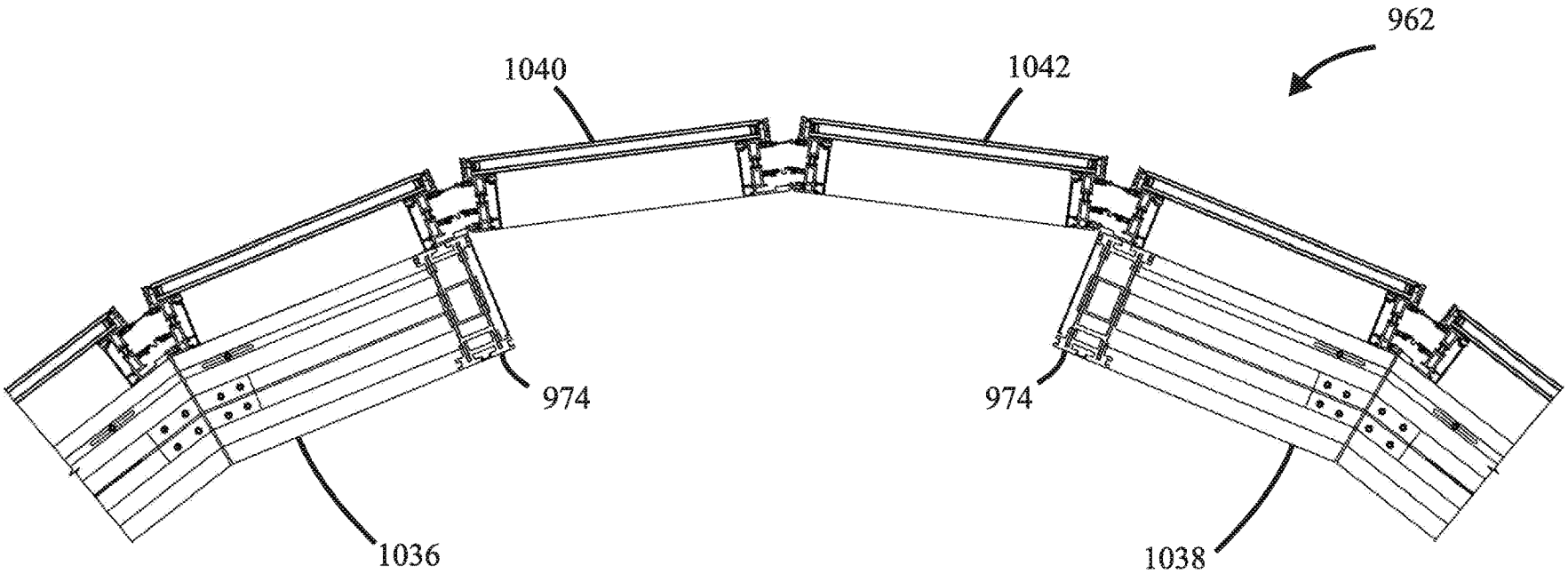
FIG. 54 is a schematic cutaway view of the top of the portion of the domed curtain wall of FIG. 47 taken along a cutting plane across its apex.
Figure 55:
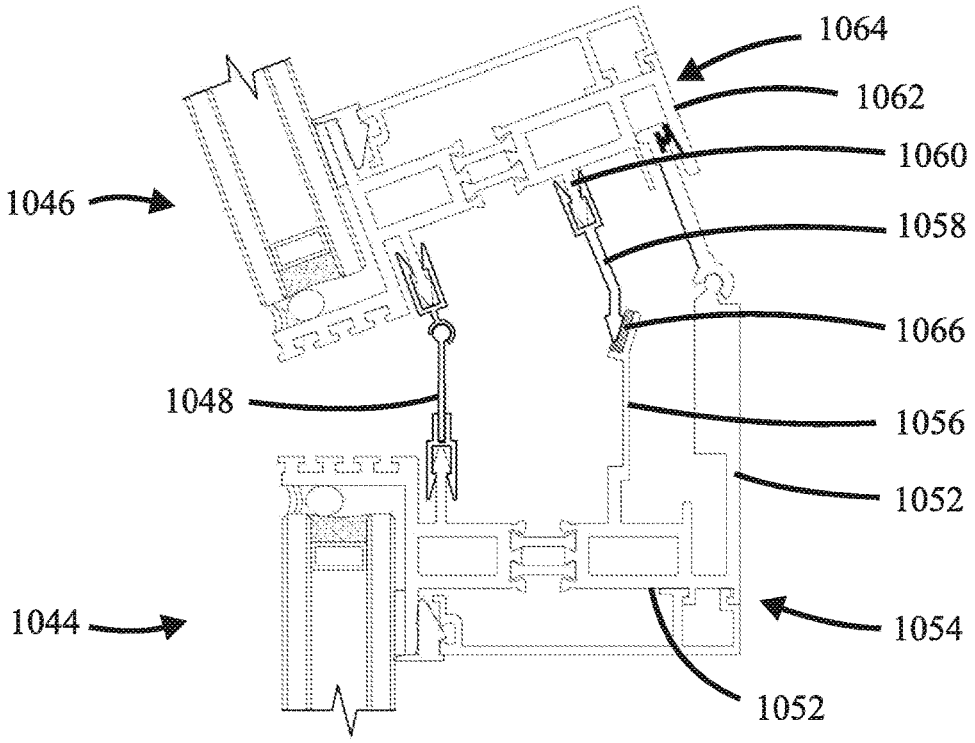
FIG. 55 is a schematic cross-sectional view of an inside corner angle junction between a lower glass panel and an upper glass panel.

| No. | Description |
|---|---|
| 906 | Top horizontal ornamental frame member |
| 908 | Outward member of 904 |
| 910 | Inward connector of 904 |
| 912 | Ridged cavity of 908 |
| 914 | Snap ridge of 904 |
| 916 | Screw |
| 918 | Flange of 910 |
| 920 | Horizontal frame member of 902 |
| 922 | Molding member of 906 |
| 924 | Glass inset of 902 |
| 926 | Left glass panel of FIG. 45 |
| 928 | Right glass panel of FIG. 45 |
| 930 | Mullion of FIG. 45 |
| 932 | Right vertical ornamental frame member of 924 |
| 934 | Left vertical ornamental frame member of 926 |
| 936 | Right vertical frame member of 926 |
| 938 | Left vertical frame member of 928 |
| 940 | Ornamental attachment point |
| 942 | Left glass panel of FIG. 46 |
| 944 | Right glass panel of FIG. 46 |
| 946 | Mullion of FIG. 46 |
| 948 | Outward member of 940 |
| 950 | Flanged base of 940 |
| 952 | Flange channel |
| 954a, b | Left and right extension beams |
| 956a, b | Rotatable extension |
| 958 | Pin |
| 960 | T-bar connector |
| 962 | Domed curtain wall |
| 964 | Domed building |
| 966 | First glass panel of 962 |
| 968 | Mullion stack of 962 |
| 970 | Foundation of 964 |
| 972 | Door build out structure of 964 |
| 974 | Top structural ring of 962 |
| 976 | Lower mullion of FIG. 50 |
| 978 | Upper mullion of FIG. 50 |
| 980 | Bolt |
| 982 | Splice plate |
| 984 | Second glass panel |
| 986 | Mullion |
| 988 | Outward cover of FIG. 51 |
| 990 | Rain deflector of FIG. 51 |
| 992 | Inward cover of FIG. 51 |
| 994 | Third glass panel of 962 |
| 996 | Fourth glass panel of 962 |
| 998 | Rain deflector strip of FIG. 52 |
| 1000a, b | First and second snap connectors of 998 |
| 1002 | Center strip of 998 |
| 1004 | Vertical arm of 1006 |
| 1006 | Inward member of 1008 |
| 1008 | Top horizontal frame member of 996 |
| 1010a, b | First and second snap connector ends of 1012 |
| 1012 | Elastomeric seal strip |
| 1014 | Arrowhead ridge of 1016 |
| 1016 | Inward member of 1018 |
| 1018 | Bottom horizontal frame member of 994 |
| 1020 | Inward vertical member of 1006 |
| 1022 | Pivotable connection |
| 1024 | Mullion stack of FIG. 53 |
| 1026 | Top ring first mullion |
| 1028 | Top ring second mullion |
| 1030 | End mullion of 1024 |
| 1032 | Bracket plate |
| 1034 | Screw |
| 1036 | First mullion stack of FIG. 54 |
| 1038 | Second mullion stack of FIG. 54 |
| 1040 | Fifth glass panel of 962 |
| 1042 | Sixth glass panel of 962 |
| 1044 | Lower glass panel of FIG. 55 |
| 1046 | Upper glass panel of FIG. 55 |
| 1048 | Rain deflector strip |
| 1050 | Inward vertical member of 1052 |
| 1052 | Inward member of 1054 |
| 1054 | Top horizontal frame member of 1044 |
| 1056 | Vertical arm of 1054 |
| 1058 | Clip extension |
| 1060 | Arrowhead ridge of 1062 |

TABLE 1-continued

Figure 56A:
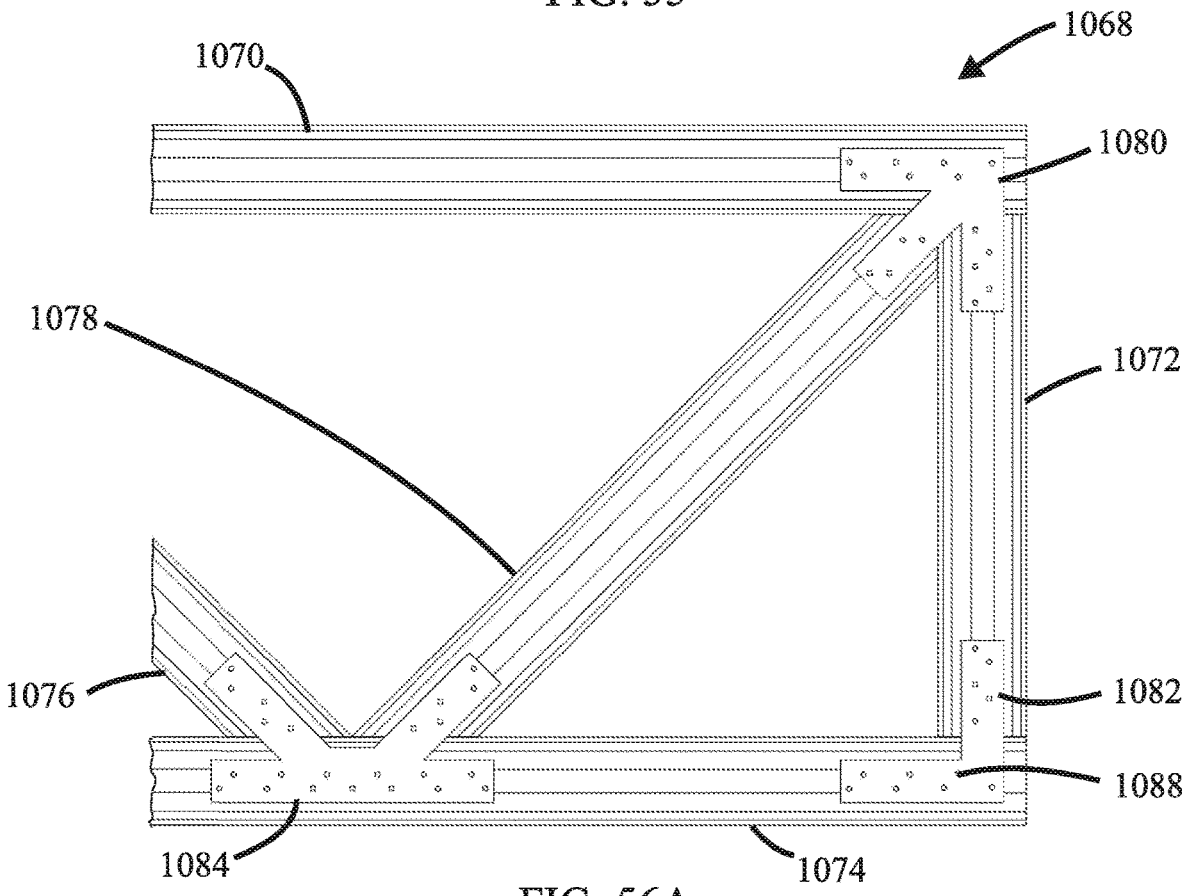
FIG. 56A is a schematic side view of a portion of a truss which comprises a plurality of parametric mullions.

| No. | Description |
|---|---|
| 1062 | Inward member of 1064 |
| 1064 | Bottom horizontal frame member of 1046 |
| 1066 | Elastomeric strip of 1056 |
| 1068 | Truss of FIG. 56A |
| 1070 | First mullion of 1068 |
| 1072 | Second mullion of 1068 |
| 1074 | Third mullion of 1068 |
| 1076 | Fourth mullion of 1068 |
| 1078 | Fifth mullion of 1068 |
| 1080 | First splice plate of 1068 |
| 1082 | Second splice plate of 1068 |
| 1084 | Third splice plate of 1068 |
| 1086 | Hole in 1080 |
| 1088 | Outer ridge of 1078 |
| 1090 | First set of straight trusses |
| 1092 | First truss of 1090 |
| 1094 | Second truss of 1090 |
| 1096 | Third truss of 1090 |
| 1098 | First deck |
| 1100 | Second set of arched trusses |
| 1102 | First truss of 1100 |
| 1104 | Second truss of 1100 |
| 1106 | Third truss of 1100 |
| 1108 | Second deck |
| 1110 | Third set of slanted trusses |
| 1112 | First truss of 1100 |
| 1114 | Second truss of 1110 |
| 1116 | Third truss of 1110 |
| 1118 | Third deck |
| 1120 | First dual wall system |
| 1122 | First wall of 1120 |
| 1124 | Second wall of 1120 |
| 1226 | First parametric mullion of 1120 |
| 1228 | Second catchment beam of 1226 |
| 1230 | First catchment beam of 1226 |
| 1132 | First glass panel of 1120 |
| 1134 | Second glass panel of 1120 |
| 1136 | Third glass panel of 1120 |
| 1138 | Fourth glass panel of 1120 |
| 1140 | Vertical frame member of 1132 |
| 1142 | Second dual wall system |
| 1144 | Third wall of 1142 |
| 1146 | Fourth wall of 1142 |
| 1148 | Second parametric mullion of 1142 |
| 1150 | First insulated metal panel of 1142 |
| 1152 | Second insulated metal panel of 1142 |
| 1154 | Third insulated metal panel of 1142 |
| 1156 | Fourth insulated metal panel of 1142 |
| 1158 | Vertical frame member of 1150 |
| 1160 | Third dual wall system |
| 1162 | Outward wall of 1160 |
| 1164 | Inward wall of 1160 |
| 1166 | Third parametric mullion of 1160 |
| 1168 | First bi-facial solar panel of 1160 |
| 1170 | Second bi-facial solar panel of 1160 |
| 1172 | Fifth insulation metal panel of 1160 |
| 1174 | Sixth insulation metal panel of 1160 |
| 1176 | First vertical frame of 1168 |
| 1178 | Second vertical frame of 1170 |
| 1180 | Third vertical frame of 1172 |
| 1182 | Fourth vertical frame of 1174 |
| 1184 | Outward face of 1172 |
| 1186 | Fourth dual wall system |
| 1188 | Outward wall of 1186 |
| 1190 | Inward wall of 1186 |
| 1192 | Fourth parametric mullion of 1186 |
| 1194 | Third bi-facial solar panel of 1186 |
| 1196 | Fourth bi-facial solar panel of 1186 |
| 1198 | Vertical frame of 1194 |
| 1200 | First spandrel panel of 1186 |
| 1202 | Second spandrel panel of 1186 |
| 1204 | First insulation block of 1200 |
| 1206 | Second insulation block of 1202 |
| 1208 | First vertical frame of 1200 |
| 1210 | Second vertical frame of 1202 |
| 1212 | Cover of 1198. |

DETAILED DESCRIPTION OF PREFERRED EMBODIMENTS

In this section, some preferred embodiments of the present invention are described in detail sufficient for one skilled in the art to practice the present invention without undue experimentation. It is to be understood, however, that the fact that a limited number of preferred embodiments are described herein does not in any way limit the scope of the present invention as set forth in the claims. It is to be understood that whenever a range of values is described herein or in the claims that the range includes the end points and every point therebetween as if each and every such point had been expressly described. Unless otherwise stated, the word "about" as used herein and in the claims is to be construed as meaning the normal measuring and/or fabrication limitations related to the value which the word "about" modifies. Unless expressly stated otherwise, the term "embodiment" is used herein to mean an embodiment of the present invention. The term "inventive" is an adjective that indicates that the word or phrase which it modifies is an embodiment of the present invention.

Additionally, to further aid in the understanding of the invention, the meanings of certain words and phrases that are used in this specification and its claims in describing or defining the present invention are presented as follows:

"Anchor", when used as a noun, means the component of a parametric mullion which is connected to the frame or deck of a building.

"Beam" means an elongate structure having substantially the same cross-sectional shape along its length.

"Component" means a principal part of a system or of an assembly.

"Element" means a part of a component.

"Facade" means the outwardly facing major side of a curtain wall.

"Frame" means an open supporting structure, e.g. of a building or a panel.

"Inset", when used as a noun, means the component of a panel that is mounted within and occupies essentially all of the open space formed by the panel's frame, e.g. a glass pane of a glass panel.

"Insulated metal panel" means a panel that comprises a metal envelope that is filled with insulation material.

"Inward" or "inwardly" mean a direction that is towards the building frame.

"Member" means an elongate structure, e.g. one of the component sides of a panel frame.

"Multi-directionally curved wall" means an insulated metal panel wall or a curtain wall having curves formed by inside and/or outside angle junctions of panels in both the vertical and horizontal directions or segmented walls creating angular planes that can create segmented curves.

"Outward" or "outwardly" mean a direction that is away from the building frame, either exteriorly toward the outdoors or interiorly towards the building's interior space.

"Panel" means the insulated metal panel wall system or curtain wall system component that comprises a framed insert and which, in combination with the other panels of the curtain wall system, forms the facade surface of the curtain wall.

"Parametric mullion" means the elongate, usually primarily vertical, insulated metal panel wall or curtain wall component which is directly attached to a building frame to transfer the walls deadload and windload to the building frame and to which one or more panels are connected.

"Parametric mullion stack" means a series of parametric mullion extending vertically across multiple stories of a building.

"Parametric" means an component, element, or system that is constructed of a plurality of interchangeable, interconnecting parts, each of which is selected to provide the component, element, or system with the desired size, strength, or other desired characteristic.

"Spandrel" means a non-transparent inset of a panel.

It is to be understood that the embodiments described in each of the following individually titled sections can be used in combination with one or more embodiments of other such sections to accomplish one or more of the objects of the invention.

Parametric Mullion Systems

The present invention includes embodiments comprising parametric mullion systems. Each of the inventive parametric mullions comprises a multitude of interchangeable components that simplify the design and construction and lower the design, construction, and installation costs of curtain walls in which the parametric mullions are used. As described below, the desired size and load bearing characteristics of the parametric mullions can be obtained simply by choosing and assembling together the components having the appropriate dimensions and material properties from a standardized schedule or stock of such components. This adaptive feature of the inventive parametric mullions eliminates the need to otherwise custom design and manufacture the mullions for a particular curtain wall.

It is to be understood that many of the embodiments include the interfacing of serrated surfaces of adjacent components. Such interfacing allows the components to slide along one another in the directions which are parallel to the serrations, i.e. the parallel directions, while preventing relative movement of the components in the directions which are perpendicular to the serrations, i.e. the lateral directions. The serrations allow selective longitudinal and lateral positioning of the components with respect to one another. The serrations of the interfacing component surfaces are placed to correspond to one each other in order to provide the desired amount of lateral restraint and positionability. Although serrations of any dimension and shape may be used, it is preferred that the serrations have a depth of about 0.79 millimeters (1/32 inches), a width of about 1.59 millimeters (1/16 inches), and have vee-shape profile. It is also to be understood that for every instance herein in which interfacing surfaces are described as being serrated, it is within the scope of the present invention to for the interfacing surfaces to be only partially covered with serrations or to be free of serrations.

Figure 1:
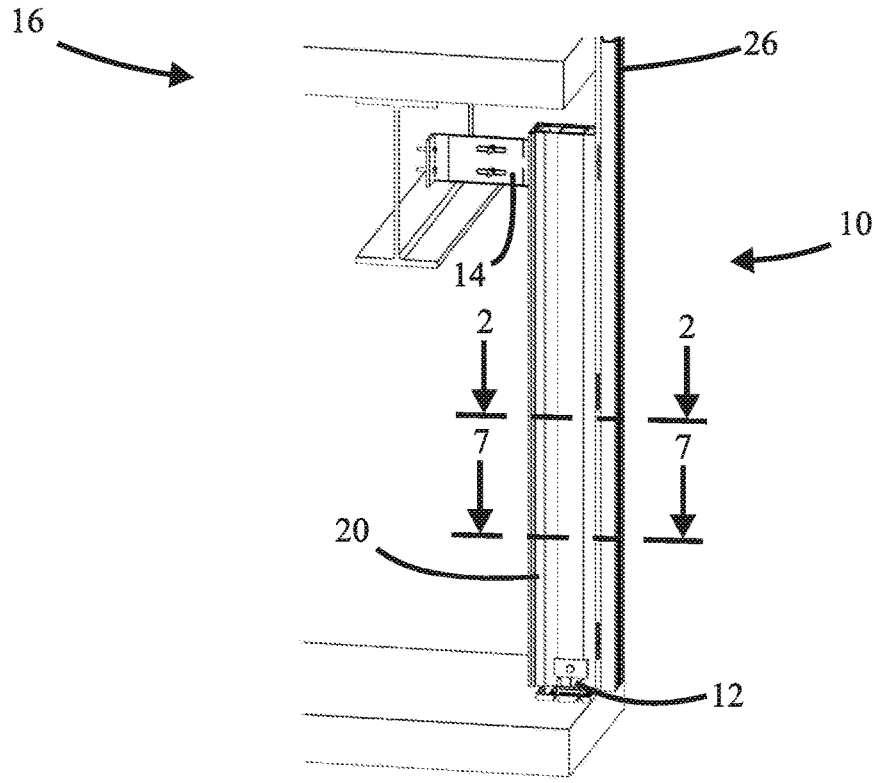
FIG. 1 is a schematic perspective view of an embodiment of an inventive parametric mullion.

FIG. 1 is a schematic perspective view of an embodiment of an inventive parametric mullion 10. The parametric mullion 10 is attached by its bottom anchor 12 and its top anchor 14 to the frame 16 of a building. Extending between the bottom anchor 12 and the top anchor 14 is the column 20 of the parametric mullion 10. As described in more detail below, an outward component of the column 20 may be extended longitudinally to splice together parametric mullions on adjacent stories.

Figure 2:
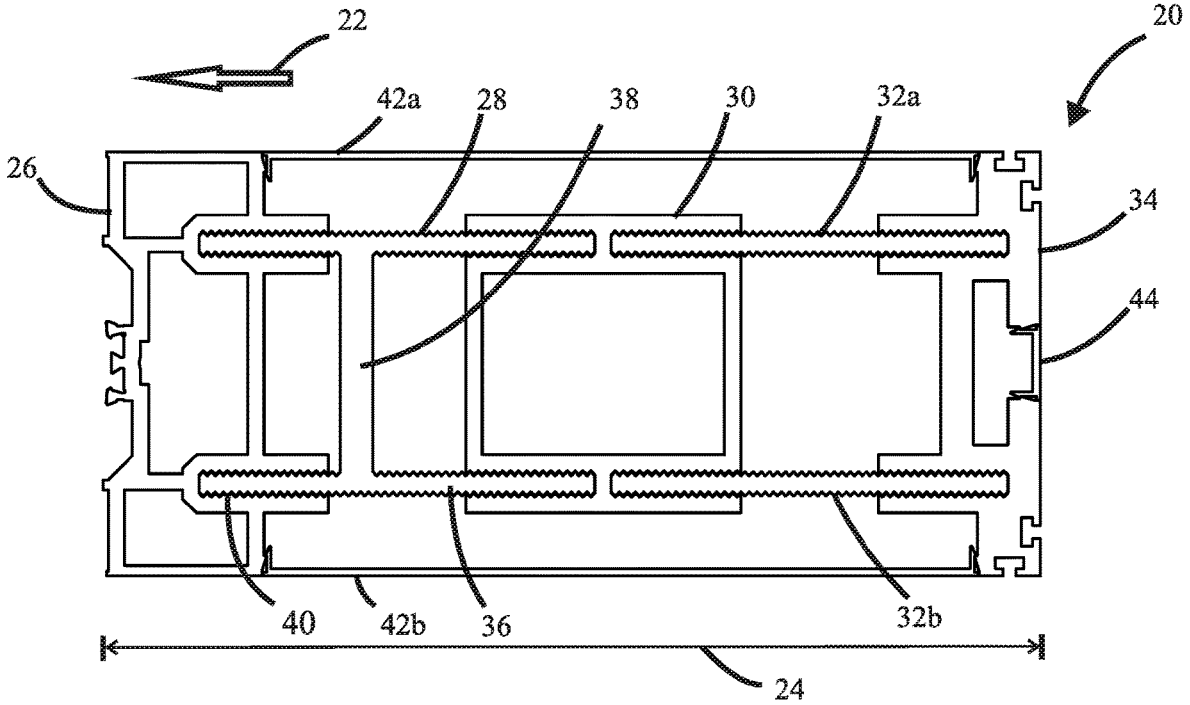
FIG. 2 is a schematic planar cross-sectional view of an inventive parametric mullion taken across cutting plane 2-2 of FIG. 1.

FIG. 2 is a schematic planar cross-sectional view of column 20 taken across cutting plane 2-2 of FIG. 1. The column 20 is oriented in use so that arrow 22 indicates an outward direction. For convenience, the dimension of the column 20 (and of the parametric mullion 10 of which it is a part) indicated by the length of line 24 is referred to herein as its "depth", the dimension of the column 20 (and likewise the parametric mullion 10) along the direction that is perpendicular to line 24 in the plane of the page is referred to herein as its "width," and the direction that is perpendicular to the line 24 and into the page is its "length." Each of the components shown in the drawing continue the length of the column 20 unless described otherwise.

The column 20 comprises structural components and non-structural components. The structural components are a catchment beam 26, a serrated H-beam 28, a serrated box tube 30, a pair of serrated plates 32*a*, 32*b*, and a double-T beam 34. These structural components are constructed of metal, preferably an aluminum alloy, or some other (preferably extrudable) structural material, e.g. a reinforced polymer composite. When the structural material is an aluminum alloy, it preferably has a thin anti-galling and/or anti-corrosion coating (not depicted in the drawings). As is shown in FIG. 2, the catchment beam 26 and the double-T beam 34 may have different cross-sectional shapes from each other, but in some embodiments they have identical cross-sections so as to make these two components interchangeable, thus minimizing the number of designs needed and types of components that need to be kept in inventory.

As illustrated in FIG. 2, the H-beam 28 has four legs, e.g. leg 36, connected together by a web 38. The surfaces of these legs and of the serrated plates 32*a*, 32*b* have fine parallel serrations extending along their lengths. Each of the catchment beam 26 and the box tube 30 has serrated cavities, e.g. the cavity 40 of the catchment beam 26, for receiving the legs of the H-beam 28 along corresponding serrations. Likewise, the box tube 30 and the double-T beam 34 have serrated cavities for receiving portions of the serrated plates 32*a*, 32*b* along corresponding serrations. The serrations permit respective connecting receiving cavities and received elements to be selectively laterally positioned to provide the column 20 with a desired depth while interlocking with one another to prevent lateral intercomponent sliding in the direction of the depth dimension.

The non-structural components of the column 20 are the side covers 42*a*, 42*b* and the strip cover 44. Side covers, such as the side covers 42*a*, 42*b*, are preferably configured to removably snap into place between the catchment beam 26 and the double-T beam 34. Strip covers, like the strip cover 44, are preferably configured to removably snap in place between the opposing walls of a recess 46 along the face of the double-T beam 34. These non-structural components help to isolate the spaces around the structural components so as to keep the spaces free of debris. Preferably, they are also configured to provide some fire protection to the structural components. The non-structural components may be made of the same materials as the structural components or of any other suitable material.

Figure 3:
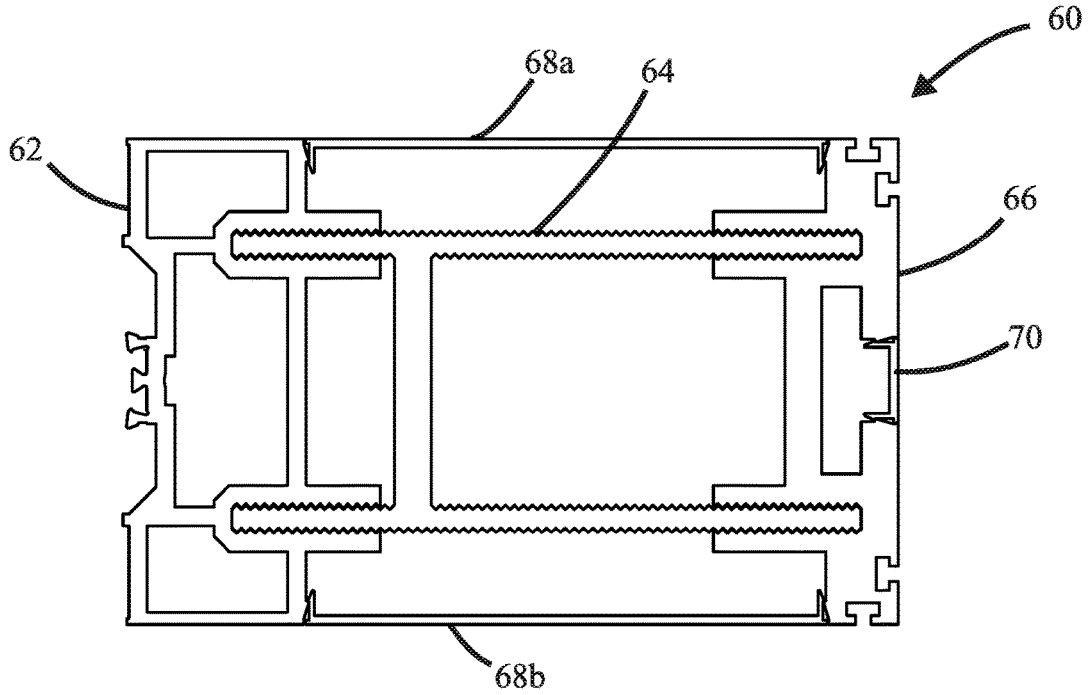
FIG. 3 is a schematic horizontal cross-sectional view of a column of a parametric mullion having a shorter depth than that of the parametric mullion of FIG. 3, but the same width.
Figure 4:
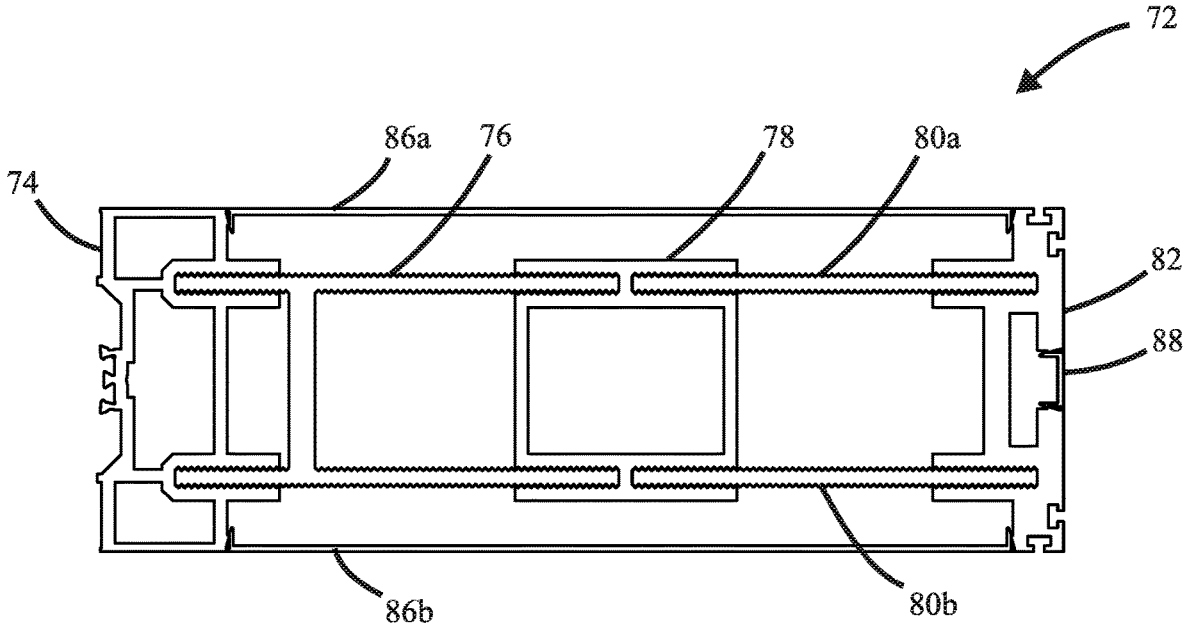
FIG. 4 is a schematic horizontal cross-sectional view of a column of a parametric mullion having a longer depth than that of the parametric mullion of FIG. 2, but the same width.

FIGS. 3 and 4 illustrate how parametric mullions of different depths can be assembled from the same or similar components as those shown in FIG. 2. FIG. 3 shows a schematic horizontal cross-sectional view of the column 60 of a parametric mullion having a shorter depth than that of the parametric mullion 10 but the same width. The column 60 comprises, as its structural components, a catchment beam 62, a serrated H-beam 64, and a double-T beam 66. Each of these structural components is identical to the corresponding structural components of the column 20 discussed above. Note that the less-deep column 60 does not have components corresponding to the box tube 30 and the pair of serrated plates 32*a*, 32*b* of the column 20 as these components are not needed to achieve the desired depth of the column 60. The non-structural components of the column 60 are the side covers 68*a*, 68*b* and the strip cover 70. While the side covers 68*a*, 68*b* are shorter in the direction of the column's 60 depth dimension than their counterparts of the column 20, the strip cover 70 is identical to its counterpart of the column 20.

FIG. 4 shows a schematic horizontal cross-sectional view of the column 72 of a parametric mullion having a longer depth than that of the parametric mullion 10 but the same width. The column 72 comprises, as its structural components, a catchment beam 74, a serrated H-beam 76, a serrated box tube 78, a pair of serrated plates 80*a*, 80*b*, and a double-T beam 82. The catchment beam 74, the serrated box tube 78, and the double-T beam 82 are identical to the corresponding structural components of the column 20 discussed above. The H-beam 76 is identical the H-beam 28 of the column 20 except that the two legs 84*a*, 84*b* of H-beam 76 are longer in the column depth direction than are their counterparts of the H-beam 28. Likewise, the serrated plates 80*a*, 80*b* differ from their counterpart serrated plates 32*a*, 32*b* of the column 20 only in that they are longer in the column depth direction. The non-structural components of the column 72 are the side covers 86*a*, 86*b* and the strip cover 88. While the side covers 86*a*, 86*b* are longer in the direction of the column's 72 depth dimension than their counterparts of the column 20, the strip cover 88 is identical to its counterpart of the column 20.

The ability to vary the parametric mullion depth in the manner described with reference to FIGS. 2-4 enables the easy creation of parametric mullions of the same length for carrying different insulated metal panel wall or curtain wall deadweights and/or transferring different expected wind loads. Also, it is to be understood that an inventive parametric mullion can be made of any desired length to span the distance between two adjacent stories of a building. In this regard, the parametric mullion system easily structurally accommodates the differing lengths by permitting easy selection of the parametric mullion depth. For example, in some preferred embodiments, the depth of a parametric mullion having the column cross-section shown in FIG. 3 is 10.16 centimeters (4 inches), the depth of a parametric mullion having the column cross-section shown in FIG. 2 is 15.24 centimeters (6 inches), and the depth a parametric mullion having the column cross-section shown in FIG. 4 is 25.4 centimeters (10 inches).

Figure 5A:
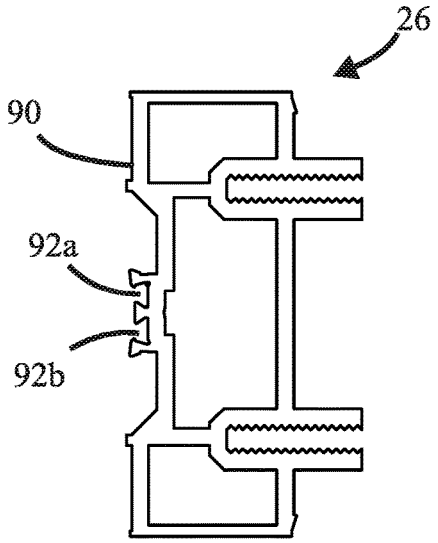
FIG. 5A is a schematic cross-sectional view of a first embodiment of a catchment beam.

The portion of an inventive parametric mullion which connects to the panels of the curtain wall is its catchment beam, e.g. the catchment beam 26 of the parametric mullion 20 as shown in FIG. 2 and reproduced in isolation in FIG. 5A. The catchment beam 26 has as a part of its outward side face 90 a pair of connector slots 92*a*, 92*b* for receiving the flanged connectors of curtain wall component.

Figure 5B:
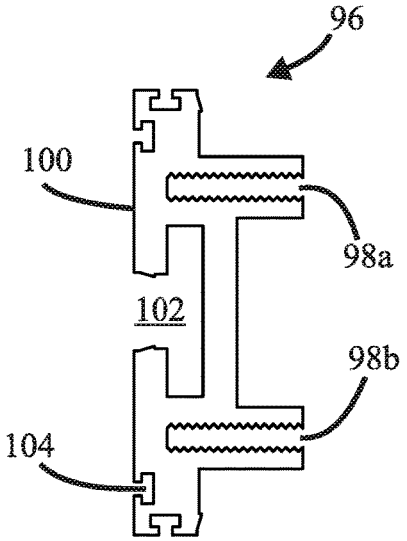
FIG. 5B is a schematic cross-sectional view of a second embodiment of a catchment beam.

Whereas the catchment beams 26, 62, 74 of parametric mullions 20, 60, 72, respectively, are identical to one another, it is within the scope of the present invention for the catchment beam of an inventive parametric mullion to have any design that is compatible with both the curtain wall connectors with which it is to be used and the other structural and non-structural components of the parametric mullion of which is a part. FIG. 5B is a schematic cross-sectional view of another catchment beam embodiment, i.e. a second catchment beam 96. The second catchment beam 96 has the same width and length (the dimension into the page) as the catchment beam 26 as well as serrated cavities 98*a*, 98*b* for receiving the serrated outward side legs of an H-beam which are substantially the same as those of catchment beam 26. Like the outward side face 90 of the catchment beam 26, the outward side face 100 of the second catchment beam 96 is adapted to connect to a component of an insulated metal panel wall or curtain wall. To this end, the outward side face 100 includes a connector slot 102 for receiving a flanged connector of an insulated metal panel wall or curtain wall component. The catchment beam 96 also optionally includes a plurality of smaller slots, e.g. slot 104, which are adapted to receive the flanged connecting portions of auxiliary elements such as wipers, covers, etc.

Figure 6A:
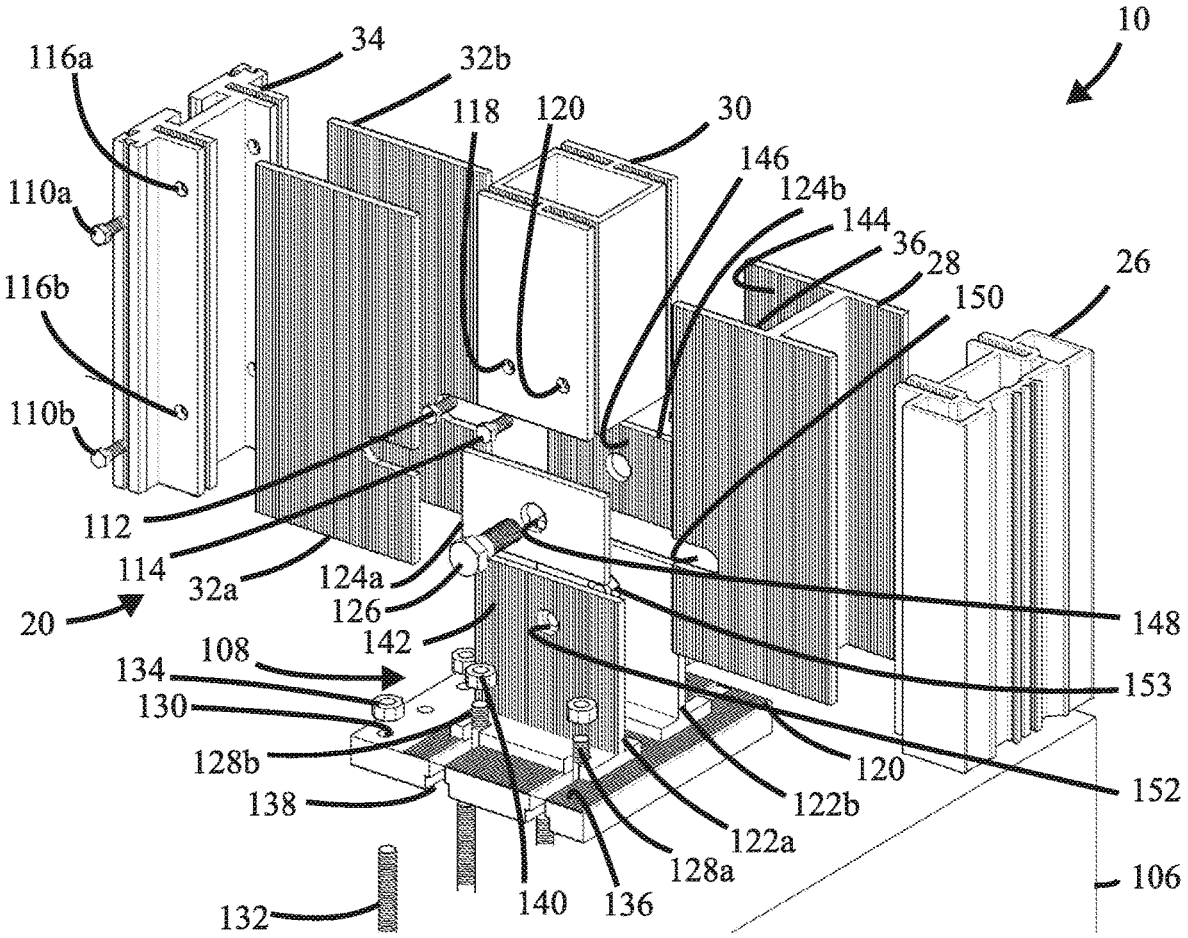
FIG. 6A is an schematic exploded view, partially in cross-section, of the structural components of the bottom portion of an inventive parametric mullion in proximity to a deck to which the parametric mullion is to be attached.
Figure 6B:
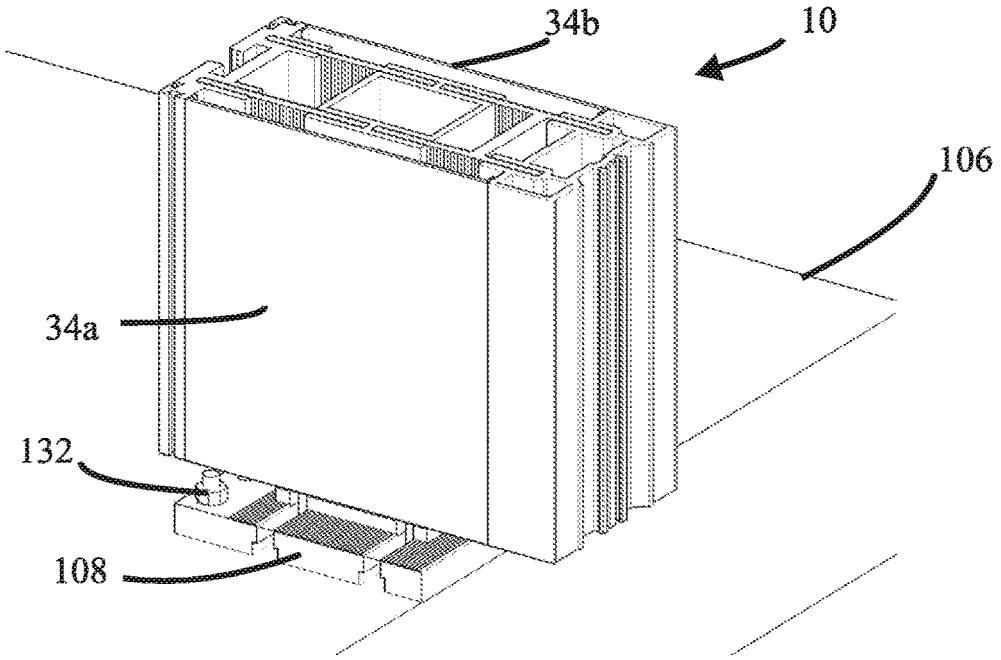
FIG. 6B is a schematic perspective view, partially in cross-section, of the same portion of the parametric mullion as in FIG. 6A, but in an assembled condition and additionally including the non-structural components of the parametric mullion.

FIG. 6A is an schematic exploded view, partially in cross-section, of the structural components of the bottom portion of the parametric mullion 10 in proximity to a deck 106 to which the parametric mullion 10 is to be attached. This bottom portion of the parametric mullion 10 includes the lower end of the column 20 and an anchor 108. FIG. 6B is a schematic perspective view, partially in cross-section, of the same portion of the parametric mullion 10 as in FIG. 6A, but in an assembled condition and additionally including the non-structural components of the parametric mullion 10. It is noted that, for the sake of clarity, bushings and washers have been omitted from FIG. 6A and other drawings in this patent document and from the discussions related to those drawings.

FIG. 6A illustrates that in addition to the structural components discussed above with reference to FIG. 2 (the catchment beam 26, the H-beam 28, the box tube 30, the serrated plates 32*a*, 32*b*, and the double-T beam 34), the column 20 includes a first plurality of self-tapping screws, e.g. the first screws 110*a*, 110*b*, a second plurality of self-tapping screws, e.g. the second screw 112, and a third plurality of self-tapping screws, e.g. the third screw 114. The double-T beam 34 includes a plurality of vertically periodically spaced holes along its length, e.g. first holes 116*a*, 116*b*, for receiving the screws of the first plurality of screws, e.g. the first screws 110*a*, 110*b*. Likewise, the H-beam 28 includes a second and a third plurality of vertically periodically spaced holes along its length, e.g. the second hole 118 and the third hole 120, for receiving the screws of the second and third plurality of screws, e.g. the second screw 112 and third screw 114, respectively. When the first plurality of screws are screwed into the first plurality of holes in the double-T beam 34, they tap and thread into the serrated plates 32*a*, 32*b* which are engaged by the double-T beam 34 thus restraining the serrated plates 32*a*, 32*b* from moving in relation to the double-T beam 126. Likewise, when the second plurality of screws are screwed into the second plurality of holes in the box tube 30, they tap and thread into the serrated plates 32*a*, 32*b* thus restraining the box tube 30 from moving in relation to the serrated plates 32*a*, 32*b*. Similarly, when the third plurality of screws are screwed into the third plurality of holes in the box tube 30, they tap and thread into the legs of the H-beam 28, e.g. leg 36, thus restraining the H-beam 28 from moving in relation to the box tube 30. It is to be noted that the screw/hole combinations are present on both of the lateral sides of the column 20 although, with the partial exception the double-T beam, only those holes and screws on the viewer facing lateral side are visible in FIG. 6A.

Because the screw/hole combinations discussed in the preceding paragraph are present at only spaced apart locations along the column of a parametric mullion, they are not present in most cross-sections of the column. For example, the cross-sectional views depicted in FIGS. 2-4 are taken at locations along their respective columns at which the screw/hole combinations are not present. FIG. 7 shows a schematic cross-sectional view taken at cutting plane 7-7 of the column 20 (see FIG. 1) which occurs at one of the locations along the length of column 20 at which instances of the screws of the first and second plurality of screws are present. FIG. 7 is discussed in greater detail later in this section.

Referring again to FIG. 6A, the anchor 108 of the parametric mullion 10 includes a base plate 120, a pair of flanged connectors 122*a*, 122*b*, a pair of serrated washer plates 124*a*, 124*b*, a pair of anchor bolts of which only one is visible in FIG. 6A, i.e. the anchor bolt 126, and a set of four second bolts of which only two are visible in FIG. 6A, i.e. the base plate bolts 128*a*, 128*b*. The base plate 120 has a plurality of holes, e.g. the base plate hole 130, for receiving bolts, e.g. the deck bolt 132, which protrude from the deck 106 and which, in combination with corresponding nuts, e.g. the deck bolt nut 134, enable the base plate 120 to be fixed to the deck 106.

A portion of the top surface 136 of the base plate 120 has serrations which correspond to the serrations on the bottom faces (not depicted) of the flanged connectors 122*a*, 122*b*. Like the serrations of the various serrated interfaces described above for the structural components of the column 10, these serrations are oriented perpendicular to the depth direction of the parametric mullion 10 so as to aid in transferring wind loads to the building frame. The base plate 120 has four fluted slots, e.g. the base plate slot 138, which align with respective slots on the flanged connectors 122*a*, 122*b* so as to allow the base plate bolts, e.g. the base plate bolts 128, 128*b*, in combination with corresponding nuts, e.g. the base plate bolt nut 140, to securely attach the flanged connectors 122*a*, 122*b* to the base plate 120 and thereby to the deck 106.

The connection of the column 20 to the anchor 108 will now be described. Keep in mind that at the point in time when this connection is to be made, the column preferably is fully assembled with regard to its other structural components. To make the connection, the column 20 is positioned directly over the anchor 108 (which, preferably, already has been attached to the deck 106) and then lowered so that the serrations on the outer faces of the flanged connectors 122*a*, 122*b*, e.g. the flanged connector outer face 142, engage with the serrations of the inner faces of the serrated plates 32*a*, 32*b* and of the legs of the H-beam 28, e.g. H-beam leg inner face 144, as the column 20 is slid down into place. When the column 20 is in place, the washer plates 124*a*, 124*b*, which have serrations on their inner faces, e.g. the inner face 146 of washer plate 124*b*, are positioned over the outside surfaces of the column 20. The washer plates 124*a*, 124*b* are positioned so that the serrations of the inner faces of the washer plates 124*a*, 124*b* engage the serrations of the respective outer surfaces of the serrated plates 32*a*, 32*b* and of the H-beam 28. In this position, the center holes of the washer plates 124*a*, 124*b*, e.g. center hole 148 of washer plate 124*a*, align with the respective slots of the serrated plates 32*a*, 32*b* and the H-beam 28, e.g. the slot 150 of the H-beam leg 36, and the bolt holes of the flanged connectors 122*a*, 122*b*, e.g. the bolt hole 152 of the flanged connector 122*a*. The slot 150 allows finite adjustment of assembled column 20 so as to properly align the mullion 10 to the building and provide structural connectivity. Once all of these components are in place, the anchor bolts, e.g. the anchor bolt 126, are inserted through these aligned holes and slots so as to threadingly engage the connector nuts, e.g. connector nut 153, which are attached to the inner faces of the upright connectors 122*a*, 122*b* and then tightened to secure the column 20 to the anchor 108 and thereby to the deck 106. After this connection has been made, the side covers 42*a*, 42*b* may be put into place. FIG. 6B shows the lower bottom portion of the assembled parametric mullion 10 attached by way of its anchor 108 and the deck bolts, e.g. deck bolt 132, to the deck 106.

Referring to FIG. 7, there is shown a cross-section of the column 20 taken across cutting plane 7-7 of FIG. 1. This cross-section of the column 20 is taken at one of the periodically-spaced locations along the length of the column 20 at which the screw/hole combinations interconnecting some of the structural components of the column 20 are present. As mentioned above, a first plurality of the spaced apart holes are in the double-T beam 34 and a second and a third plurality of the spaced part holes are in the box beam 30. The holes are only through the outer lateral faces of these components, e.g. the first hole 154 is through the outer lateral face 156 of the double-T beam 34, the second hole 158 and the third hole 160 are through the outer lateral face 162 of the box beam 30. Each of these holes receives a self-tapping screw, e.g. the first, second, and third screws 164, 166, 168, respectively. The tips of the self-tapping screws are driven through the serrated member that is captured within the corresponding serrated recesses of the double-T beam 34 and the box beam 30, e.g. the serrated plate 32*b* and the leg 36 of the H-beam 28, respectively, and then on through the inner lateral faces of the double-T beam 34 and the box beam 30, e.g. through the double-T beam inner lateral face 170 and the box beam inner lateral face 172, respectively.

Similar screw/hole combinations for interconnecting some of the structural components at periodically-spaced locations are present in embodiments of parametric mullions of other designs. For example, FIG. 8 shows another schematic cross-section of the column 60 that is taken at a location different from that which appears in FIG. 3. In this cross-section of the column 60, the screw/hole combinations are present, e.g. the screw 174 passes through the hole 176 and interconnects the double-T beam 66 and the leg 178 of the H-beam 64. Another example is provided by FIG. 9 which shows another schematic cross-section of the column 72 that is taken at a location different from that which appears in FIG. 4. In this cross-section of the column 72, several of the screw/hole combinations are present. The first screw 180 passes through the first hole 182 and interconnects the double-T beam 82 and the serrated plate 80*a*. The second screw 184 passes through the second hole 186 and interconnects the box beam 78 and the serrated plate 80*b*. The third screw 188 passes through third hole 190 and interconnects the box beam 78 and the leg 192 of the H-beam 76.

In some preferred embodiments, the vertical spacing of the screw/hole combinations is about 46 centimeters (18 inches), but any spacing which is structurally suitable may be chosen. It is to be understood that although FIGS. 7-9 depict the location of all of the structural component screw interconnections to be in the same cross-section, it is within the scope of the present invention for such connections to be on different horizontal planes for different structural component combinations.

A feature of the columns 20, 60, 72 that was not discussed in previously will now be described with reference to FIG. 9. This feature is the inclusion of a fastener, e.g. the bolt 194 in combination with the nut 196, that passes through vertically oriented slots of the catchment beam, e.g. the catchment beam 74, and of the structural element of the column which engages the receiving cavities of the catchment beam, e.g. the H-beam 76. These slots may be centimeters long, preferably about 10 centimeters (4 inches). An example of such a slot is shown in FIG. 10 as first slot 218. The fastener is meant to laterally fix the relative positions of the catchment beam and the other structural component while allowing them to move vertically relative to one another. Note that while in FIG. 10 and other drawings of the patent document the fasteners, e.g. the fastener 216 of FIG. 10, that are disposed in a slot such as the first slot 218 of FIG. 10, are depicted for ease of illustration as being located at about the vertical midpoint of its corresponding slot, it is to be understood that such fasteners can be located anywhere along the slot. In some preferred embodiments, such fasteners are located at the top of their corresponding slots as this transfers load from one level to another, which is just one of the innovative features presented herein.

FIG. 10 is a schematic perspective view depicting portions of spliced-together parametric mullions on adjacent stories of a building according to an embodiment. In order to facilitate the description of the structural features of these parametric mullions, their respective non-structural features have been omitted from the drawing. Shown is the lowermost portion of the first parametric mullion 200 and the uppermost portion of the second parametric mullion 202. The first parametric mullion 200 is attached to the deck 204 of the building in the manner described above with reference to FIGS. 6A and 6B. The second parametric mullion 202 is attached to the web 206 of the girder 208 of the building frame by way of its top anchor 210. Note that to allow permit viewing of the horizontal slots of the top anchor 210, e.g. the horizontal slot 211, the serrated washer plates (e.g. the serrated plate shown in FIG. 11) have been omitted from FIG. 10. Both the first and second parametric mullions 200, 202 are similar in design to the parametric mullion 10 described above. The catchment beam 212 of the second beam 202 extends vertically beyond the other structural components of the second parametric mullion 202. The serrated cavities (not visible) of the catchment beam 212 engage the serrated forward legs (not visible in the drawing) of the H-beam 214 of the first parametric mullion 200. The catchment beam 212 and the H-beam 214 are connected together by a fastener 216 which is disposed in corresponding slots in the catchment beam 212, e.g. the first slot 218, and in the H-beam 214 (not visible) in the manner described above with regard to combination of the bolt 194 and the nut 196 of FIG. 9. Accordingly, while the fastener 216 fixes the relative lateral positions of the catchment beam 212 and the H-beam 214, a certain amount of relative vertical movement between the catchment beam 212 and the H-beam 214 is permitted.

Figure 11:
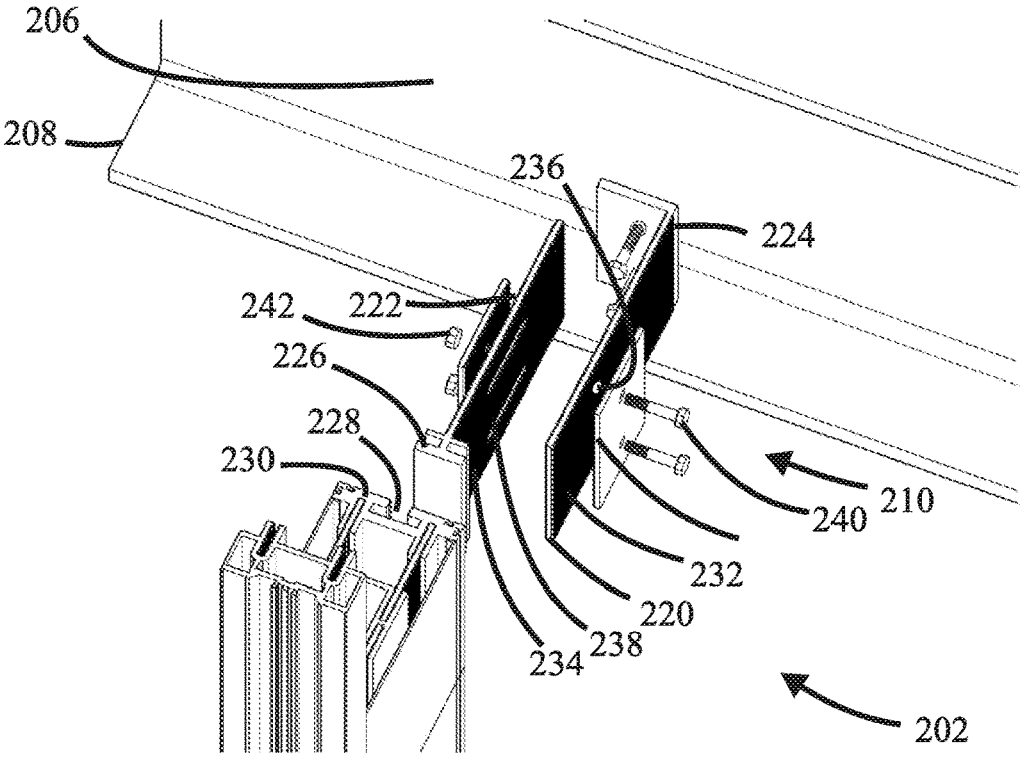
FIG. 11 is a partially-exploded schematic perspective view of the uppermost end of the lower parametric mullion of FIG. 10 in which the top anchor is exploded to show its elements.

FIG. 11 shows a partially-exploded schematic perspective view of the uppermost end of the second parametric mullion 202 in which the top anchor 210 is exploded to show its components and elements. The top anchor 210 includes an angle-bottom connector 220 and a flange-bottom connector 222. The bottom plate 224 of the angle-bottom connector 220 is adapted to be bolted to the web 206 of the girder 208. The flange 226 of the flange-bottom connector 222 is adapted to slide into the flange cavity 228 on the inward face of the dual-T connector 230 of the parametric mullion 202. Both of the lateral faces of each of the angle-bottom connector 220 and the flange-bottom connector 222 are serrated vertically (the serrations make the faces appear black in FIG. 11), e.g. angle-bottom connector lateral face 232 and flange-bottom connector lateral face 234, thus allowing these plates to be assembled with the serrations of either lateral face of one interconnecting with the serrations of the lateral face of the other. The angle-bottom connector 220 has a plurality of holes, e.g. the hole 236, and the flange-bottom connector 222 has a plurality of corresponding slots, e.g. the slot 238, for receiving the bolts, e.g. the bolt 240, which in combination with nuts, e.g. the nut 242, secure together the angle-bottom connector 220 and the flange-bottom connector 222 when the top-anchor is assembled. Serrated washer plates, e.g. the serrated washer plate 244, are used to as an interface between the bolt heads of the bolts, e.g. bolt 240, and/or the nuts, e.g. the nut 242, and the respective serrated face against which the bolt heads or nuts would otherwise engage when tightened in place.

Not all embodiments of inter-story parametric mullions comprise top anchors which connect laterally to the building frame, e.g. in the manner disclosed with regard to FIGS. 10 and 11. Some embodiments of inter-story parametric mullions comprise top anchors which connect vertically to the frame of the building, e.g. to the bottom flange of a girder or the underside of a deck. FIGS. 12A and 12B illustrate such an embodiment. FIG. 12A is a schematic perspective, partly cutaway view of just the top portion of a parametric mullion 250 having its vertically-disposed top anchor 252 attached to the underside of a deck 254. FIG. 12B is a schematic, perspective, partly cutaway view of top portion of the parametric mullion 250 as in FIG. 12A, except that the side cover 256*a* (see FIG. 12A) is not shown (although the side cover 256*b* is shown) and the remainder of the components of the parametric mullion 250 are shown in a laterally exploded relationship to one another. The structural components of the column 258 of the parametric mullion 250, i.e. the double-T beam 260, the serrated plates 262*a*, 262*b*, the box beam 264, the H-beam 266, and the catchment beam 268, are all arranged in a similar fashion as those of the column 20 of the parametric mullion 10 shown in FIG. 6A.

As is apparent from FIG. 12B, the components of the top anchor 252 of the parametric mullion 250 all have their counterparts in the bottom anchor 108 of the parametric mullion 10 as shown in FIG. 6A. These components include a base plate 270, a pair of flanged connectors 272*a*, 272*b*, a pair of serrated washer plates 274*a*, 274*b*, a pair of anchor bolts of which only one is visible in FIG. 12B, i.e. the anchor bolt 276, and a set of four second bolts of which only three are visible in FIG. 12B, i.e. the base plate bolts 278*a*, 278*b*, 278*c*. The top anchor 252 is attached to the deck 254 by way of a plurality of deck bolts, e.g. the deck bolt 280, which protrude from the deck 254. Vertical slip may be provided in this anchor connection by not fully tightening the anchor bolts, e.g. the anchor bolt 276, and/or by providing vertical slots, e.g. the vertical slot 279, on the inside-facing edges of the serrated plates 262*a*, 262*b* and of the H-beam 264.

Either arrangement of top anchoring, i.e. that shown in FIG. 11 or that shown in FIG. 12B, in combination with the bottom anchor as shown in FIG. 6A, allows the inventive parametric mullion to be anchored at the edge of a deck, thus minimizing the moment the mullion exerts on the building deck, thereby the need to enhance the structural strength of the building frame to accommodate the moment couple load applied to a building by the insulated metal panel wall system or the curtain wall system. The ability to locate the parametric mullion at the edge of the deck also maximizes the amount of the deck surface available for use as part of the interior space of the building as is evident from FIG. 13 which is a schematic perspective view of a portion of a parametric mullion stack 281 showing three spliced together parametric mullions 282, 284, 286 mounted, respectively on the ground, second and third floors 288, 290, 292 of a building.

Not all embodiments of the parametric mullions are anchored at both their top and bottom ends as the present invention includes parametric mullions which are anchored only at either their top or bottom ends. For example, FIG. 14 shows a schematic side view of a parametric mullion 294 (without its side covers) that is used as part of a parapet. The parametric mullion 294 is anchored only at its bottom by its anchor 296 to the top side of the deck 298 and is spliced by way of the catchment beam 300 of a parametric mullion (otherwise not shown) that extends up from the story below the deck 298.

It is to be understood that although in the embodiments discussed above the anchoring to a deck was described as utilizing bolts protruding from the deck, the present invention comprises all other known means in the art for attaching an object to a deck, e.g. the use of screws passing through the parametric mullion anchor and into the deck or a screw anchor residing in a hole in the deck, clamping mechanisms, weldments, welding, etc.

Insulated Metal Panel Wall Systems

The present invention comprises insulated metal panel wall systems which utilize the parametric mullions described above. Embodiments of such insulated metal panel wall systems include inventive features which are in addition to those of the inventive parametric mullions. Some of those features will now be discussed with relation to FIGS. 15 to 32. It is important to realize that the present invention eliminates the need for the conventional framework to which the individual insulated metal panels are attached. The present invention provides systems in which the insulated metal panels are supported by the inventive parametric mullions described above.

FIG. 15 shows in its lower section a schematic discontinuous front view of an embodiment of a portion of an insulated metal panel wall system, i.e. the insulated metal panel wall 302, and in its upper section a plan view of the insulated metal panel wall 302 so as to illustrate the nature of the angles between adjacent panels of the insulated metal panel wall 302 at five vertical parametric mullion stacks, i.e. the first parametric mullion stack 304, the second parametric mullion stack 306, the third parametric mullion stack 308, the fourth parametric mullion stack 310, and the fifth parametric mullion stack 312. The unevenly dashed lines, e.g. the unevenly dashed line 314, between the upper and lower sections of FIG. 15, indicate the alignment of the two views with one another. Note that the parametric mullions in the insulated metal panel wall 302 are the same as those of the parametric mullion 10 (see, e.g. FIG. 2), except, in some instances, the catchment beam of the parametric mullions is of the style shown in FIG. 5B rather than that shown in FIG. 5A. Also note that the parametric mullions themselves are not visible in the lower section of FIG. 15.

The insulated metal panel wall 302 comprises a plurality of panels comprising insulated metal panels, e.g. the first insulated metal panel 316, as well as a plurality of panels comprising glass panes, e.g. the first glass panel 318. The glass panels of the insulated metal panel wall 302 are what are commonly referred to in the art as "frameless" panels, the term meaning that the frames of the panels are unnoticeable or nearly unnoticeable when the outward facade of the insulated metal panel wall is viewed. Nonetheless, it is to be understood that the insulated metal panel wall systems of the present invention may comprise framed panels, i.e. panels whose frames are generally noticeable when the outward facade of the insulated metal panel wall is viewed as well as insulated metal panel walls comprising a combination of frameless and framed panels. The insulated metal panel wall 302 will now be used to describe the various junctions contained in the insulated metal panel wall between panels and between parametric mullions and panels, starting with vertical junctions (which, despite the name, are junctions between horizontally adjacent components)

and then proceeding to horizontal junctions (which, despite the name, are junctions between vertically adjacent components).

It is to be kept in mind when viewing the cross-sectional drawings in this section, that most features shown in those drawings extend in directions perpendicular to the page for the length of the parametric mullion or panel under discussion. Exceptions are such things as screws and bolts for which their long dimensions obviously lie in some plane other than that which is perpendicular to the plane of the page.

Refer to FIG. 16 which is a schematic cross-sectional view taken at cutting plane 16-16 in FIG. 15 at the junction of the second and third insulated metal panels 320, 322 and the parametric mullion 324 of the second parametric mullion stack 306. The parametric mullion 324 has a catchment beam 326 of the type that is illustrated in FIG. 5A. Each of the first and second insulated metal panels 320, 322 comprises an insulating foam-filled inset, e.g. the first insulation inset 328, surrounded in part by a frame, only part of which, the first vertical member 330, is visible in FIG. 16. Insulated metal panels which are suitable for use with the present invention are available commercially, e.g. from Kingspan Insulated Panels, 726 Summerhill Drive, Deland, Fla. 32724, United States.

Figure 17:
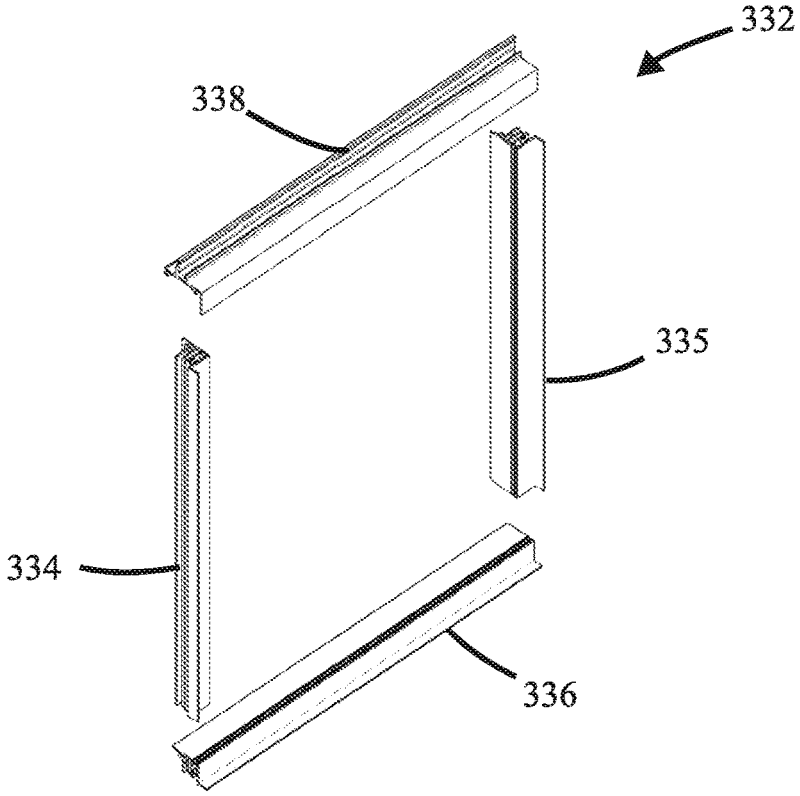
FIG. 17 is an outward side schematic perspective view of the component of a frame for an insulation metal panel.

An outward side schematic perspective view of the component of a frame 332 for an insulation metal panel is shown in FIG. 17. The frame 332 includes two jamb members, i.e. first and second vertical members 334, 335, and first and second horizontal members, i.e. the sill member 336 and the header member 338. However, it should be understood that in most instances, an insulation metal panel will include only the jamb portions of the frame attached to an insulation metal inset. The horizontal frame members, i.e. the sill and header members, are used only when the insulation metal panel is adjacent to something other than another insulation metal panel. Thus, instances in which an insulation metal pane includes a full frame, such as the frame 332, are usually relatively few in most insulated metal curtain walls.

Refer to FIG. 18A which provides a closer view of the area contained within the dashed-line box 340 in FIG. 16. Inasmuch as the portions of the first and second insulated metal panels 320, 322 shown in FIG. 18A are essentially mirror images of one another, only the first insulated metal panel 320 and the first vertical member 334 of its frame will be discussed. The first insulation inset 328 of the first insulated metal panel 320 comprises a partial envelope comprising an outward-facing shell 342 and an inward-facing cover 344. Contained within the partial envelope is a foam insulation slab 346. Note that the foam insulation slabs, e.g. foam insulation slab 346, may be formed in situ within the envelope of the insulated metal panel by injecting an expandable, hardenable insulation material into the envelope. Note that in some preferred embodiments, the inward-facing cover, e.g. the inward facing cover 344, is constructed so as to be suitable as a wall material for the space in the building which the insulated metal panel in part closes off, thus obviating the need for the installation thereat of other wall materials, e.g. drywall.

At the junction of the first insulation inset 328 and its frame, faces of the first vertical member 334 fit against exposed faces of the foam slab 346 and the beveled ends 348*a*, 348*b* of the first vertical member 330 are contained within the cavities formed between exposed faces of the foam slab 346 and the beveled end tabs 350, 352, respectively, of the shell 342 and the cover 344. The first vertical member 334 is connected to the inset 328 by way of connecting screws, e.g. the screws 354*a*, 354*b*, through the beveled ends 348*a*, 348*b* and the beveled end tabs 350, 352. Note that in this embodiment, the connecting screws are aligned in parallel directions with one another so as to maximize the moment couple of the connection of the inset and its frame.

Note that the first vertical frame member 330 comprises an inward member 356 which is connected to, but thermally isolated from, an outward member 358 by way of the first and second flanged insulating connectors 360*a*, 360*b*. Preferably, the first and second flanged insulating connectors 360*a*, 360*b* and other insulating connectors discussed herein are made of an extruded glass-fiber reinforced polymide, e.g. those available under the Insulbar® trademark of Ensinger Inc. of Grenloch, N.J. 08032, United States of America. The flanges of the first and second flanged insulating connectors 360*a*, 360*b* are captured within opposing pairs of flange grooves on the outward face of the inward member 356 and the inward face of the outward member 358.

A preferred alternate embodiment of the frames for the insulated metal panels is shown in FIG. 18B. FIG. 18B shows the same schematic cross-sectional view that is shown in FIG. 18A in which the vertical member of the insulated metal panels, e.g. the first vertical member 330, have been replaced by alternate vertical members, e.g. the alternate first vertical member 330A. These alternate vertical members are the same as those represented by the first vertical member 330 in all respects except that the alternate vertical members includes ridges, e.g. the ridge 357, which protrude into the foam insulation slabs of the insulated metal panels to which the alternate vertical members are attached. Optionally, each such ridge may be affixed to the foam insulation slab by an adhesive applied periodically or continuously along the lengths of the ridges.

An additional difference between FIG. 18A and FIG. 18B is that, for illustrative purposes, two of the screws, the first and second securing screws 359*a*, 359*b*, that are periodically spaced vertically to secure the insulated metal panels to the mullions are shown in FIG. 18B.

Turning attention now to the parametric mullion 324, its catchment beam 326 is connected to, but thermally isolated from, a catchment extension beam 362 (which runs vertically along the entire length of the catchment beam 326) by the third and fourth flanged insulating connectors 364*a*, 364*b*. The catchment beam 326 has a pair of seals 366*a*, 366*b* adhesively attached to its outward face proximate to alignment ridges 368*a*, 368*b*. These seals 366*a*, 366*b*, when interfaced against an inward face of a panel frame member, e.g. of the first vertical frame member 330, form air seals between the environment on the outward sides of the panels and the environment on the inward sides of the panels.

The catchment extension beam 362 has a pair of flanged elastomeric seal gaskets 370*a*, 370*b* captured within flange grooves on its inward face. The seal gaskets 370*a*, 370*b* when compressed against on outward face of a panel frame, e.g. the outward face of the inward member 356, form a water seal between the environment on the outward sides of the panels and the environment on the inward sides of the panels. The catchment extension beam 362 also has a pair of flanged elastomeric wipe gaskets 372*a*, 372*b* captured within flange grooves on its outward face. The wipe gaskets 372*a*, 372*b* pressed against on inward face of a panel frame, e.g. the inward face of the outward member 358, form a seal between the environment on the outward sides of the panels and the environment on the inward sides of the panels to prevent the ingress of debris, insects, and water.

Figure 20:
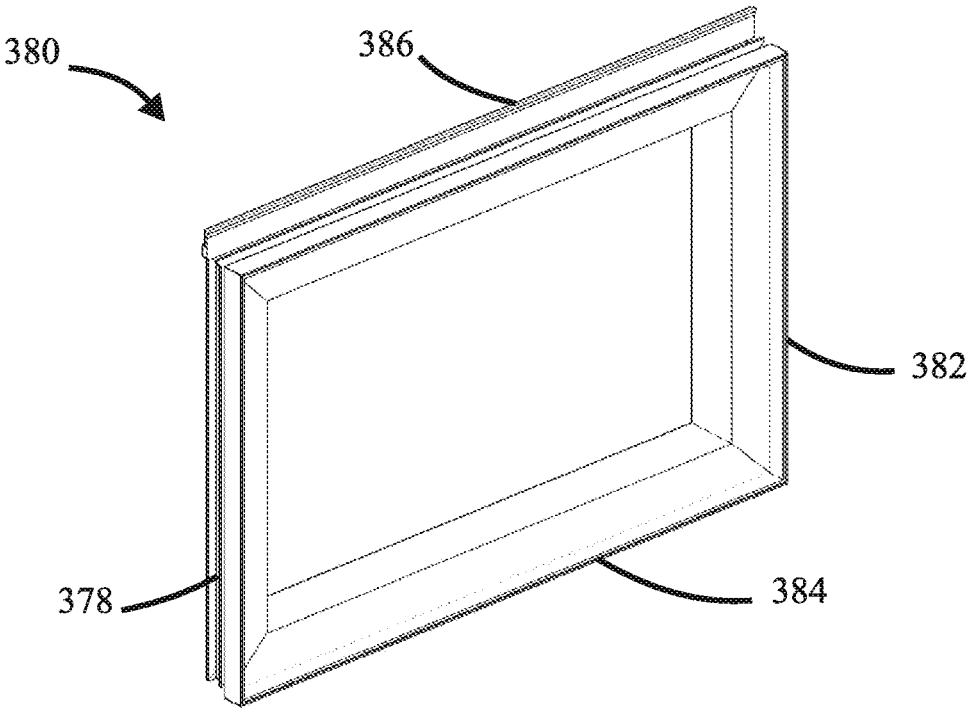
FIG. 20 is an outward side perspective view of a frame of which a first frame member is an element.

Refer now to FIG. 19 which is a schematic cross-sectional view taken at cutting plane 19-19 in FIG. 15 at the junction of the third insulated metal panel 322, the second glass panel 374, and the parametric mullion 375 of the third parametric mullion stack 308. The parametric mullion 375 is the same as the parametric mullion 324 and the third insulated metal panel 322 is the same as the second and third insulated metal panels 320, 322 discussed with respect to FIGS. 16 and 18. The second glass panel 374 comprises a first glass pane inset 376 surrounded by a frame, only part of which, i.e. the first vertical member 378, is visible in FIG. 19. An outward side perspective view of the frame 380, of which the first frame member 378 is an element, is shown in FIG. 20. The frame 380 includes two jamb members, i.e. the first vertical member 378 and a second vertical member 382, and first and second horizontal members 384, 386 as sill and header members, respectively. Each connection between a vertical member, e.g. the first vertical member 378, and a horizontal member, e.g. the first horizontal member 384, is a mitered connection that permits water flowing along channels within the horizontal members to drain into corresponding channels of the vertical members and subsequently flow down the parametric mullion stack of which the parametric mullion is a part.

Figure 21:
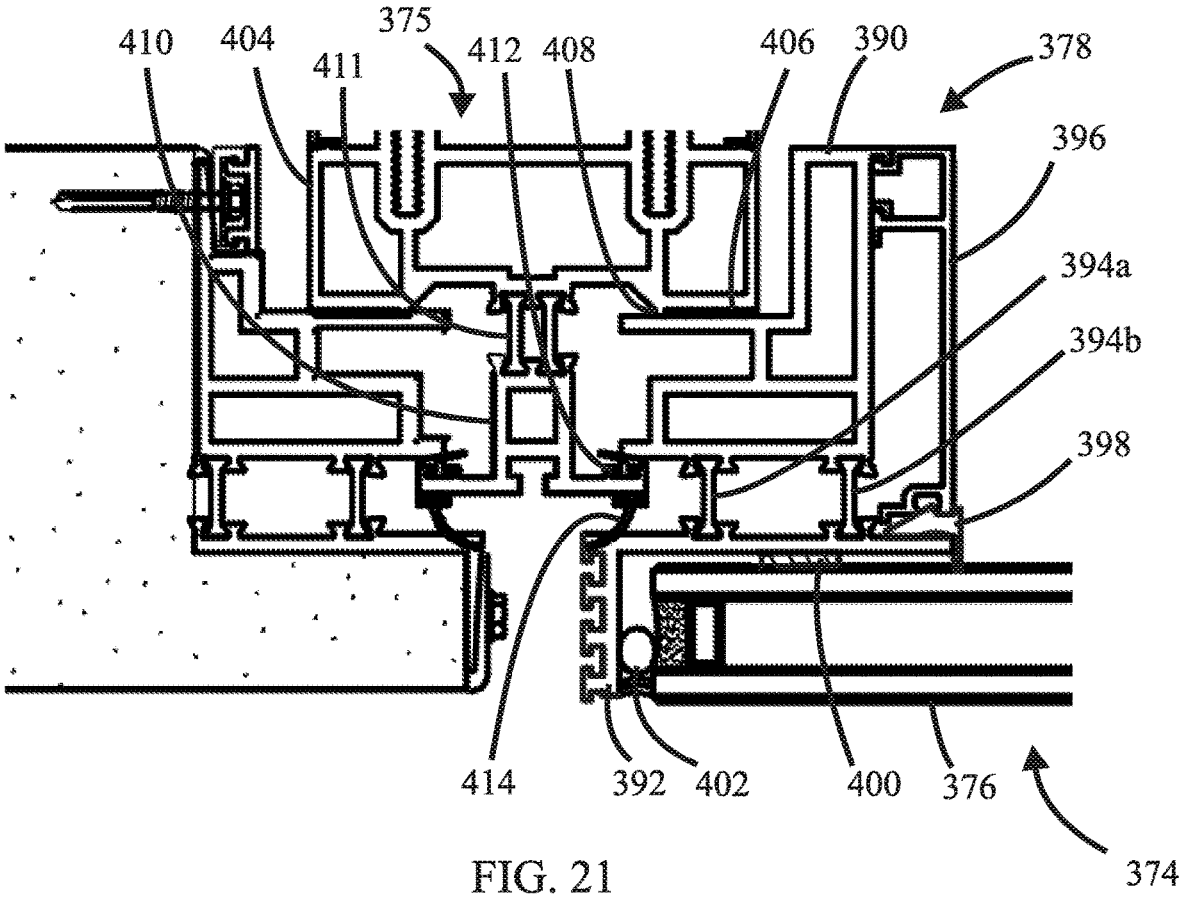
FIG. 21 is a closer view of the area contained within the dashed-line box in FIG. 19.

Refer to FIG. 21 which provides a closer view of the area contained within the dashed-line box 388 in FIG. 19. Only the aspects of this drawing that relate to the second glass panel 374 will be discussed (see FIGS. 16 and 18 for information about the remaining aspects of FIG. 21). The first glass pane inset 376 is an insulated glass double pane. The first frame member 378 comprises an inward member 390, which is connected to, but thermally isolated from, an outward member 392 by way of the first and second flanged insulating connectors 394*a*, 394*b*, and a glazing member 396 that is snap connected to the inward member 390 and is separated from the outward member 392 by a gasket 398. The first glass pane inset 376 is adhesively attached to the outward member 392 by adhesive strip 400, which, in combination with the lower tab of gasket 398, provide an air seal between the environment on the outward side of the second glass panel 374 and the environment on the inward side of that panel. Interposed between the edge of the first glass pane inset 376 and a face of the outward member 392 is a water seal 402.

The parametric mullion 375 has a catchment beam 404 which has a strip seal 406 adhesively attached to its outward face adjacent to an alignment ridge 408. The strip seal 406 interfaces against an inward face of the first vertical frame member 390 to form an air seal between the environment on the outward side of the second glass panel 374 and the environment on the inward side of that panel. The catchment extension beam 410 is attached to and thermally separated from the catchment beam 404 by a pair of flanged insulating connectors, e.g. the flanged insulating connector 411. The catchment extension beam 410 has a flanged elastomeric seal gasket 412 captured within a flange groove on its inward face. The seal gasket 412 interfaces with an outward face of the inward member 390 to form a water seal between the environment on the outward sides of the second glass panel 374 and the environment on the inward side of that panel. The catchment extension beam 410 also has a flanged elastomeric wipe gasket 414 captured within flange grooves on its outward face. The wipe gasket 414 interfaces against on inward face of the outward member 392 to form a seal between the environment on the outward side of the second glass panel 374 and the environment on the inward sides of that panel to prevent the ingress of debris, insects, and water.

So far, the discussion has involved adjacent panels of the insulated metal panel wall 302 which are in the same plane. Such planes can be said to be at a straight angle to one an other, i.e. to have an included angle of $\pi$ radians (180 degrees). The discussion will now consider panels which are disposed at non-straight angles to one another. In considering such embodiments, it is to be understood that the drawings that will be referenced are not cross-sectional drawings, but rather cross-cut drawings. In these cross-cut drawings, all of the components which are involved in a joint are showed in plan view even if they do not fall within the same plane normal to the direction of viewing. In general, a junction which involves a pinned joint has its components arranged vertically along the pin in the manner of a door hinge, i.e. one component stacked on top of another with the pin rotatably joining those stacked components together. The stacked components include three major components. One of these components extends outwardly from a parametric mullion and includes one or two pinned connection points. Each of the other two of these components extend from a respective panel toward their respective pinned connection points. In the junctions in which the component extending outwardly from the parametric mullion has a single pinned connection point, that component is vertically disposed between the other two components. In the junctions in which the component extending outwardly from the parametric mullion has two pinned connection points, that component is vertically disposed beneath the other two components and the other two components are disposed horizontally from one another.

Each of the three major components discussed in the previous paragraph has its own vertical height which is chosen based on the structural requirements of the wall of which the components are a part. In some preferred embodiments, the vertical heights of all of these components are the same, e.g. about 10.16 centimeters (4 inches). It is to be understood that junctions which involve such pinned connection joints, one or more such joints may be used. Preferably, one joint is disposed proximate to the top of the junction and another is disposed proximate to the bottom of the junction with additional joints being disposed vertically therebetween in numbers sufficient to provide the desired structural strength to wall at the junction.

Figure 22:
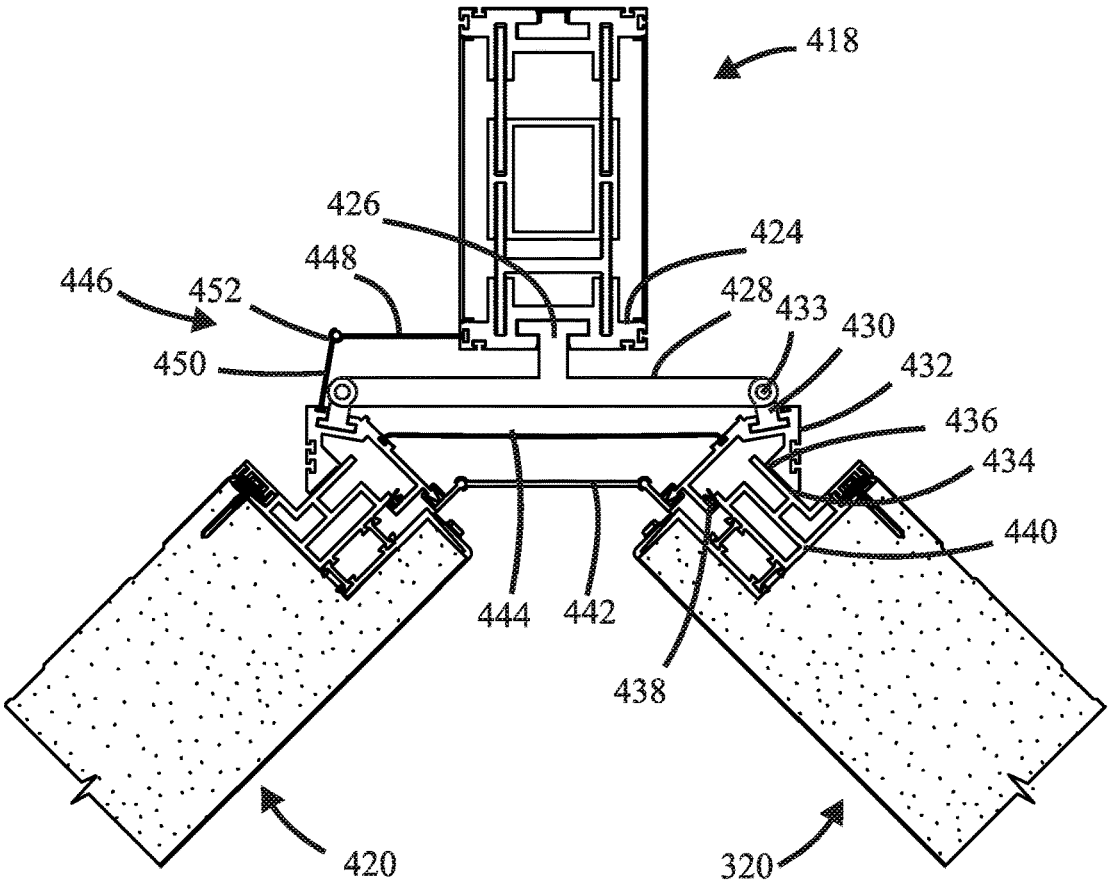
FIG. 22 is a schematic cross-cut view taken at cutting plane 22-22 in FIG. 15.

FIG. 22 is a schematic cross-cut view taken at cutting plane 22-22 in FIG. 15 at the junction of the second insulated metal panel 320 and a parametric mullion 418 of the first parametric mullion stack 304 and a fourth insulated metal panel 420 which is not visible in FIG. 15, but is part of the panel stack 422 which is partially represented in the top portion of FIG. 15 adjacent the first parametric mullion stack 304. The parametric mullion 418 is the same as the parametric mullion 10 discussed above, except that its catchment beam 424 is like the one shown in FIG. 5B. The end of the second insulated metal panel 320 that appears in FIG. 22 is opposite to the end of that panel that was shown in FIG. 16 and is configured the same as the end third insulated metal 322 as shown in FIG. 16. The portion of the fourth insulated metal panel 420 shown in FIG. 22 is configured the same as the portion of the second insulated metal panel 320 that is shown in FIG. 16. Thus, only the features of the parametric mullion 418 and the second and fourth insulated metal panels 320, 420 which have not been discussed before will now be discussed, i.e. the features which connect the second and fourth insulated metal panels 320, 420 to the parametric mullion 418 while permitting them to be disposed at right angles to one another in an inside corner configuration. Also, inasmuch as such of these features which are related to the insulated metal panels are mirror images for the second and fourth insulated metal panels 320, 420, such features are discussed only with regard to the second insulated metal panel 320.

Referring to FIG. 5B, recall that the catchment beams having the design shown there have a flange-shaped connector slot, e.g. the connector slot 102 shown in FIG. 5B. Returning now to FIG. 22, it is shown there that the flange connector portion 426 of an inside corner T-bar connector 428 occupies the connector slot of the catchment beam 424. At either end of the inside corner T-bar connector 428 is a pinned rotatable connection, e.g. rotatable connector 430. These rotatable connectors each have a flanged connector that is received into connector slot of a catchment extension beam, e.g. the catchment extension beam 432, which are pivotably held in place by a pin 433. The catchment extension beams have a strip seal, e.g. the strip seal 434, adhesively attached to an outward face adjacent to an alignment ridge, e.g. the alignment ridge 436, and a flanged gasket, e.g. the gasket 438, captured within a flanged groove on an inward face. The strip seal interfaces with a inward face of the inward member of a frame member of the insulated metal panel, e.g. of the inward member 440 of the second insulated metal panel 320, to form an air seal between the environment on the outward sides of the panels and the environment on the inward sides of the panels. The flanged gaskets interface with an inward face of the inward member of a frame member of the insulated metal panel, e.g. of the inward member 440 of the second insulated metal panel 320, to form a water seal between the environment on the outward sides of the panel and the environment on the inward sides of the panels.

Interposed in the outward space between the two panels are a water deflector 442 and an air seal 444. The water deflector 442 is attached by pivoted snap connector ends which capture the arrowhead shaped ridges of the catchment extension beams, e.g. catchment extension beam 432. The elastomeric air seal 444 has flanged ends which are captured by flanged grooves of the catchment extension beams.

Optionally, a cover, e.g. the cover 446, is attached between the catchment beam and the catchment extension beam. This cover may be used for aesthetic purposes and/or to provide some amount of fire protection to the components it shields from the inward space. The cover 446 includes a first member 448 and a second member 450, each of which has a flanged end adapted to be captured within a flanged groove of the catchment beam 424 and of a catchment beam extension, respectively. The other end of the first member 448 has a cylindrical shape that is adapted to be captured within concave end of the second member 450 to form a rotatable snap connection 452.

FIG. 23A is a schematic cross-cut view taken at cutting plane 23-23 in FIG. 15 at the junction of the fifth insulated metal panel 454 and a parametric mullion 456 of the fifth parametric mullion stack 312 and a sixth insulated metal panel 458 which is not visible in FIG. 15, but is part of the panel stack 460 which is partially represented in the top portion of FIG. 15 adjacent the fifth parametric mullion stack 312. The fifth and sixth insulated metal panels 454, 458 are disposed at a right angle to one another in an outside corner configuration. Note that with only the few exceptions that will next be enumerated, all of the features shown in FIG. 23A have identical counterparts in FIG. 22.

The first exception is that the outside T-bar connector 462 of FIG. 23A is different from its counterpart inside corner T-bar connector 428 of FIG. 22. The lateral arms of the inside corner connector T-bar 428 are missing from the outside corner T-bar connector 462. The outwardly extending portion 464 of the flange connector portion 462 has been extended to end in a pinned connection with the left and right rotatable connectors 466*a*, 466*b*, which are similar in design and function to the rotatable connector 430 shown in FIG. 22.

Two other exceptions are that the sizes of the water deflector 468A and the air seal 470 of FIG. 23A are different from their counterparts the water deflector 442 and the air seal 444 of FIG. 22 in order to adapt these elements to the geometry of the panel junction of FIG. 23A. Finally, there is no counterpart in FIG. 23A to the cover 446 of FIG. 22 as the geometry of the panel junction in that drawing eliminates the need for such covers.

FIG. 23B is a schematic cross-cut view that is similar in every respect to that of FIG. 23A except that the water deflector 468B of FIG. 23B has a right angle corner shape whereas the water deflector 468A of FIG. 23A has a planar shape where it spans the space between the adjacent insulated metal panels.

FIG. 23C is a schematic cross-cut view that is similar in every respect but four to FIG. 23B. The first difference is that three-piece water deflector 468B of FIG. 23B has been replaced by the single piece water deflector 468C of FIG. 23C. The second difference is that in FIG. 23C the vertical frames of the insulated metal panels, e.g. the vertical frame 469, includes ridges, e.g. the ridge 471, which protrude into the foam insulation slabs of the insulated metal panels to which the alternate vertical members are attached in the manner discussed with regard to FIG. 18B. The third difference is that in FIG. 18C the catchment extension beams, e.g. the catchment extension beam 472, is of an alternative design. The fourth difference is that the air seal 470C shown in FIG. 18C is longer in the plane of the drawing and so is less taught than its counterpart in FIG. 18B.

Figure 24:
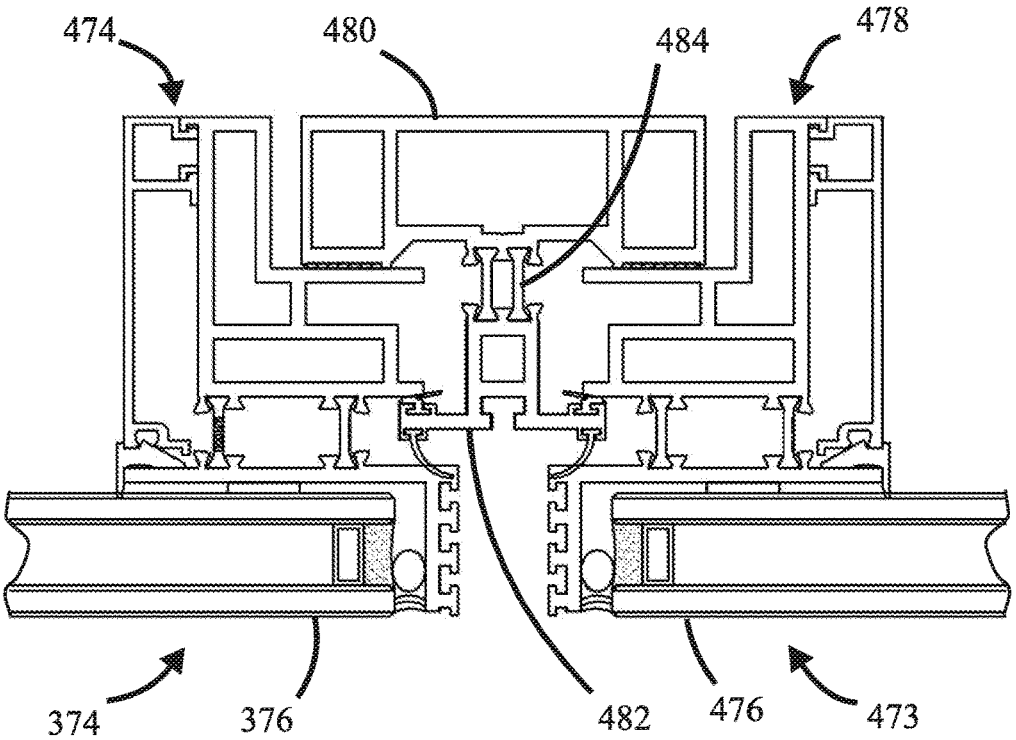
FIG. 24 is a schematic cross-sectional view taken at cutting plane 24-24 in FIG. 15.

FIG. 24 is a schematic cross-sectional view taken at cutting plane 24-24 in FIG. 15 at the junction of the second glass panel 374 and the third glass panel 473. The second glass panel 374 comprises a first glass pane inset 376 connected to a second vertical frame member 474. The components and elements of the second vertical frame member 474 are mirror image duplicates of those of the first vertical frame member 378 discussed above with regard to FIG. 21. The third glass panel 473 comprises a second glass pane inset 476 connected to a third vertical frame member 478. The components and elements of the third vertical frame member 478 are duplicates of those of the first vertical frame member 378. Note that there is no parametric mullion located at this junction. In its place at this junction is a vertical joint extrusion 480 which has all of the outward features of the catchment beam 404 discussed with regard to FIG. 21. The vertical joint extrusion 480 is connected to catchment extension beam 482 by way of a pair of flanged insulating connectors, e.g. 484. The features of the catchment extension beam 482 are the same as those of the catchment extension beam 410 discussed with regard to FIG. 21.

Figure 25:
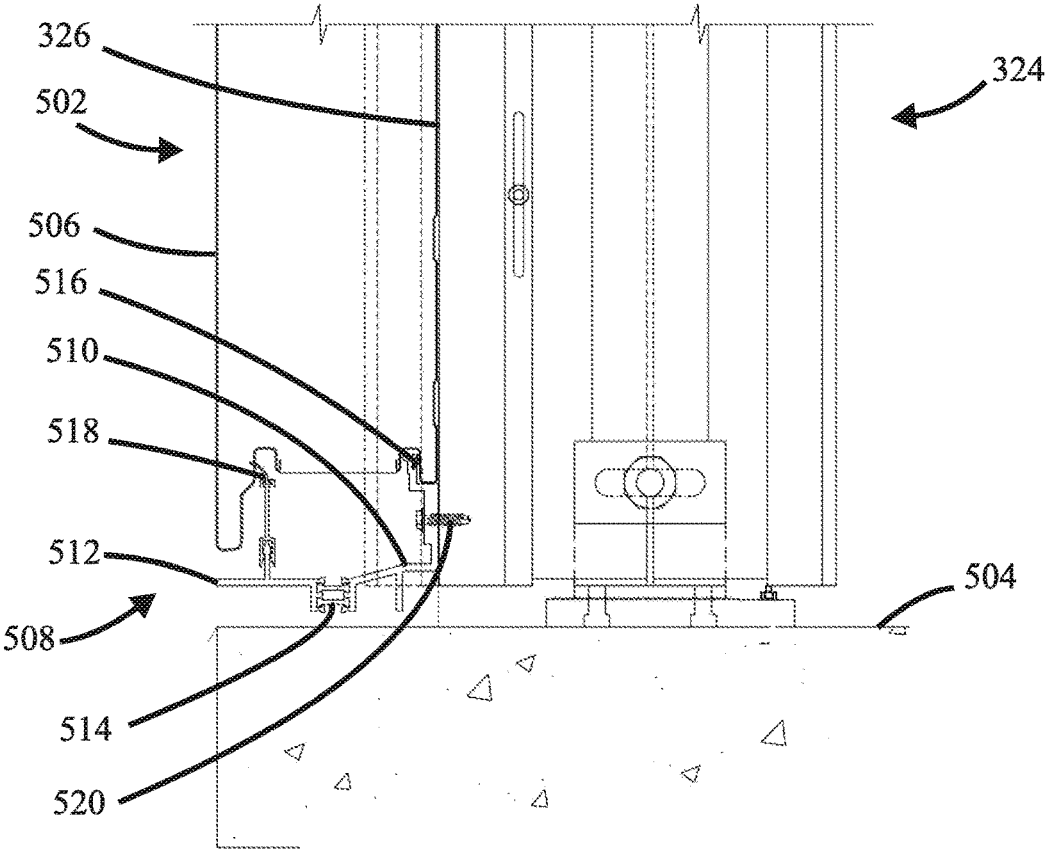
FIG. 25 is a schematic cross-sectional view taken at cutting plane 25-25 in FIG. 15.

Starting with FIG. 25, the horizontal junctions of the insulated metal panel wall 302 will now be discussed. FIG. 25 is a schematic cross-sectional view taken at cutting plane 25-25 in FIG. 15 that is just to the right of junction of the sixth insulated metal panel 502 and the parametric mullion 324 of the second parametric mullion stack 306. Note that unlike the previous cross-sectional views which showed only features located within the cutting plane, the cross-sectional view in FIG. 25 shows the location of some of the components and elements of the second parametric mullion stack 306 and the screw 520 which are located just to the left of the cutting plane.

The parametric mullion 324 is bolted to the ground floor deck 504 of the building. The sixth insulated metal panel 502 includes an insulation inset 506 and two vertical frame members, neither of which are visible in FIG. 25. A base starter extrusion set 508 comprises an inward extrusion 510 and an outward extrusion 512 connected together by a pair of insulating connectors, e.g. the insulating connector 514. The inward extrusion 510 carries a flanged seal 516 captured within a flanged groove on an inward face to provide an inward seal against the insulation inset 506. The outward extrusion 512 carries a flanged wiper seal 518 captured within a flanged groove to provide an outward seal against the insulation inset 506. The base starter extrusion set 508 is attached by way of screw 520 through its inward member 510 to the catchment beam 326 of the parametric mullion 324.

Figure 26:
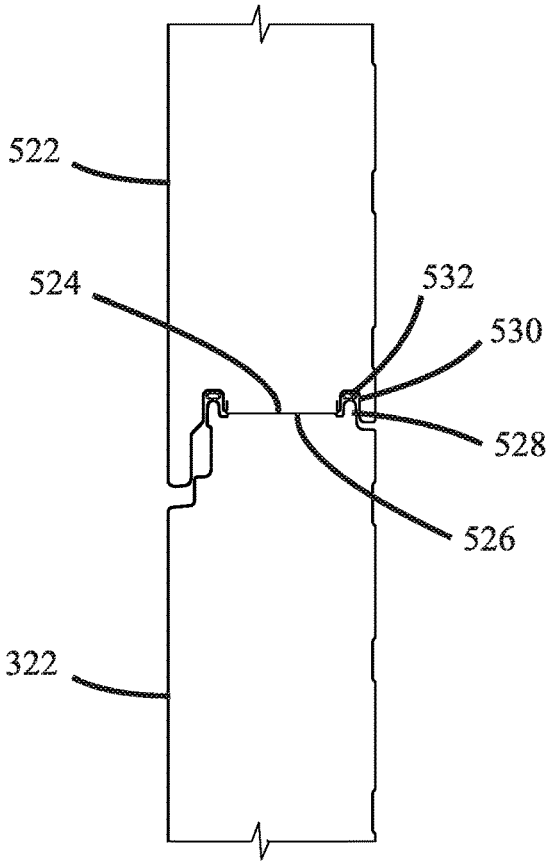
FIG. 26 is a schematic cross-sectional view taken at cutting plane 26-26 in FIG. 15.

FIG. 26 is a schematic cross-sectional view taken at cutting plane 26-26 in FIG. 15 showing the half-lap or ship-lap connection between two vertically adjacent insulated metal panels, i.e. third insulated metal panel 322 and seventh insulated metal panel 522. A lower sheet metal face 524 of the seventh insulated metal panel 522 interfaces with an upper sheet metal face 526 of the third insulated metal panel 322. The third metal insulation panel 322 has two parallel upward ridges, e.g. the ridge 528, which protrude into the two parallel downward facing troughs, e.g. the trough 530, of the seventh insulated metal panel 522. Preferably, a caulking bead, e.g. the caulking bead 532, is provided within each of the ridge/trough combinations to create seals between the two adjacent insulated metal panels.

Figure 27:
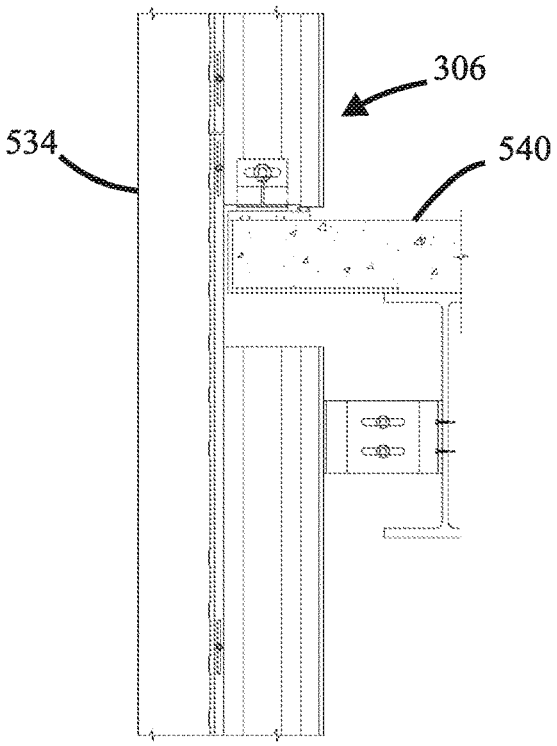
FIG. 27 is a schematic cross-sectional view taken at cutting plane 27-27 in FIG. 15.

FIG. 27 is a schematic cross-sectional view taken at cutting plane 27-27 in FIG. 15, which is just to the right of where the vertical frame member of the eighth insulated metal panel 534 begins. Note that the horizontal dashed lines in FIG. 15, e.g. the horizontal dashed line 536, indicates the location of the decks of the building behind the insulated metal panel wall 302 and the vertical dashed lines, e.g. vertical dashed line 538, indicate the locations of the parametric mullions behind the insulated metal panel wall 302. Note also, that the cross-sectional view in FIG. 27 shows the location of some of the components and elements of the second parametric mullion stack 306 which are located just to the left of the cutting plane. As shown in this drawing, the insulated metal panel 534 is located outwardly from the outward end of the deck 540 by only a very short distance which is significantly less than would be the case for convention insulated metal panel walls.

Figure 28:
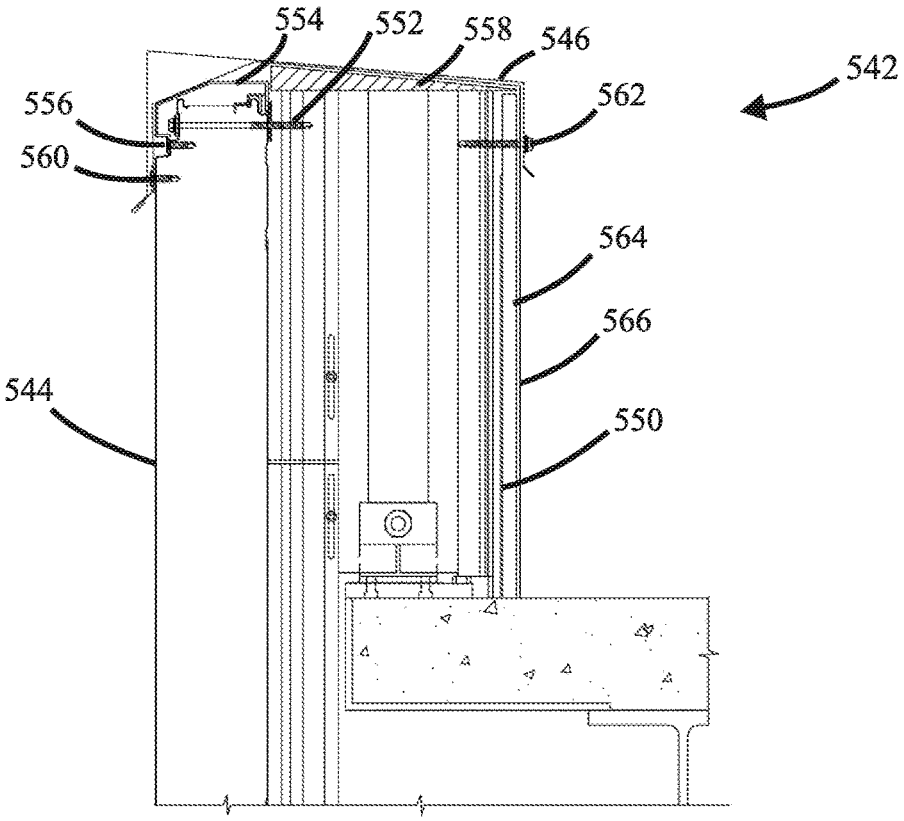
FIG. 28 is a schematic cross-sectional view taken at cutting plane 28-28 in FIG. 15.

FIG. 28 is a schematic cross-sectional view taken at cutting plane 28-28 in FIG. 15 and shows a portion of the parapet 542 of the insulated metal panel wall 302. The cutting plane 28-28 is located just to the right of where the vertical frame member of the ninth insulated metal panel 544 begins. Like FIG. 27, the cross-sectional view in FIG. 28 shows the location of some of the components of the second parametric mullion stack 306 which are located just to the left of the cutting plane, as well as the parapet top flashing 546. The insulated metal panel 544 is attached to the outward side of the parametric mullion 550 by a first screw 552. A parapet cap extrusion 554 is attached to the end of the insulated metal panel 544 by a second screw 556. The flashing 546 is spaced from the top end of the parametric mullion 550 by a wedge 558 and attached to the outward side of the insulated metal panel 544 by a third screw 560 and to the inward side of the parametric mullion 550 by a fourth screw 562, which also secures sheathing 564 and roof membrane 566 to the inward side of the parametric mullion 550.

Figure 30:
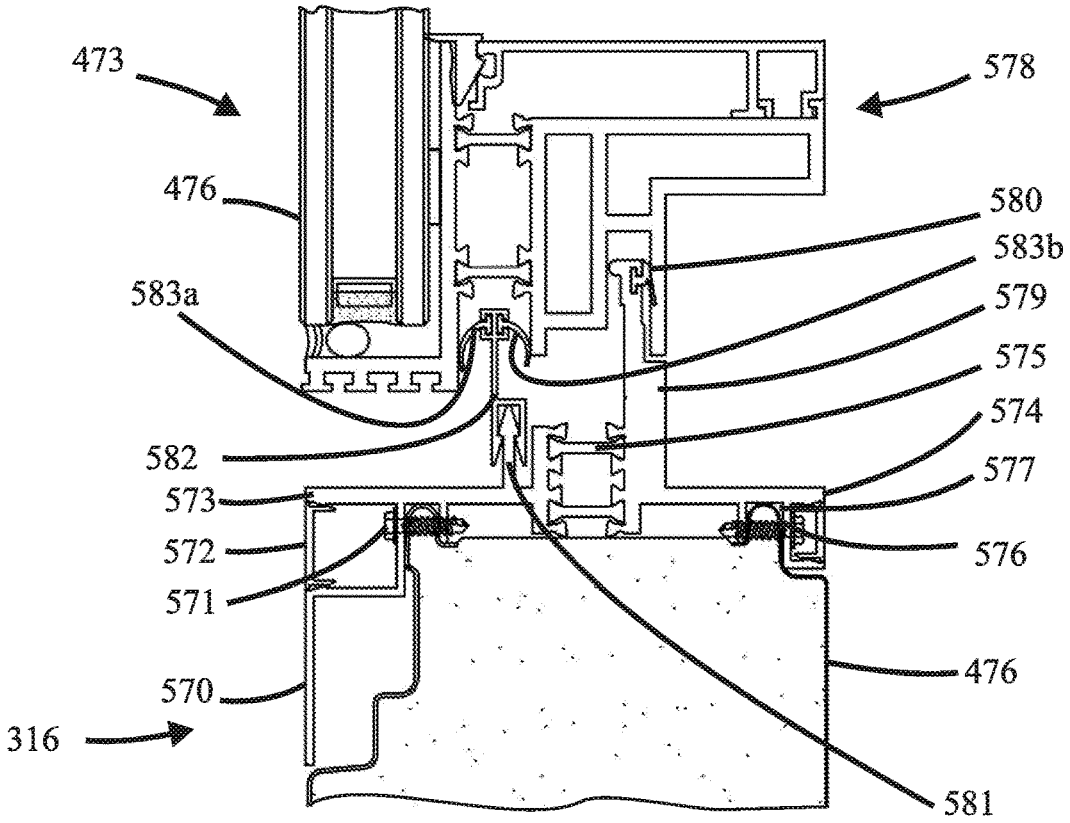
FIG. 30 is a closer view of the area contained within the dashed-line box 568 in FIG. 29.

FIG. 29 is a schematic cross-sectional view taken at cutting plane 29-29 in FIG. 15 showing the junction of the first insulated metal panel 316 with the third glass panel 473. Refer to FIG. 30 which provides a closer view of the area contained within the dashed-line box 568 in FIG. 29. The top portion of the first insulated metal panel 316 has the same configuration as is shown in FIG. 26 for the third insulated metal panel 322. The metal envelope 476 of the first insulated metal panel 316 continues around the upper end of the first insulated metal panel 316 providing a rigid body to which the head or top horizontal frame member 570 is attached by screws, e.g. screw 571, which are hidden beneath caps, e.g. the cap 572. Note that the head frame member 570 comprises an outward member 573 and an inward member 574 which are interconnected by a pair of insulating connectors, e.g. the insulating connector 575. The metal envelope 476 has a pair of upward ridges, e.g. the ridge 576, which are received by downward cavities, e.g. the cavity 577, of the head frame member 570. The third glass panel 473 includes the third glass pane inset 476 and a sill or bottom frame horizontal member 578. The components and elements of the sill frame horizontal member 578 are duplicates of those of the first vertical frame member 378 discussed with regard to FIG. 21. The inward member 574 of the head frame member 570 has a first vertical arm 579 which carries a flanged bottom seal strip 580 that forms an air seal against a face of the sill frame horizontal member 578. The outward member 573 of the head frame member 570 has a vertical arrowhead connector ridge 581 that is captured within a receiving cavity of a water deflector clip extrusion 582. The water deflector clip extrusion 582 carries a first flanged bottom wipe gasket 583*a* which forms a water seal against an inward face of the sill frame horizontal member 578 and a second flanged bottom wipe gasket 583*b* that forms a water seal against an outward face of the sill frame horizontal member 578.

Figure 31:
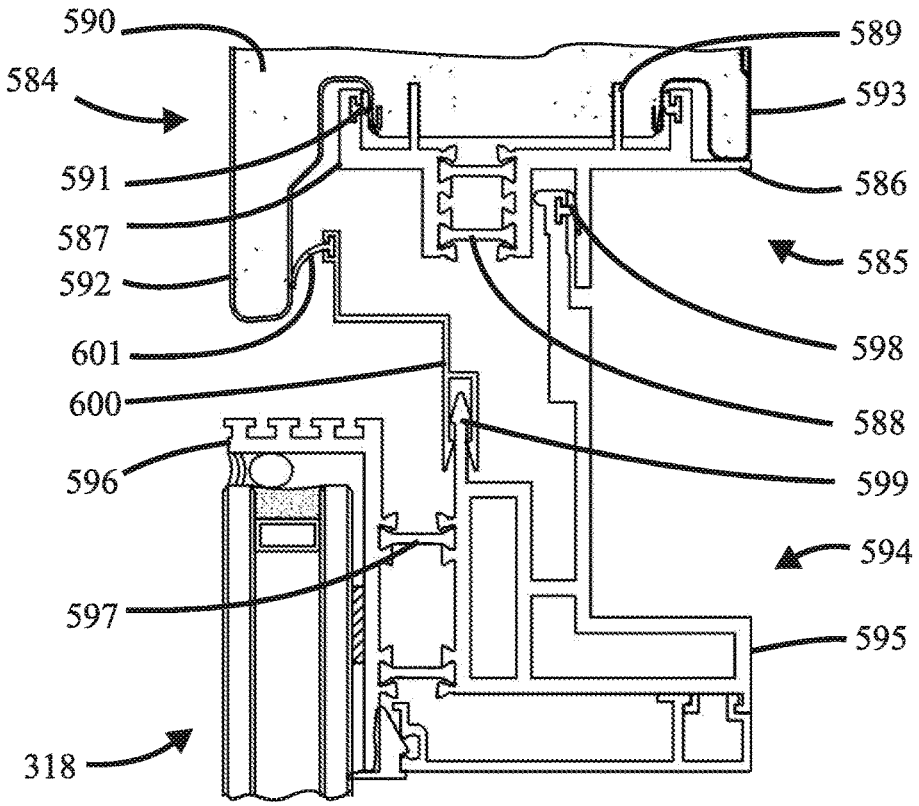
FIG. 31 is a schematic cross-sectional view taken at cutting plane 31-31 in FIG. 15.

FIG. 31 is a schematic cross-sectional view taken at cutting plane 31-31 in FIG. 15 showing the junction of the tenth insulated metal panel 584 with the first glass panel 318. The bottom portion of the tenth insulated metal panel 584 has the same configuration as is shown in FIG. 26 for the seventh insulated metal panel 522, but here the bottom portion of the tenth insulated metal panel 584 is captured by the sill or lower horizontal frame member 585. The lower horizontal frame member 585 comprises an inward member 586 and an outward member 587 which are interconnected by flanged insulating connectors, e.g. the flanged insulating connector 588. Each of the inward and outward members 586, 587 has a ridge, e.g. the ridge 589 of the inward member 586, that protrudes into the foam insulation slab 590 of the tenth metal insulation panel 584. Optionally, each such ridge may be affixed to the foam insulation slab 590 by an adhesive applied periodically or continuously along the lengths of the ridges. Each of the inward and outward members 586, 587 also carries a flanged bottom seal strip, e.g. the flanged bottom seal strip 591 of outward member 587, that sealing engages a face of either the outward facing cover 592 or the inward facing cover 593 of the tenth metal insulation panel 584. The head or top horizontal frame member 594 of the first glass panel 318 comprises an inward member 595 and an outward member 596 which are interconnected by flanged insulating connectors, e.g. the flanged insulating connector 597. The inward member 595 carries a flanged bottom seal strip 598 that sealingly engages an outward face of the inward member 587 of the lower horizontal frame member 585. The inward member 595 of the top horizontal frame member 594 of the first glass panel 318 has an arrowhead connector ridge 599 that is captured within a receiving cavity of a water deflector clip extrusion 600. The water deflector clip extrusion 600 carries a flanged bottom wipe gasket 602 which forms a water seal against an inward face of the inward member 586 of the bottom horizontal member 585 of the tenth insulated metal panel 584.

Figure 32:
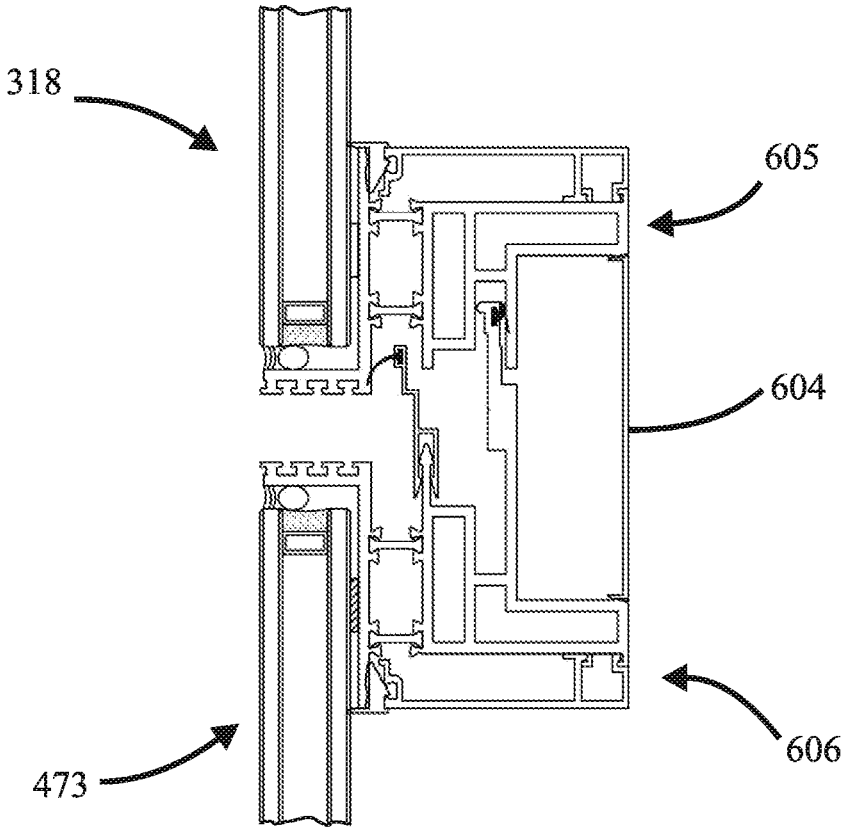
FIG. 32 is a schematic cross-sectional view taken at the cutting plane 32-32 in FIG. 15.

FIG. 32 is a schematic cross-sectional view taken at the cutting plane 32-32 in FIG. 15 showing the junction of the first glass panel 318 and the third glass panel 473. The components and elements of the first glass panel 318 have their exact counterparts in third glass panel 473 as they are described with regard to FIG. 30. The components and elements of the third glass panel 473 have their exact counterparts in the first glass panel 318 as they are described with regard to FIG. 31. A cover strip 604 is snap connected between the sill or bottom horizontal frame member 605 of the first glass panel 318 and the header or top horizontal frame member 606 of the third glass panel 473 to keep the space it covers free of debris and, preferably, to provide some fire protection to those components.

Curtain Wall Systems

The present invention comprises curtain wall systems which utilize the parametric mullions and the glass panels described above. Embodiments of such curtain wall systems include some inventive features which are in addition to those already described above. Some of those features will now be discussed with relation to FIGS. 33 to 43B. It is important to realize that the present invention eliminates the conventional need to set a curtain wall far outward of the building frame, thus lowering the moment of the dead weight load and thereby minimizing the corresponding conventional need to enhance the strength of the building frame to handle such moment loads. The present invention provides systems in which the glass panels are supported by the inventive parametric mullions described above.

FIG. 33 is a schematic perspective view of an embodiment of a building 608 having an embodiment of a curtain wall 610. The various features of this curtain wall 610 will be described in the discussion below. To start with, a portion of the front side of the curtain wall 610, beginning with the column 612 of panels at the left hand side of the front side and ending with the column 614 of panels, is presented in FIG. 34.

FIG. 34 shows in its lower section a schematic discontinuous front view of the curtain wall 610 and in its upper section a plan view of the curtain wall 610 so as to illustrate the nature of the angles between adjacent panels of the curtain wall 610 at nine vertical parametric mullion stacks, i.e. the first parametric mullion stack 616, the second parametric mullion stack 618, the third parametric mullion stack 620, the fourth parametric mullion stack 622, the fifth parametric mullion stack 624, the sixth parametric mullion stack 626, the seventh parametric mullion stack 628, the eighth parametric mullion stack 630, and the ninth parametric mullion stack 632. The unevenly dashed lines, e.g. the unevenly dashed line 634 between the upper and lower sections of FIG. 34, indicate the alignment of the two views with one another. The pairs of parallel horizontal dashed lines, e.g. the dashed lines 636*a*, 636*b*, indicate the presence of a deck behind the curtain wall 610. Note that the parametric mullions in the curtain wall 610 are the same as those of the parametric mullion 10 (see, e.g. FIG. 2), except in some instances, the catchment beam of the parametric mullions is of the style shown in FIG. 5B rather than of the style shown in FIG. 5A. Also note that the parametric mullions themselves are not visible in the lower section of FIG. 34.

Starting with FIG. 35, the horizontal junctions of the curtain wall 610 will now be discussed. However, FIG. 35 does not, strictly speaking, show a junction, but is a schematic cross-sectional view taken at cutting plane 35-35 in FIG. 34 just to the right of the junction of the first glass panel 638 of the curtain wall 610 and the parametric mullion 640 of the third parametric mullion stack 620. Note that, unlike the cross-sectional views which show only features located within the cutting plane, the cross-sectional view in FIG. 35 shows the location of some of the components and elements of the parametric mullion 640 and the screw 642 which are located just to the left of the cutting plane 35-35.

The parametric mullion 640 is bolted to the ground floor deck 644 of the building 608 in the manner described with regard to FIGS. 6A and 6B. Attached to the outward side of the parametric mullion 640 by the screw 642 is the base starter extrusion set 646. The base starter extrusion set 646 comprises an inward extrusion 648 and an outward extrusion 650 which are connected together by a pair of insulating connectors, e.g. the insulating connector 652, and a splash guard extrusion 654. Note that the inward extrusion 650 is the same as the inward extrusion 510 discussed with regard to FIG. 25. The outward extrusion 650 has a pair of vertical arrowhead ridges, e.g. the arrowhead ridge 656, which are received by snap connector cavities, e.g. the snap connector cavity 658, on the downward facing side of the splash guard extrusion 654.

Figure 35:
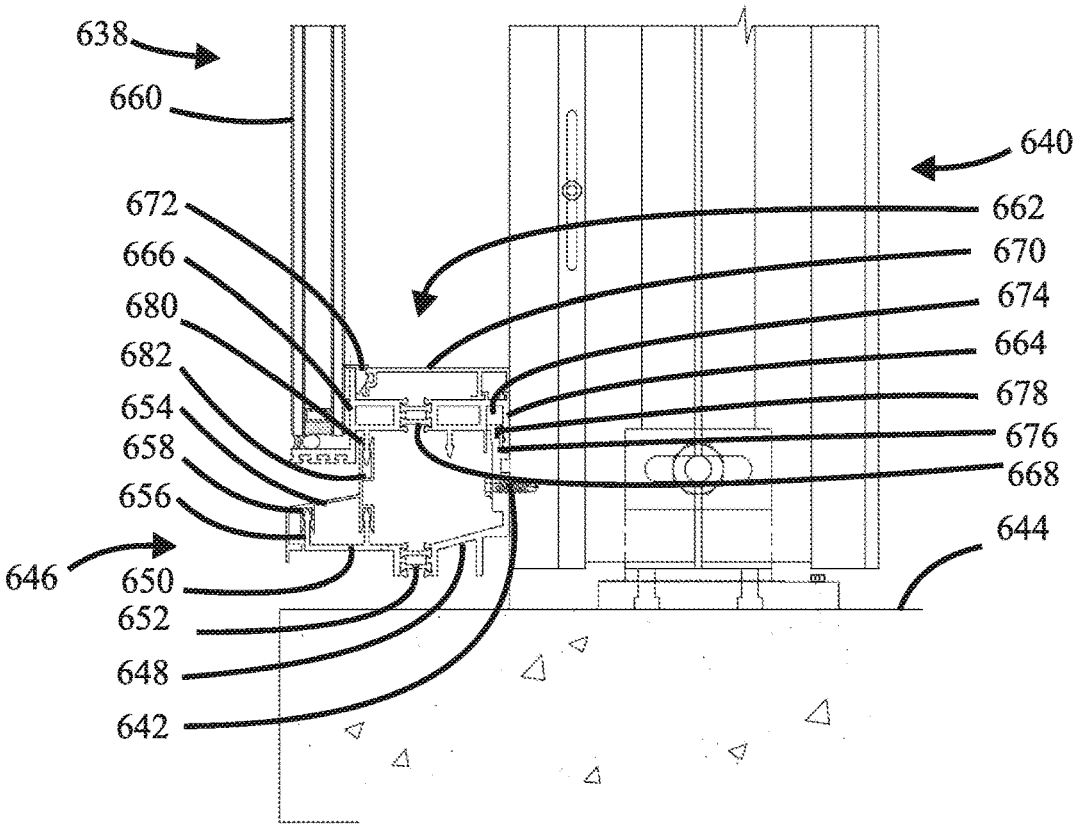
FIG. 35 is a schematic cross-sectional view taken at cutting plane 35-35 in FIG. 34.

The first glass panel 638 includes a glass pane inset 660 surrounded by a frame, of which only the bottom horizontal member 662 (sill member) is visible in FIG. 35. The bottom horizontal member 662 comprises an inward member 664 and an outward member 666 connected together by a pair of insulating connectors, e.g. the insulating connector 668. The attachment and sealing of the of the glass pane inset 660 to the outward member 666 is in the manner described above with regard to FIG. 21. The bottom horizontal member 662 also includes a glazing bead 670 and a sponge gasket 672 interposed between an inward face of the outward member 666 and the glazing bead 670. The inward member 664 has a channel 674 which receives a vertical ridge 676 of the inward extrusion 650. The vertical ridge 676 carries a flanged base seal 678 captured within a flanged groove on an inward face to provide an inward seal against a wall of the channel 674. The outward member 666 has a downward arrowhead ridge 680 which is received by a snap connector cavity 682 of the splash guard extrusion 654.

Figure 36:
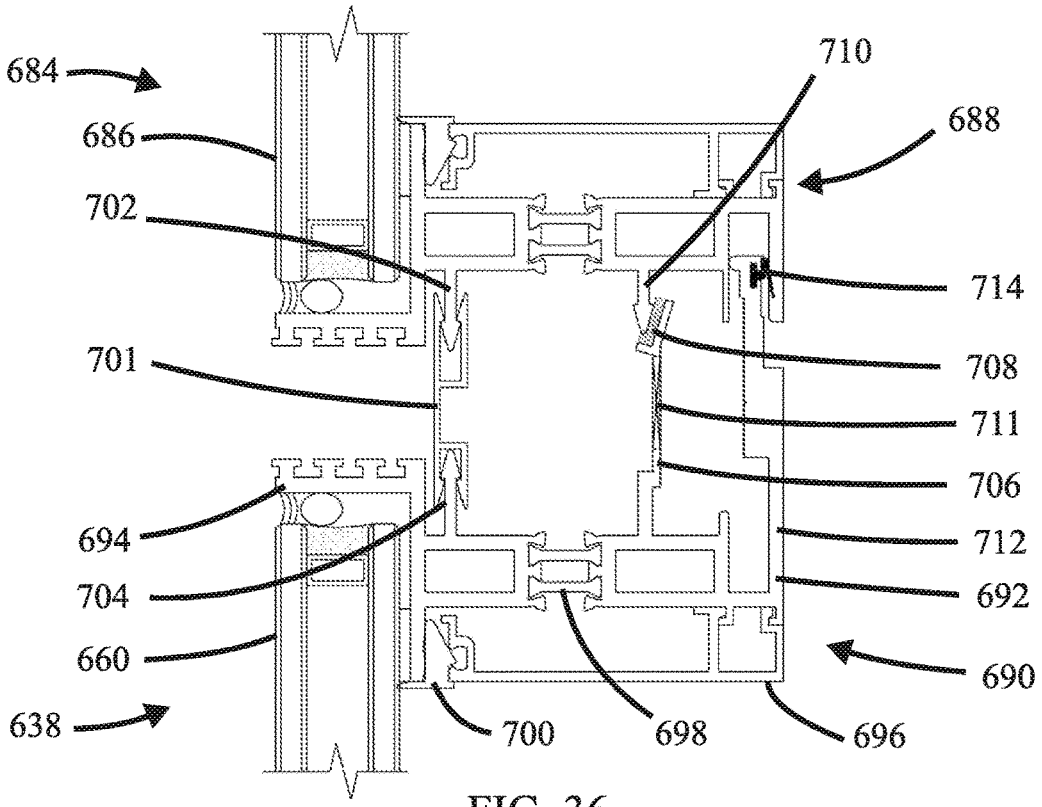
FIG. 36 is a schematic cross-sectional view taken at cutting plane 36-36 in FIG. 34.

FIG. 36 is a schematic cross-sectional view taken at cutting plane 36-36 in FIG. 34 showing the horizontal junction of the first glass panel 638 with a second glass panel 684. The second glass panel 684 comprises a glass inset 686 and a bottom horizontal frame member 688 which is configured the same as the bottom horizontal frame member 662 described with regard to FIG. 35. The first glass panel 638 comprises the glass inset 660 and a top horizontal frame member 690. The top horizontal frame member 690 comprises a panel head member 692, an outward member 694, and a glazing bead 696. The panel head member 692 is connected to the outward member 694 by a pair of insulating connectors, e.g. the insulating connector 698. The glazing bead 696 is snap connected to the panel head member 692 and compresses a sponge seal 700 against in inward face of the outward member 694 to form a seal. A rain deflector strip 701 is snap connected between the arrowhead ridges 702, 704, which protrude from the bottom horizontal frame member 688 and the top horizontal frame member 690, respectively. The panel head member 692 has a vertical arm 706 which carries an elastomeric strip 708 which presses against the inward side of an arrowhead ridge 710 of the bottom horizontal frame member 688 to form an air seal. The vertical arm has a series of holes, e.g. hole 711, which may be plugged with a solid grommet after the installation of the first and second glass panels 638, 684. Finally, an inward vertical member 712 of the panel head member 692 carries a flanged bottom seal 714 which presses against an outward face of the bottom horizontal frame member 688 to form a seal.

FIG. 37A is a schematic cross-sectional view taken at cutting plane 37A-37A in FIG. 34 and shows a portion of the parapet 716 of the curtain wall 610. The cutting plane 37A-37A is located just to the right of where the vertical frame member of the third glass panel 718 begins. The cross-sectional view in FIG. 37A shows the location of some of the components of the third parametric mullion stack 620 which are located just to the left of the cutting plane. Many of the features of the parapet 716 are the same as those of the parapet 542 that was described with reference to FIG. 28. The third glass panel 718 is screw-attached (in a location not visible in the drawing) to the third parametric mullion stack 620.

Figure 37B:
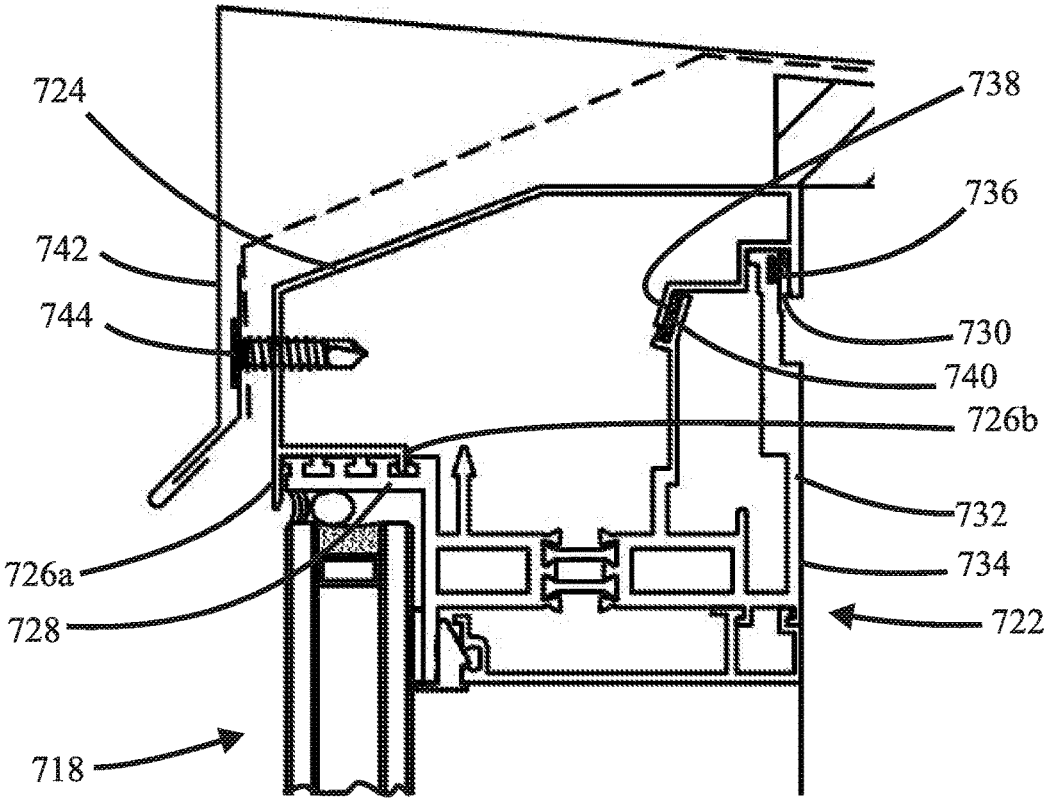
FIG. 37B is a closer view of the area contained within the dashed-line box shown in FIG. 37A.

FIG. 37B provides a closer view of the area contained within the dashed-line box 720 shown in FIG. 37A. Note that the top horizontal frame member 722 of the third glass panel 718 is the same as the top horizontal frame member 690 of the first glass panel 638 which is discussed above with reference to FIG. 36. A parapet cap extrusion 724 snap connects to the top horizontal frame member 722. Two lower fingers 726*a*, 726*b* of the parapet cap extrusion 724 engage the outward member 728 of the horizontal frame member 722. A channel 730 of the parapet cap extrusion 724 captures a vertical ridge 732 of the inward member 734 of the horizontal frame member 722 and sealingly presses against the flanged base seal 736 carried by the vertical ridge 732. An inward facing surface 738 of the parapet top extrusion 724 sealingly engages a elastomeric strip 740 carried by the inward member 734. A parapet top flashing 742 is attached to the parapet top extrusion 724 by a screw 744.

Vertical junctions of the curtain wall 610 will now be discussed. It is be understood that the discussion in the previous section regarding cross-cut views of junctions having pinned connections applies also to this section.

Figure 38:
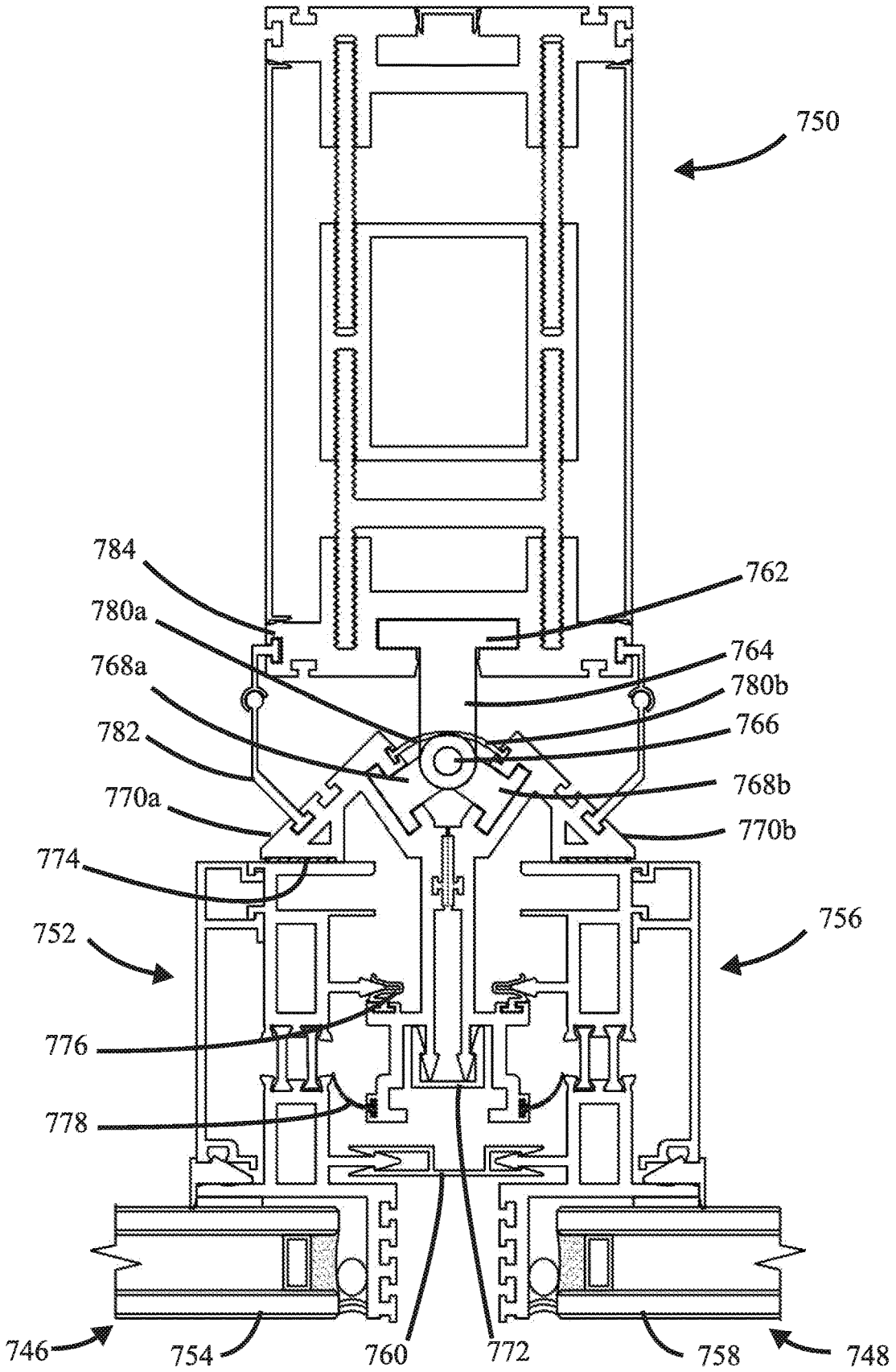
FIG. 38 is a schematic cross-cut view of taken at cutting plane 38-38 in FIG. 34.

FIG. 38 is a schematic cross-cut view taken at cutting plane 38-38 in FIG. 34 and shows the vertical junction of the fourth glass panel 746 with a fifth glass panel 748 and a parametric mullion 750 of the sixth parametric mullion stack 626. Note that the fourth and fifth glass panels 746, 748 are coplanar with one another. The fourth glass panel 746 comprises a right vertical frame member 752 and a glass inset 754. The fifth glass panel 748 comprises a left vertical frame member 756 and a glass inset 758. The left vertical frame member 756 is the same as the bottom horizontal frame member 688 discussed with respect to FIG. 36 and the right vertical frame member 752 is the mirror image of the left vertical frame member 756. A rain deflector strip 760 is connected between the left and right vertical frame members 756, 752.

The parametric mullion 750 is the same as the parametric mullion 456 shown in FIG. 23A. Connected to the parametric mullion 750 is a T-bar connector 762 which, except for the length of its outwardly extending portion 764, is the same as the T-bar connector 462 shown in FIG. 23A. The T-bar connector 762 is connected by a pin 766 to left and right rotatable connectors 768*a*, 768*b*, which are connected, respectively to left and right catchment extension beams 770*a*, 770*b*. The left and right catchment extension beams 770*a*, 770*b* are optionally interconnected near their outward ends by an end cover 772. The left and right catchment extension beams 770*a*, 770*b* are mirror images of one another, so, for brevity, only the right catchment extension beam 770*a* will be discussed further. The right catchment extension beam 770*a* carries four seals of which three, i.e. a strip seal 774, a gasket seal 776, and a wiper seal 778, sealingly engage portions of the left vertical frame member 758. The fourth seal, a wiper seal 780*b*, extends in the vertical space between T-bar connectors to engage its counterpart, wiper seal 780*a*, which is carried by the left catchment extension beam 770*a*.

Optionally, covers, e.g. the cover 782, are attached between the catchment beam 784 of the parametric mullion 750 and each of the left and right catchment extension beams 770*a*, 77*b* in the manner described with regard to the cover 446 with regard to FIG. 22.

FIG. 39 is a schematic cross-cut view of taken approximately at cutting plane 39-39 in FIG. 34 and shows the vertical junction of the sixth glass panel 786 with a seventh glass panel 788 and a parametric mullion 790 of the fourth parametric mullion stack 622. Note that the sixth and seventh glass panels 786, 788 are disposed at an internal angle of ⅔ π radians (120 degrees) with one another, but are representative of glass panels meeting at internal angles of from η/2 radians (90 degrees) to π radians (180 degrees). Such joints are sometimes referred to as inside corner angle junctions. The sixth and seventh glass panels 786, 788 comprise, respectively, right and left vertical frame members 792, 794 and glass insets 796, 798. The left and right frame members 792, 794 are the same as the left and right vertical frame members 752, 756 described with reference to FIG. 38. The parametric mullion 790, the inside corner T-bar connector 800, the pins 802*a*, 802*b*, the rotatable connectors 804*a*, 804*b*, the rain deflector 806, the air seal 808, and the inward covers 810*a*, 810*b* have their counterparts in the junction that is discussed with reference to FIG. 22. Likewise, the left and right catchment beams 812*a*, 812*b* and the outward cover 814 all have their counterparts in the junction which is discussed with reference to FIG. 38.

FIG. 40 is a schematic cross-cut view taken approximately at cutting plane 40-40 in FIG. 34 and shows the vertical junction of an eighth glass panel 816 with a ninth glass panel 818 and a parametric mullion 820 of the second parametric mullion stack 618. Note that the eighth and ninth glass panels 816, 818 are disposed at an external angle of ⅔π radians (120 degrees) with one another, but are representative of glass panels meeting at external angles of from π/2 radians (90 degrees) to π radians (180 degrees). Nearly all of the components and elements of this junction have their counterparts in the internal angle junction described with regard to FIG. 39. The exception is that the dual rotary connection inside angle T-bar connector 800 of FIG. 39 is replaced in FIG. 40 with a single rotary connection outside T-bar connector 822 so that the rotatable connectors 824*a*, 824*b* are connected together with a single pin 826 to the T-bar connector 822.

So far all of the panels discussed in this section on curtain wall embodiments have been glass panels. It is to be understood, however, that the present invention includes within its scope curtain walls that include one or more spandrel panels and as well as curtain walls for which the only type of panel used is a spandrel panel. The incorporation of spandrel panels into such curtain walls is very similar to the incorporation of glass panels as has been already described above. Instead of a glass panel having a glass pane inset in a frame, a spandrel panel has a spandrel inset in a frame. The spandrel panel frame is substantially the same as that of the glass panel, with allowances made for any differences in geometry and weight there may be of spandrel inset versus the glass inset. Note that in some embodiments, the inward-facing cover of a spandrel inset is constructed so as to be suitable as a wall material for the space in the building which the spandrel panel in part closes off, thus obviating the need for the installation thereat of other wall materials, e.g. drywall. A few exemplary embodiments which include spandrel panels will now be discussed.

FIG. 41 is a schematic cross-cut view of the horizontal junction of a first spandrel panel 828, a second spandrel panel 830, and a parametric mullion 832. The first and second spandrel panels 828, 830 are coplanar with one another. This spandrel-parametric mullion junction is analogous to the glass panel-parametric mullion junction discussed with reference to FIG. 38. The first and second spandrel panels 828, 830 comprise, respectively, first and second spandrel insets 834, 836 and right and left vertical frame members 838, 840. Each of the spandrel insets 834, 836 has an outward shell, e.g. the outward shell 842 of first spandrel inset 834, an inward shell, e.g. the inward shell 844 of first spandrel inset 834, and spray foam insulation disposed between the inner and outward shells, e.g. the spray foam insulation 846 of the first spandrel inset 834. Note that the right and left vertical members 838, 840 are the same as their counterparts in FIG. 38 except they do not include glazing beads and their inward and outward members, e.g. the inward and outward members 848, 850 of the right vertical frame member 838, are adapted to account for this omission.

FIG. 42 is a schematic side view, partly in cross-section, of a spandrel panel 852 connected to an upper glass panel 854 and a lower glass panel 856 in a manner meant to render the building frame in the vicinity of the deck 858 invisible from a person viewing the outward facade of the curtain wall to which the panels 852, 854, 856 belong. The spandrel insert 860 of the spandrel panel 852 is the same as the first and second spandrel insets 834, 836 described with regard to FIG. 41. The bottom and top horizontal frame members 862, 864 of the spandrel panel 852 are configured the same as are the left and right vertical members 838, 840 shown in FIG. 41. The top horizontal frame member 866 of the lower glass panel 854 is the same as the top horizontal frame member 690 described with regard to FIG. 36 and the bottom horizontal frame member 868 is configured as the mirror image of the top horizontal frame member 866. The lower and upper glass panels 854, 856 are attached, respectively, to the lower and upper parametric mullions 870, 872 of the parametric mullion stack 874.

FIG. 43A is a schematic side view, partly in cross-section, showing a portion of a parapet 876 of a curtain wall which has, at this location, a spandrel panel 878 as its uppermost panel. All of the components and features of the parapet 876 have counterparts in the parapet 620 as discussed with reference to FIGS. 37A and 37B. FIG. 43B provides a closer view of the area contained within the dashed-line box 880 shown in FIG. 43A. The top horizontal frame member 882 of the spandrel panel 878 is the same as the top horizontal frame member 864 described with regard to FIG. 42 and the parapet cap extrusion 884 is the same as the parapet cap extrusion 724 described with regard to FIG. 37B. The top horizontal frame member 882 interconnects with and seals against the parapet cap extrusion 884 in the manner described for the corresponding components and elements as described in FIG. 37B.

It is to be understood that, in embodiments, the horizontal and vertical members of the frames of the glass panels and spandrel panels preferably have the mitered junctions as described for the glass panels of the insulated metal panel walls in reference to FIG. 20.

Ornamental Features

The present invention also comprises ornamental features for insulated metal panel walls and curtain walls, insulated metal panel walls and curtain walls having one or more of such ornamental features, and buildings having such ornamental features. The inventive ornamental features comprise connectors which interconnect to optional features of the panel frames of the curtain wall so that the features are directly supported by one or more panel frames and/or parametric mullions of the insulated metal panel wall or curtain wall of which the ornamental features becomes part.

The purpose of the ornamental features is to provide a designer with the ability to modify the appearance of the underlying facade to achieve a desired aesthetic effect. The ornamental features may remain in place permanently or may be added or removed at will, e.g. as seasonal or occasional decorations.

Refer again to the curtain walled building 608 shown in FIG. 33. The curtain wall 610 of the building 608 includes inventive ornamental features in the form of ornamental panel frames, e.g. a first ornamental panel frame 886, and ornamental attachment points, e.g. a first ornamental attachment point 888. As suggested by the curtain wall 610, these ornamental features can be arranged in any desired fashion. For example, the ornamental panel frames may be provided for every panel of a facade or may be arranged in patterns in continuous or intermittent fashion, e.g. the intermittent column 890 of which the first ornamental panel frame 886 is a part and the staggered column 892 of which a second ornamental panel frame 894 is a part. The ornamental attachment points can be arranged randomly, side-by-side, e.g. as with first and second ornamental attachment points 888, 896, staggered vertically, e.g. as with second and third ornamental attachment points 896, 898, or any other desired manner.

An embodiment of an ornamental panel frame will now be discussed with reference to FIGS. 44 and 45. FIG. 44 is a schematic cross-sectional view of the vertical junction of lower and upper glass panels 900, 902 of a curtain wall. The components and elements of the lower and upper glass panels 900, 902 have their counterparts, respectively, in the first and second glass panels 638, 684 as described with reference to FIG. 36. A bottom horizontal ornamental frame member 904 is attached to the upper glass panel 902 and a top horizontal ornamental frame member 906 is attached to the lower glass panel 900. In this instance, the bottom horizontal ornamental frame member 904 is a mirror image of the top horizontal ornamental frame member 906, so only the bottom horizontal ornamental frame member 904 will be discussed. The bottom horizontal ornamental frame member 904 comprises an outward member 908 and an inward connector 910. The outward member 908 has a ridged cavity 912 for receiving a snap connector ridges, e.g. the snap ridge 914, of the inward connector 910. Screws, e.g. the screw 916, prevent the outward member 908 and inward connector 910 from sliding laterally with respect to one another. The inward connector 910 has at least one flange, e.g. the flange 918, captured within flange receiving cavities of the horizontal frame member 920 of the upper glass panel 902. The outward member 908 also includes a molding member 922 that covers a portion of the glass inset 924 of the upper glass panel 902.

FIG. 45 is a schematic cut-away view of the horizontal junction of left and right glass panels 926, 928 and a parametric mullion 930 of a curtain wall. All of the components and features displayed in FIG. 45 have their counterparts in FIG. 38 except for the right and left vertical ornamental frame members 932, 934. The right and left vertical ornamental frame members 932, 934, respectively, are configured the same as the bottom and top horizontal ornamental frame members 904, 906 described with reference to FIG. 44. Note that the left and right vertical ornamental frame members 932, 934 connect, respectively, with the right and left vertical frame members 936, 938 of, respectively, the left and right glass panels 926, 928 in the same manner as do the bottom and top horizontal ornamental frame members 904, 906 with, respectively, the upper and lower glass panels 900, 902 of FIG. 44.

FIG. 46 is a schematic cut-away view of the horizontal junction of an ornamental attachment point 940, left and right glass panels 942, 944, and a parametric mullion 946 of a curtain wall. All of the components and features displayed in FIG. 46 have their counterparts in FIG. 38 except for the ornamental attachment point 940. The ornamental attachment point 940 has an outward member 948 and a flanged base 950. The flanged base 950 is received by the flange channel 952 cooperatively formed by left and right extension beams 954*a*, 954*b* which are connected to the parametric mullion 946 via the left and right rotatable extensions 956*a*, 956*b*, the pin 958, and the T-bar connector 960. A permanent or removable fastener or stop (not visible in FIG. 46) maintains the flanged base 950 vertically in place with respect to the flange channel 952. The outward member 948 may have openings or other connection features adapted to connecting to banners, flags, ligatures, etc. which are desired to be supported by the ornamental attachment point 940. The lateral faces of the outward member 948 may be adorned as desired, e.g. single or multiple colors, letters, symbols, etc.

The embodiments of ornamental features discussed above are only exemplary. For example, the shapes of the ornamental panel frames and of the ornamental attachment points may be altered as desired to have any shape. The individual members of the ornamental panel frames may have any profile, e.g. slope, ogee, round, etc. An ornamental panel frame need not fully frame any particular panel and can be used to spell out a word or message. In some embodiments, the ornamental panel frames components form a frame or other ornamental design around a multitude of panels. In some embodiments, the ornamental panel frame components partially or completely cover one or more panels. In some embodiments, ornamental panel frame components comprise connectors to which other decorations can be added, e.g. flags and banners.

The ornamental attachment points can have any desired shape and are examples of embodiments of ornamental features that protrude outwardly from the facade. The ornamental attachment points may be used to support other items, e.g. flags and banners, or may themselves be adorned with designs and messages.

Moreover, it is also to be understood that the ornamental panel frames and the ornamental attachment points are only two examples of the many different kinds of ornamental features that are within the scope of the present invention as this aspect of the invention lies within the concept of ornamental features comprising connectors which interconnect to corresponding features of a panel frame and/or a parametric mullion.

Curved Insulated Metal Panel Walls and Curtain Walls

Through the inclusion of one or more of the inside or outside angle junctions described above, the present invention includes embodiments of insulated metal panel walls and curtain walls which curve horizontally as well as buildings having such curved curtain walls. The present invention also includes embodiments in which the insulated metal panel wall or curtain wall curve vertically through the use of one or more vertical inside or outside junctions in combination with parametric mullions which are adapted to accommodate such junctions. The present invention also includes buildings having such vertically curving walls. Additionally, the present invention includes embodiments in which the insulated metal panel or curtain wall curves both vertically and horizontally and buildings having such walls. Insulated metal panel walls and curtain walls having curves in both the vertical and horizontal directions are referred to herein as "multi-directionally curved walls." Embodiments of multi-directionally curved walls will now be described. It is to be understood that although for brevity's sake only curtain wall embodiments are described below, the designs presented in those embodiments can be readily applied to insulated metal panel walls.

Figure 47:
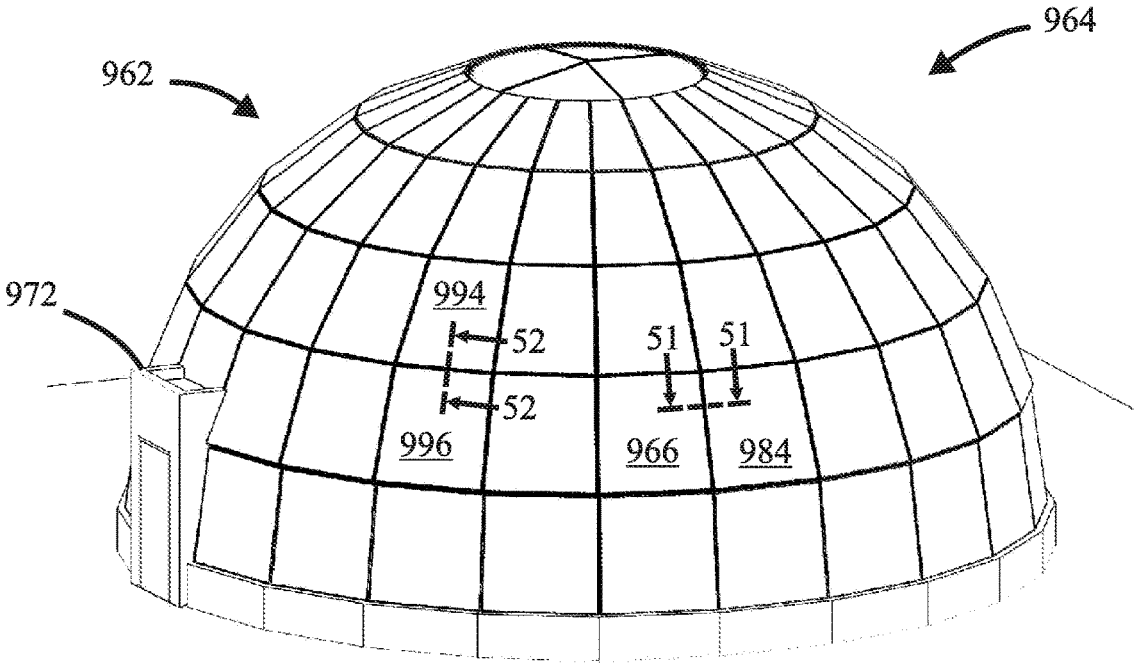
FIG. 47 is a schematic perspective view of a curtain wall in the form of a dome for a small domed building.

FIG. 47 is a schematic perspective view of a curtain wall 962 in the form of a dome for a small domed building 964. The curtain wall 962 comprises a plurality of glass panels, e.g. a first glass panel 966, each of which forms both horizontal and vertical outside angle junctions with each of its neighboring glass panels.

Figure 48:
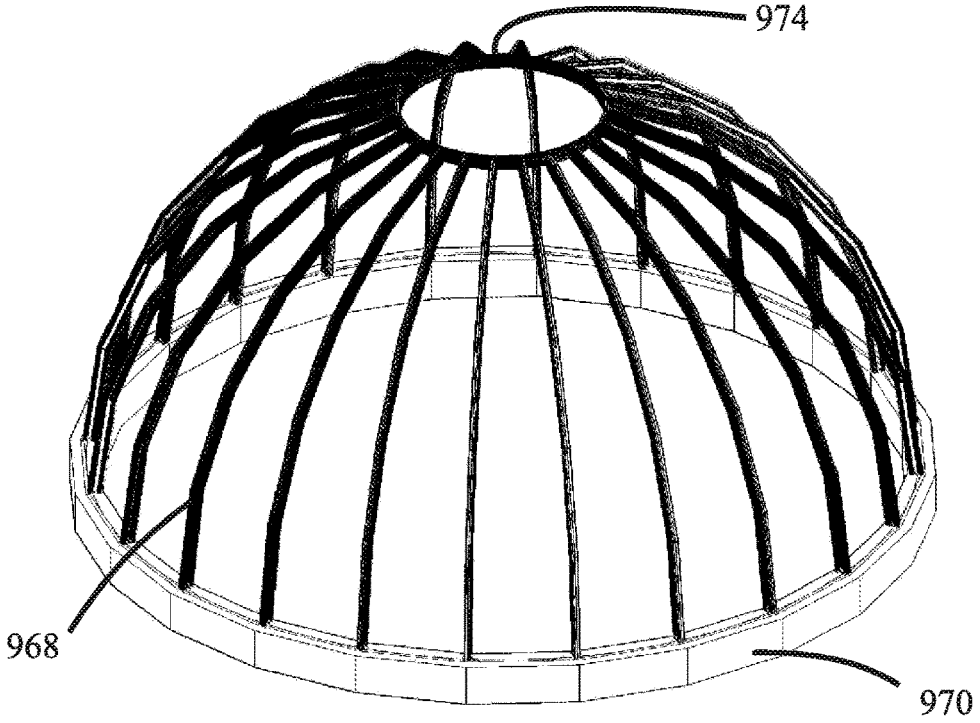
FIG. 48 is a schematic perspective view of the plurality of parametric mullion stacks that are comprised by the curtain wall of FIG. 47 and the foundation to which each of the parametric mullion stacks is anchored.

FIG. 48 is a schematic perspective view of the plurality of parametric mullion stacks, e.g. the parametric mullion stack 968, that are comprised by the curtain wall 962 and the foundation 970 to which each of the parametric mullion stacks is anchored. Note that for simplicity sake, the door build-out structure 972 shown in FIG. 47 has been omitted from FIG. 48. Although multi-directionally curved curtain walls may be used with multi-deck building frames comprising conventional components, the small domed building 964 is a single level building that has no frame beside that proved by the parametric mullion stacks of the curtain wall 962 in combination with the structural top ring 974.

Figure 13:
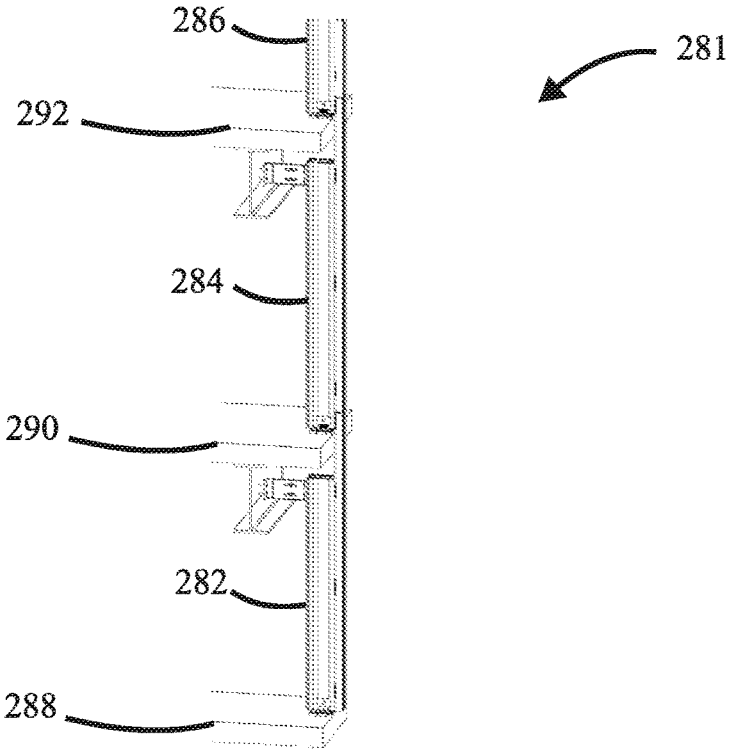
FIG. 13 is a schematic perspective view of a portion of a parametric mullion stack showing three spliced together parametric mullions mounted, respectively on the ground, second and third floors of a building.
Figure 49:
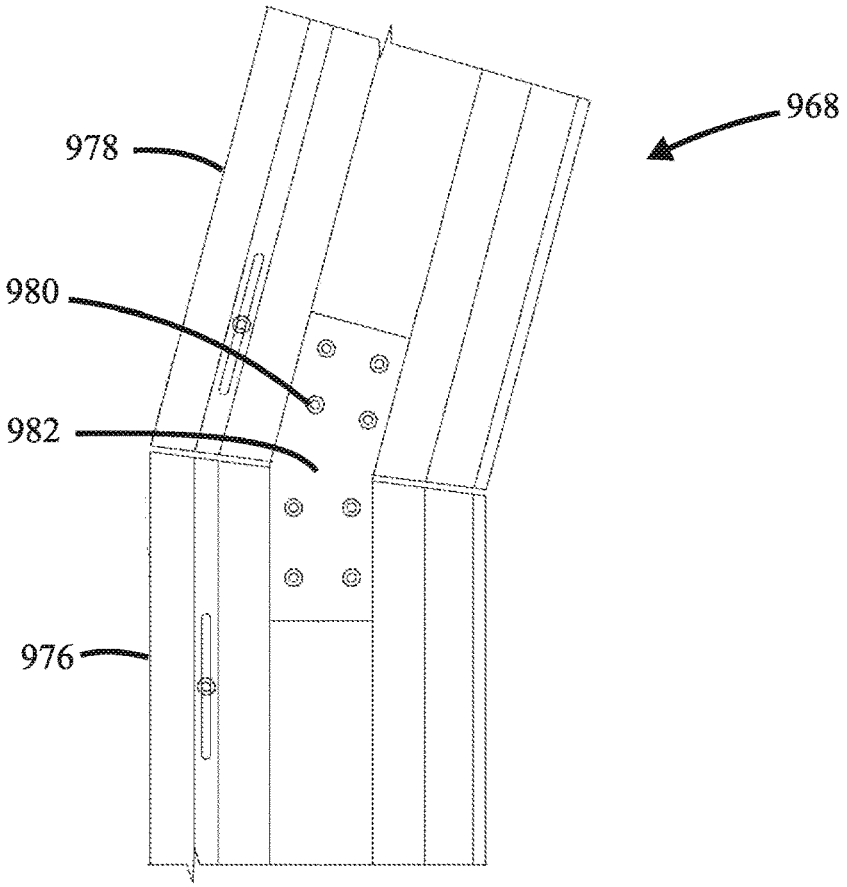
FIG. 49 is a schematic side view of a parametric mullion stack showing the junctions of a lower parametric mullion and an upper parametric mullion.

Unlike the parametric mullion stacks described above, e.g. the parametric mullion stack 281 described with respect to FIG. 13, the parametric mullions of the parametric mullion stacks shown in FIG. 48 are not connected to a building frame and are not disposed strictly vertically. Instead, the parametric mullions of the stacks shown in FIG. 48 are connected together at junctions in which one parametric mullion is disposed at an angle to the parametric mullion to which it is connected. FIG. 49 is a schematic side view of the parametric mullion stack 968 showing the junctions of a lower parametric mullion 976 and an upper parametric mullion 978. The lower and upper parametric mullions 976, 978 are structurally fixed in relation to one another by a plurality of bolts, e.g. the bolt 980, and a pair of parallel splice or gusset plates, of which only splice plate 982 is visible. Optional side covers have been omitted from the lower and upper parametric mullions 976, 978 in order to illustrate the splice plate 982 and the plurality of bolts.

FIG. 50 is a schematic side perspective view showing the anchoring of the lower parametric mullion 976 of the parametric mullion stack 968 to the foundation 970. The optional side covers of the lower parametric mullion 976 have been omitted from FIG. 50 so as to better show the anchor configuration, which is the same as that discussed with reference to FIG. 6A except for the tilt of the parametric mullion 976 from the vertical.

FIG. 51 is a schematic cross-cut view taken at cutting plane 51-51 in FIG. 47 and shows the junction of the first glass panel 966 with a second glass panel 984 and a parametric mullion 986 of the curtain wall 962. It is to be noted that the junctions between the horizontally adjacent panels of the curtain wall 962 are similar to the outside corner junctions described above with reference to FIG. 40 as is evident by comparing FIG. 40 to FIG. 51. Only the configurations of the outward cover 988, the rain deflector 990, and the inward covers, e.g. the inward cover 992, shown in FIG. 51 differ from their counterparts that are shown in FIG. 40.

FIG. 52 is a schematic cross-sectional view taken at the cutting plane 52-52 in FIG. 47 and shows the junction between a third glass panel 994 and a fourth glass panel 996 of the curtain wall 962. The components and features of the third and fourth glass panels 994, 996 are the same as those of the glass panels described with regard to FIG. 36 with three exceptions. The first is that the rain deflector strip 998 has been reconfigured to consist of first and second snap connectors 1000*a*, 1000*b* and a center strip 1002. The one end of the center strip 1002 is captured within a receiving groove of the first snap connector 1000*a* and the other end has a cylindrical ridge which is pivotably received into the arcuate receiving end of the second snap connector 1000*b*. The second exception is that the vertical arm 1004 of the inward member 1006 of the top horizontal frame member 1008 of the fourth glass panel 996 has been reconfigured to end in an arrowhead ridge which connects into a first snap connector end 1010*a* of the elastomeric strip seal 1012. A second snap connector end 1010*b* of the elastomeric strip seal 1012 connects with an arrowhead ridge 1014 of the inward member 1016 of the bottom horizontal frame member 1018 of the third glass panel 994. The third exception is that the inward vertical member 1020 of the inward member 1006 has been reconfigured to include a pivotable connection 1022.

Referring back to FIG. 48, it is seen that each of the parametric mullion stacks of the curtain wall 962 terminate at their upper ends at the structural top ring 974. The top ring 974 itself is formed of spliced-together parametric mullions. Refer now to FIG. 53, which is a schematic perspective view of the upper end of the parametric mullion stack 1024 terminating at the top ring 974. Visible in FIG. 53 are portions of two of the parametric mullions of the top ring 974, i.e. top ring first and second parametric mullions 1026, 1028. Each of the top ring first and second parametric mullions 1026, 1028 is connected to the end parametric mullion 1030 of the parametric mullion stack 1024 by bracket plates, e.g. the bracket plate 1032, which are held in place by a plurality of self-taping screws, e.g. the screw 1034.

FIG. 54 is a schematic cutaway view of the top of the portion of the domed curtain wall 962 taken along a cutting plane across its apex. Visible in FIG. 54 are the upper portions of a first parametric mullion stack 1036 and a second parametric mullion stack 1038 terminating against the top ring 974. Also visible is a plurality of glass panels, e.g. a fifth glass panel 1040. Note that the adjacent glass panels, e.g the fifth glass panel 1040 and a sixth glass panel 1042, are interconnected in the manner discussed with reference to FIG. 52.

By its nature, the domed curtain wall 962 involves only convex sections which utilize outside corner junctions between adjacent glass panels. Some embodiments of multi-directionally curved curtain walls have concave sections. The junctions between horizontally adjacent panels in such concave sections are configured in the manner described with reference to FIG. 39, i.e. with an inside corner angle junction. The junctions between vertically adjacent panels in such walls are configured as shown in FIG. 55.

FIG. 55 is a schematic cross-sectional view of an inside corner angle junction between a lower glass panel 1044 and an upper glass panel 1046. Note that the components and features of the lower and upper glass panels 1044, 1046 are the same as those of the glass panels described with regard to FIG. 36 with four exceptions. The first and second exceptions are that the rain deflector strip 1048 and the inward vertical member 1050 of the inward member 1052 of the top horizontal frame member 1054 of the lower glass panel 1044 have been reconfigured in the manner described with reference to FIG. 52. The third is that the vertical arm 1056 of the inward member 1052 does not have a hole in its midsection as does its counterpart in FIG. 36. The fourth is that a clip extension 1058 has been attached to the arrowhead ridge 1060 of the inward member 1062 of the bottom horizontal frame member 1064 of the upper glass panel 1046 so that it is the clip extension 1058, instead of the arrowhead ridge 1060 itself, that presses against the elastomeric strip 1066 that is carried by the vertical arm 1056 to form a seal.

Parametric Mullion Trusses

As is evident from the discussion the previous section on curved curtain walls, it is within the scope of the present invention to interconnect two or more of the inventive parametric mullions described herein with splice (gusset) plates and/or brackets to form a structural member or a structural frame. Such trusses may be used as part of a curtain or insulated panel wall or independently of such walls. Some such embodiments will now be described in which the parametric mullions are interconnected to form trusses.

Figure 56B:
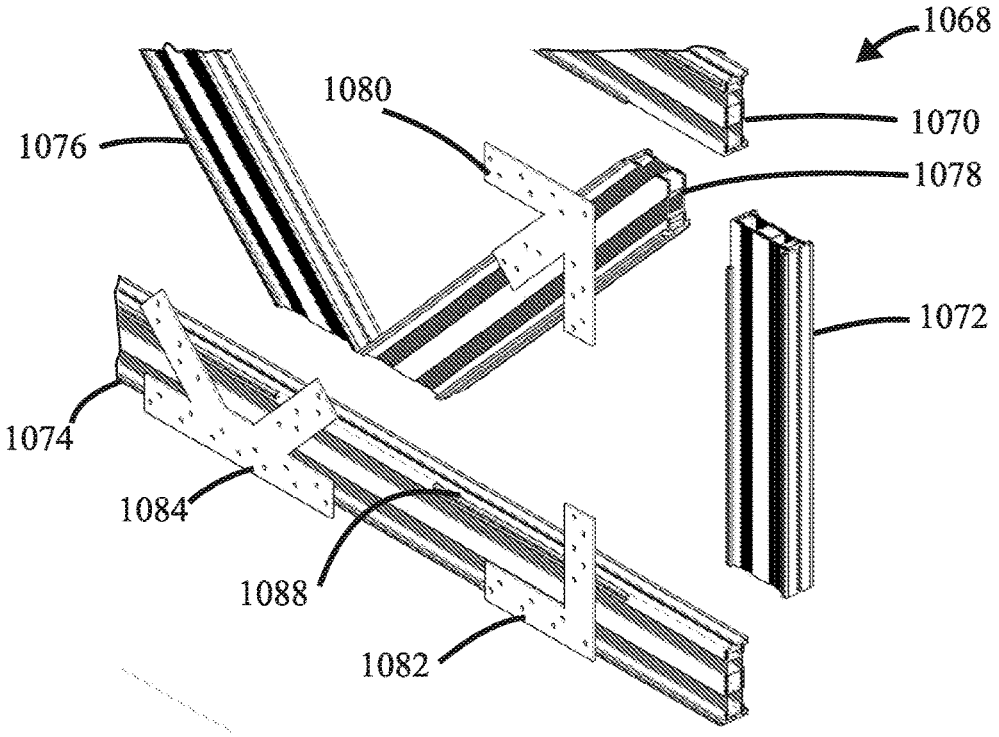
FIG. 56B is a schematic perspective exploded view of the truss 1068 showing greater detail of the first, second, third, fourth, and fifth parametric mullions of FIG. 56A.

FIG. 56A is a schematic side view of a portion of a truss 1068 which comprises a plurality of parametric mullions including first, second, third, fourth, and fifth parametric mullions 1070, 1072, 1074, 1076, 1078. These parametric mullions are interconnected by first, second, and third splice plates 1080, 1082, 1084. Although each of these splice plates is shown to have a plurality of holes, e.g. the hole 1086 in the second splice plate 1082, for receiving a bolt, screw, or rivet, it is also within the scope of the present invention for the splice plates to be welded to the parametric mullions. FIG. 56B is a schematic perspective exploded view of the truss 1068 showing greater detail of the first, second, third, fourth, and fifth parametric mullions 1070, 1072, 1074, 1076, 1078. Note that portions of the outer ridges of the parametric mullions, e.g. outer ridge 1088 of the third parametric mullion 1074, have been removed to allow faces of the splice plates to interface more fully against the sides of the parametric mullions.

Figure 57:
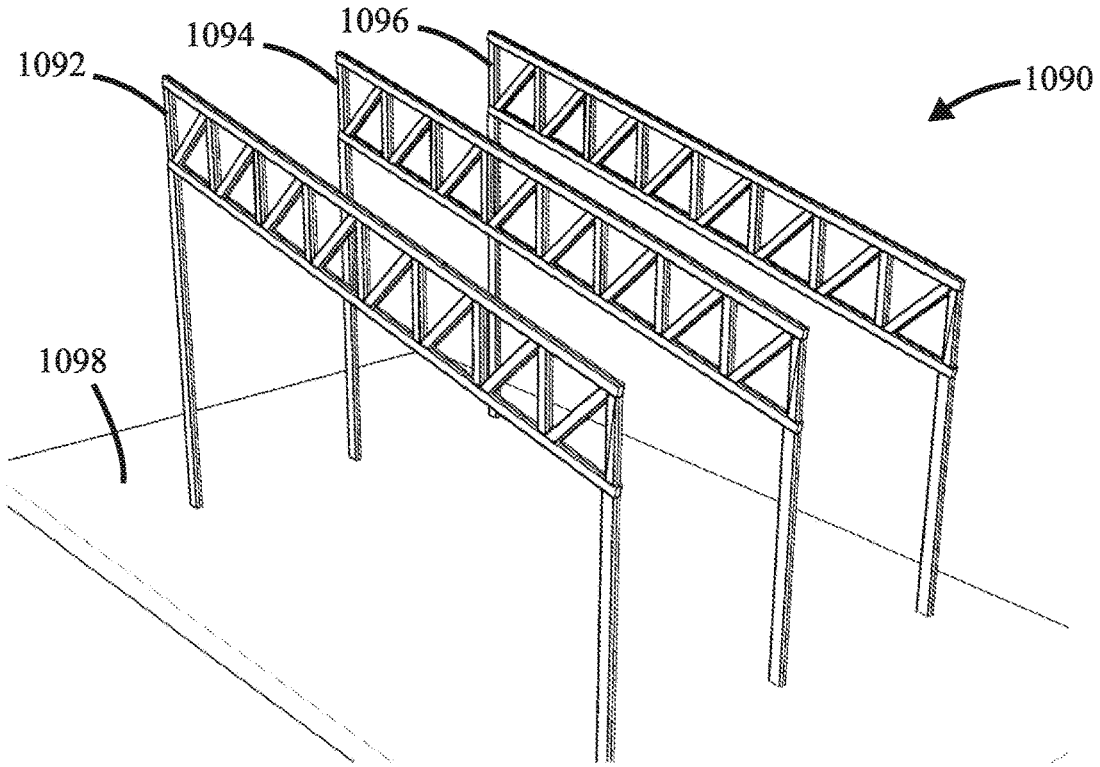
FIG. 57 is a schematic perspective view of a set of straight trusses anchored to a deck.
Figure 58:
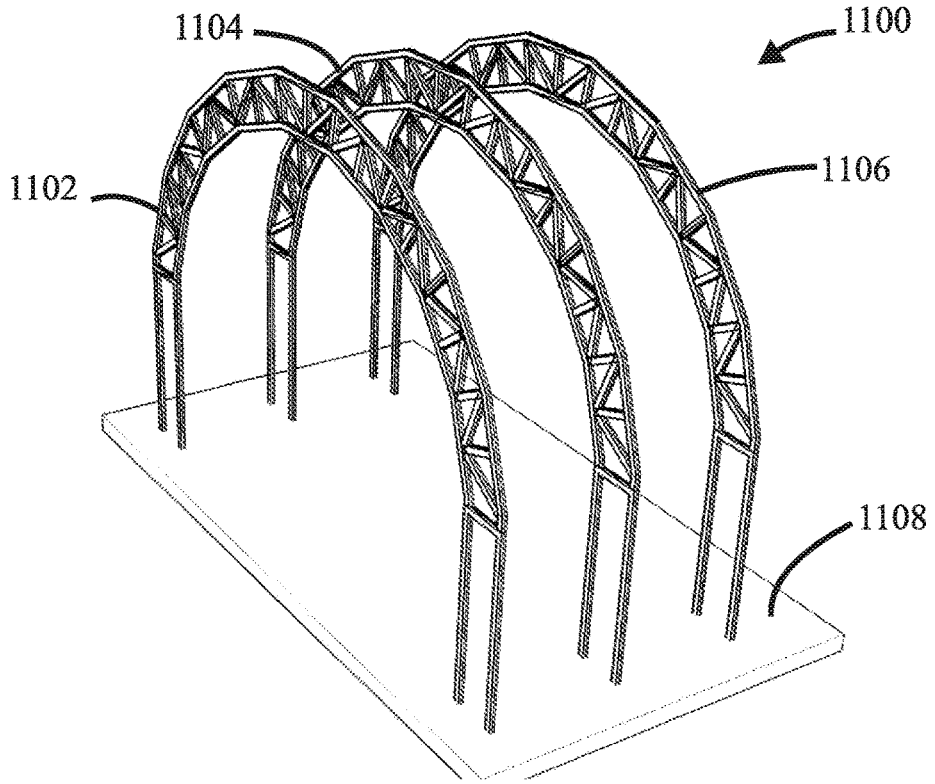
FIG. 58 is a schematic perspective view of a set arched trusses anchored to a deck.
Figure 59:
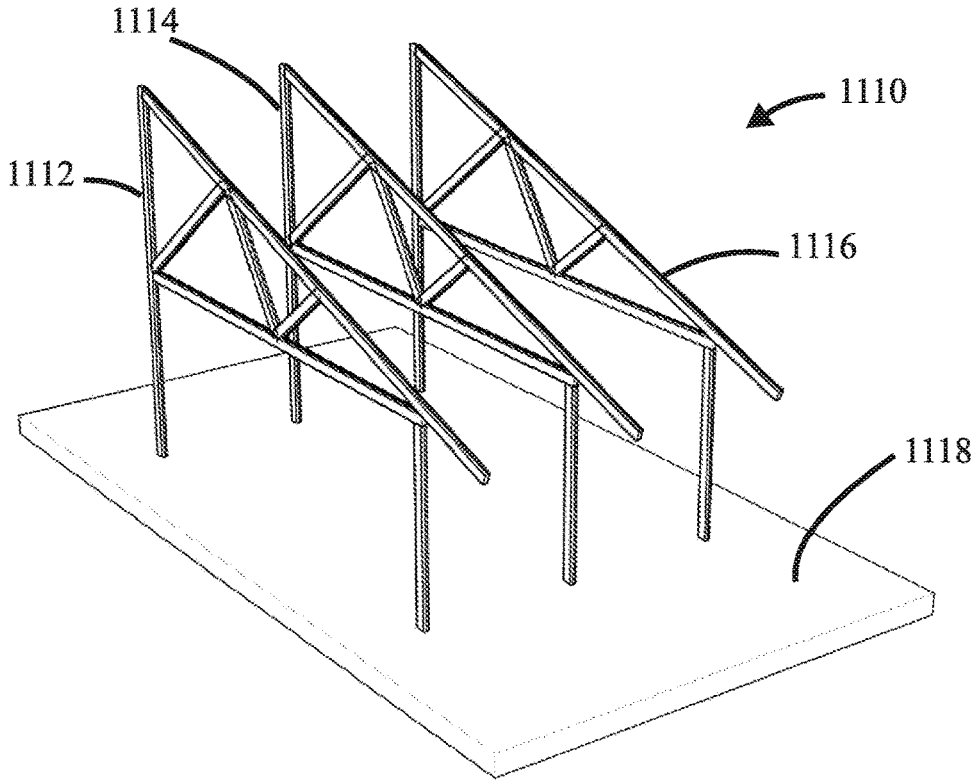
FIG. 59 is a schematic perspective view of a set of slanted trusses anchored to a deck.

Three exemplar embodiments of trusses are shown in FIGS. 57-59. For simplicity of presentation, the splice plates of the trusses are not shown in these drawing, although the presence of the splice plates, in the manner described with regard to FIGS. 56A-56B, is to be understood. In each of these drawings, three truss are shown parallel to one another, with each truss ending with one or two vertical parametric mullions which are anchored to a deck in the manner described in reference to FIGS. 6A-6B. It is to be understood that adjacent trusses shown in each of the drawings may be used to support and spatially fix one or more glass or spandrel panels to create, for example, a canopy. The glass or spandrel panels may be attached to the individual parametric mullions making up the trusses and to each other in the manner already described herein.

FIG. 57 is a schematic perspective view of a first set 1090 of first, second, and third straight trusses 1092, 1094, 1096 anchored to a first deck 1098. The first set 1090 may be used to form the supporting part of a flat-roof curtain wall canopy.

FIG. 58 is a schematic perspective view of a second set 1100 of first, second, and third arched trusses 1102, 1104, 1106 anchored to a second deck 1108. The second set 1100 may be used to form the support part of an arched curtain wall canopy.

FIG. 59 is a schematic perspective view of a third set 1110 of first, second, and third slanted trusses 1112, 1114, 1116 anchored to a third deck 1118. The third set 1110 may be used to form the support part of a slant-roof curtain wall canopy.

Dual Wall Systems

A. Dual Wall Systems Incorporating a Captured Air Space

Some embodiments of the present invention involve a dual wall system having an outward wall and an inward wall supported and spaced-apart by shared parametric mullions thus incorporating a space therebetween. An embodiment of such a dual wall system is illustrated in FIG. 60.

Figure 60:
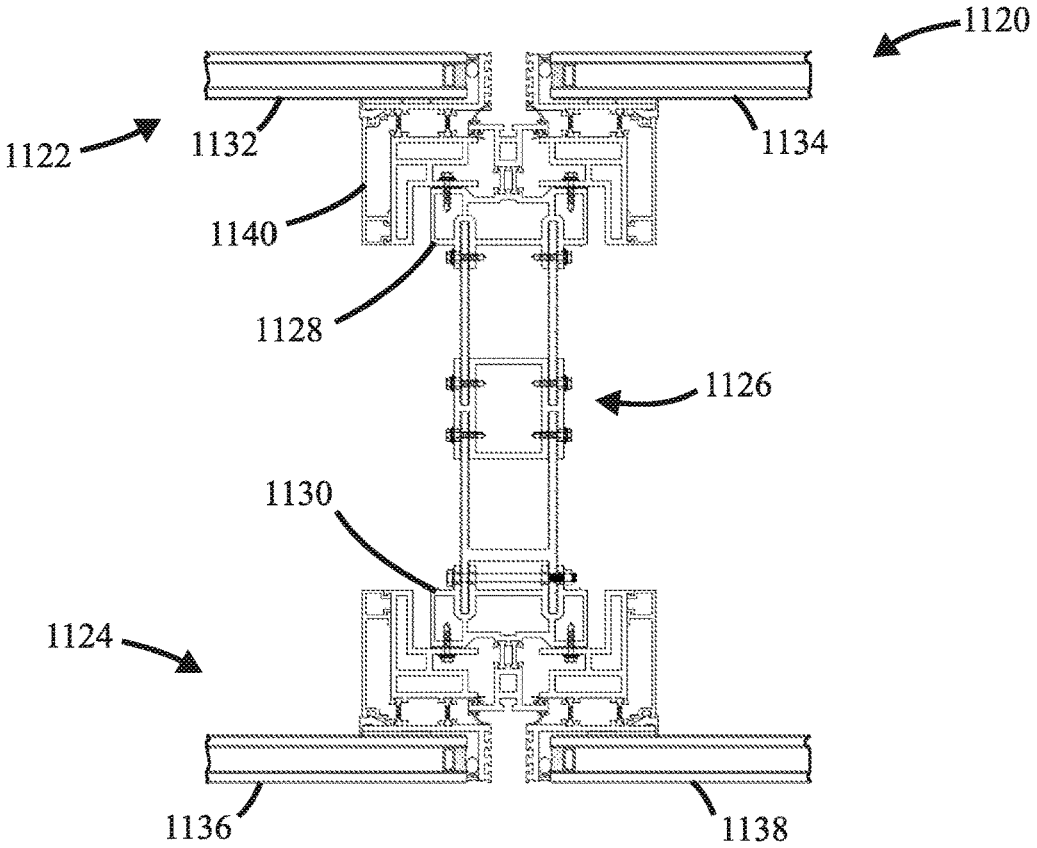
FIG. 60 is a schematic cross-section view taken along a horizontal cutting plane of a portion of an inventive first dual wall system.

FIG. 60 is a schematic cross-section view taken along a horizontal cutting plane of a portion of an inventive first dual wall system 1120. The first dual wall system 1120 comprises a first wall 1122, a second wall 1124, and a first parametric mullion 1126. The first parametric mullion 1126 is similar to the parametric mullion 72 shown in FIG. 9, except that in place of the double-T beam 82 of the parametric mullion 72, the first parametric mullion 1126 has a second catchment beam 1128 that is the same as its first catchment beam 1130. The first and second glass panels 1132, 1134 of the first wall 1122 and the third and fourth glass panels 1136, 1138 of the second wall 1122 have vertical frame members, e.g. the vertical frame member 1140 of first glass panel 1132, which are the same as the vertical frame members 474, 478 of FIG. 24. These vertical frame members of the first, second, third, and fourth glass panels 1132, 1134, 1136, 1138 are attached to the first parametric mullion 1126 in the same manner as the vertical frame members 474, 478 are attached in FIG. 24 to the vertical joint extrusion 480 in FIG. 24.

Figure 61:
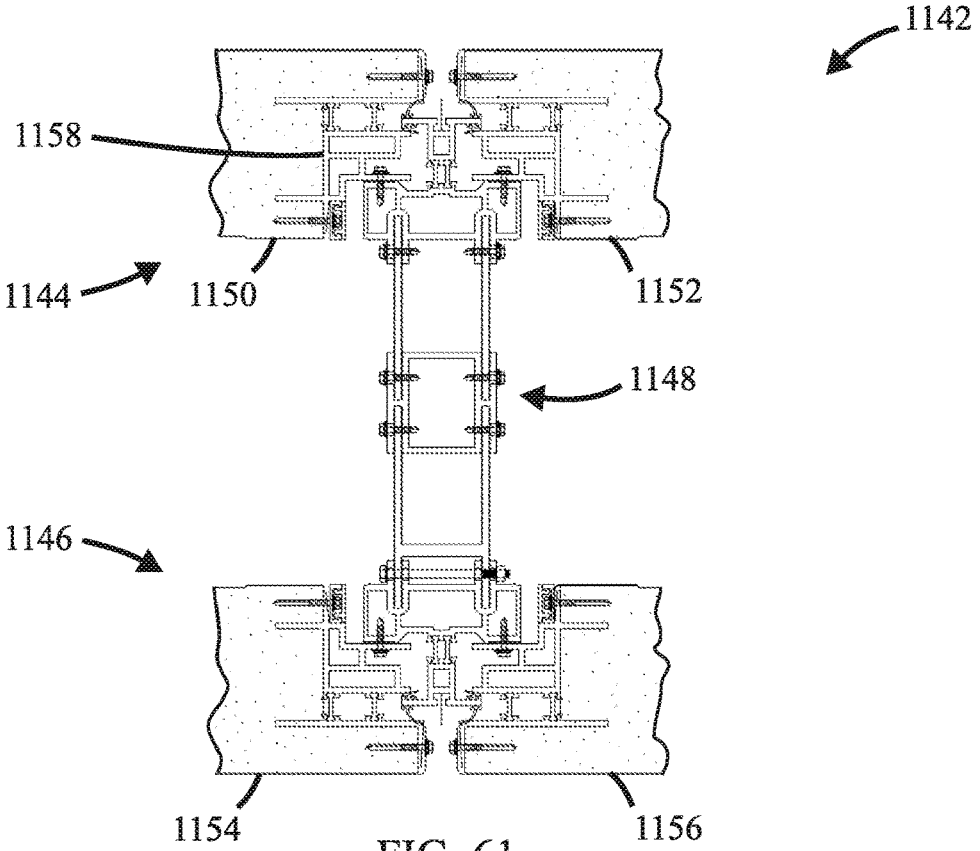
FIG. 61 is a schematic cross-section view taken along a horizontal cutting plane of a portion of an inventive second dual wall system.

Another embodiment of a dual wall system, i.e. second dual wall system 1142, is shown in FIG. 61. FIG. 61 is a schematic cross-section view taken along a horizontal cutting plane of a portion of the dual wall system 1142. The second dual wall system 1142 comprises a third wall 1144, a fourth wall 1146, and a second parametric mullion 1148. The second parametric mullion 1148 is the same as the first parametric mullion 1126 described in the immediately preceding paragraph. The third wall 1144 comprises first and second insulated metal panels 1150, 1152 and the fourth wall 1146 comprises third and fourth insulated metal panels 1154, 1156. The first, second, third, and fourth insulated metal panels 1150, 1152, 1154, 1156 all have vertical frame members, e.g. the vertical frame member 1158 of the first insulated metal panel 1150, which are the same as the vertical frame member, e.g. the first vertical frame member 330, of FIG. 18A. These vertical members of the first, second, third, and fourth insulation metal panels 1150, 1152, 1154, 1156 are attached to the second parametric mullion 1148 in the same manner as the vertical frame members are attached to the mullion 324 in FIG. 18A.

Although the two embodiments of dual wall systems described above include two wall of the same kind of panels, the present invention includes embodiments dual wall systems in which either wall can comprise any of the kinds of panels and panel wall systems, i.e. insulated metal panel wall systems, curtain wall systems, and mixtures thereof, described in this and the previous sections of this patent application.

B. Dual Wall Systems Comprising Solar Panels

The present invention also includes embodiments of dual wall systems which include one or more solar panels as part of one or both of the walls. The solar panels can be single face solar panels or bifacial solar panels. At least some of the wiring and other electronic components associated with the solar panels preferably are located within space captured between the two walls.

Figure 62:
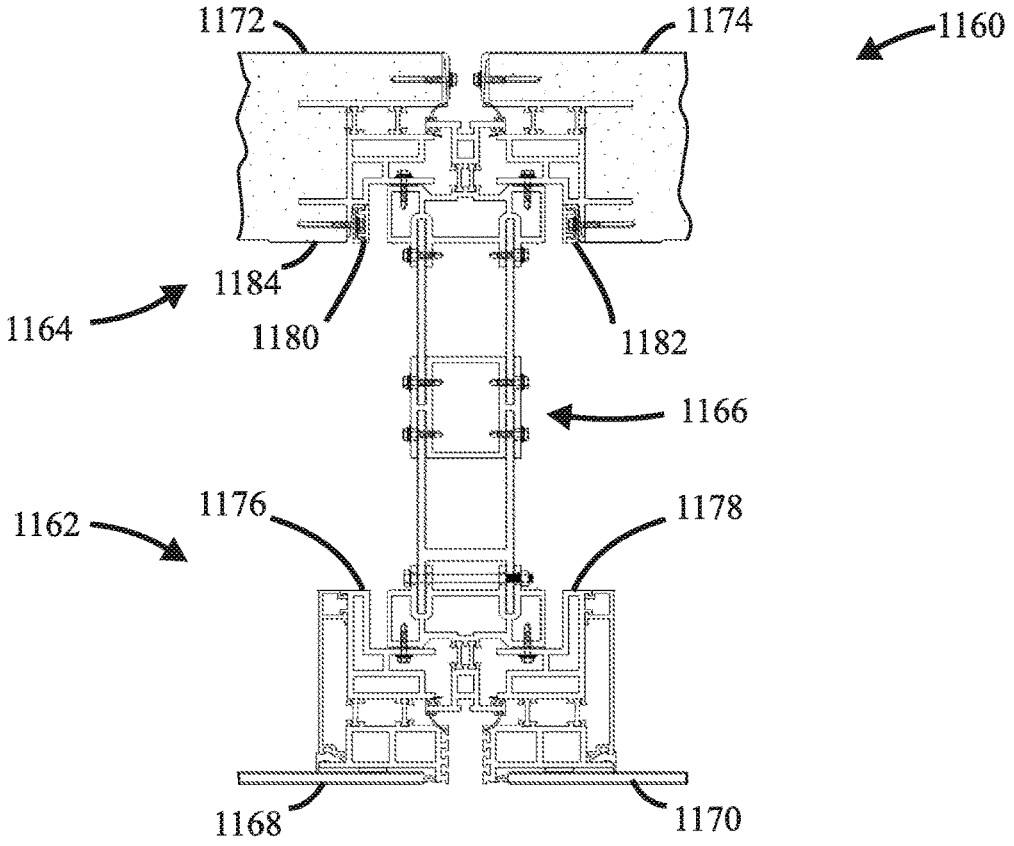
FIG. 62 is a schematic cross-section view taken along a horizontal cutting plane of a portion of an inventive third wall dual wall system.

FIG. 62 is a schematic cross-section view taken along a horizontal cutting plane of a portion of an inventive third wall dual wall system 1160. The third dual wall system 1160 includes an outward wall 1162, an inward wall 1164, and a third parametric mullion 1166. The outward wall 1162 includes at least two solar panels, i.e. first and second bi-facial solar panels 1168, 1170. The inward wall 1164 comprises at least two insulated metal panels, i.e. the fifth and sixth insulation metal panels 1172, 1174. The first and second bi-facial solar panels 1168, 1170 include first and second vertical frames 1176, 1178, which are the same as the vertical frames of the first and second glass panels 1128, 1130 described in relation to FIG. 60. The fifth and sixth insulation metal panels 1172, 1174 include third and fourth vertical metal frames 1180, 1182, which are the same as the vertical metal frames of the third and fourth insulated metal panels 1154, 1156 described in relation to FIG. 61. The third parametric mullion 1166 is the same as the first parametric mullion 1126 described in relation to FIG. 60. The vertical frames 1176, 1178, 1180, 1182 are attached to the third parametric mullion 1166 in the same way that their counterparts are attached to the first and second parametric mullions 1126, 1148 as described in relation to FIGS. 60 and 61.

Preferably, the outward faces of the fifth and sixth insulation metal panels 1172, 1174, e.g. the outward face 1184 of fifth insulation metal panel 1172 are imbued with a high gloss reflective surface so that solar rays which pass through the first and second bi-facial solar panels 1168, 1170 are reflected outward to illuminate the inward surfaces of those solar panels.

Figure 63:
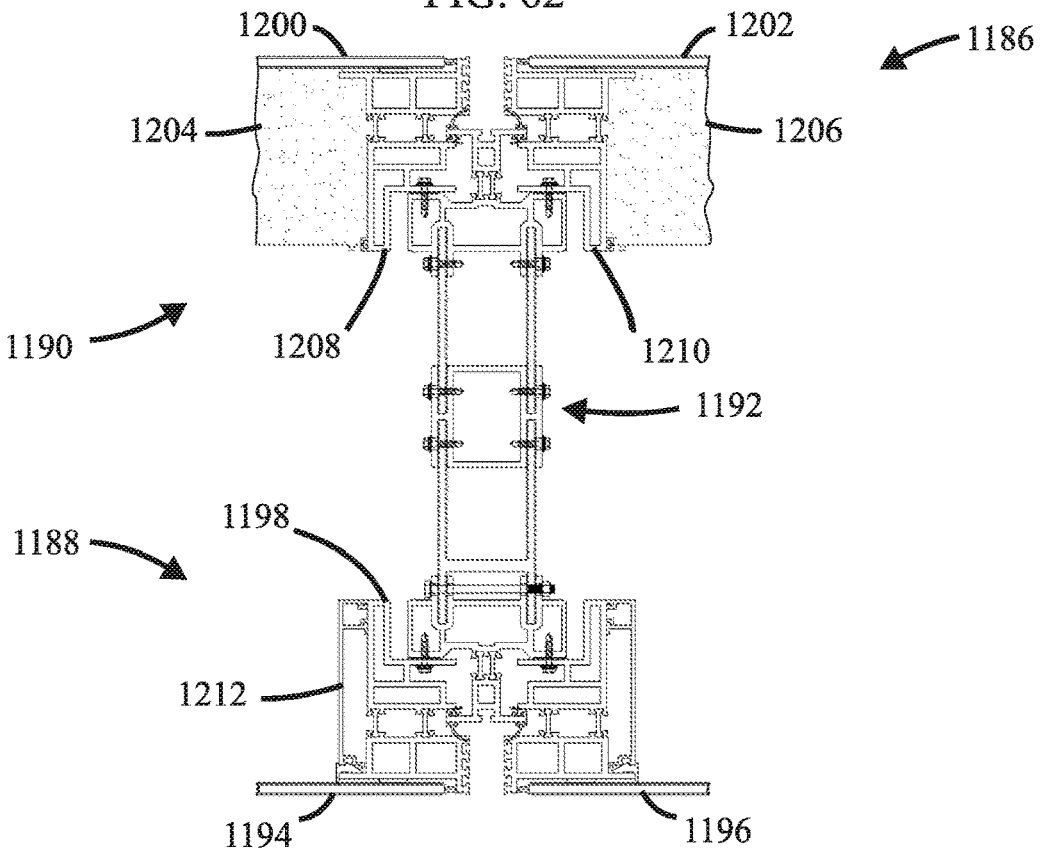
FIG. 63 is a schematic cross-section view taken along a horizontal cutting plane of a portion of an inventive fourth dual wall system The reference numerals used in the drawings are presented in Table 1 below.

Another embodiment of a dual wall system which includes one or more solar panels is shown in FIG. 63. FIG. 63 is a schematic cross-section view taken along a horizontal cutting plane of a portion of an inventive fourth dual wall system 1186. The fourth dual wall system 1186 includes an outward wall 1188, an inward wall 1190, and a fourth parametric mullion 1192. The fourth parametric mullion 1192 is the same as the first, second, and third parametric mullions described with regard to FIGS. 60-62. The outward wall 1188 includes at least two solar panels, i.e. third and fourth bi-facial solar panels 1194, 1196. The third and fourth bi-facial solar panels 1194, 1196 include vertical frames, e.g. the vertical frame 1198 of the third bi-facial solar panel 1194, in the same manner as do the first and second bi-facial solar panels 1168, 1170 described in relation to FIG. 62 and these vertical frames are attached to the fourth parametric mullion as are the vertical frames of the first and second bi-facial solar panels 1168, 1170 described in relation to FIG. 62. The inward wall 1190 comprises at least two spandrel panels, i.e. the first and second spandrel panels 1200, 1202, each of which is backed on its outward side with a block of spray foam insulation, i.e. the first and second insulation blocks 1204, 1206, respectively. Each of the first and second spandrel panels 1200, 1202 includes a vertical frame, i.e. the first and second spandrel panel vertical frames 1208, 1210, respectively, which are similar to the vertical frames of the third and fourth bi-facial solar panels 1194, 1196 except that they do not include a cover, e.g. the cover 1212 of the vertical frame 1198 of the third bi-facial solar panel 1194.

General

It is to be understood that the inventive buildings, parametric mullions, panels (glass, insulated metal, or spandrel) having the inventive frames, the inventive trusses, and the dual wall systems (with or without the solar panels) described herein may be preassembled in whole or in part or assembled in whole or in part at the construction site at which they are to be used. The sizes and materials of construction of the inventive parametric mullions, panels (glass, insulated metal, or spandrel), and trusses are to be selected to accommodate the wall designs in which they are to be used.

It is to be understood that the inventive buildings, parametric mullions, panels (glass, insulated metal, or spandrel) having the inventive frames, the inventive trusses, and the dual wall systems (with or without the solar panels) described herein may be used either alone or in combination with one another depending on the design needs of the architectural application. It is also to understood one or more embodiments of the inventive buildings, parametric mullions, panels (glass, insulated metal, or spandrel) having the inventive frames, the inventive trusses, and the dual wall systems (with or without the solar panels) described herein may be used alone or in combination with one another depending on the design needs of the architectural application.

While only a few embodiments of the present invention have been shown and described, it will be obvious to those skilled in the art that many changes and modifications may be made thereunto without departing from the spirit and scope of the present invention as described in the following claims. All patent applications and patents, both foreign and domestic, and all other publications referenced herein are incorporated herein in their entireties to the full extent permitted by law.

What is claimed is:

1. An exterior curtain wall system for an exterior of a building comprising a plurality of mullions, wherein each mullion comprises a plurality of components including i) an H-beam beam having a plurality of serrated legs, ii) a first end beam having plurality of serrated cavities into which at least one of the serrated legs of the H-beam is received allowing interfacing of serrated surfaces of the serrated cavities of the first end beam and the serrated legs of the H-beam, iii) at least one serrated plate having a first serrated end and a second serrated end, iv) a box tube having a plurality of serrated cavities into which at least one of the serrated legs of the H-beam and at least the first serrated end of the at least one serrated plate are received allowing interfacing of serrated surfaces of the serrated cavities of the box tube and the serrated legs of the H-beam, and of the serrated cavities of the box tube and the first end of the at least one serrated plate, and v) a second end beam having a plurality of serrated cavities into which the second end of the at least one serrated plate is received allowing interfacing of serrated surfaces of the serrated cavities of the second end beam and the second end of the at least one serrated plate.

2. The exterior curtain wall system of claim 1 further comprising a plurality of panels wherein at least one of the panels is attached to at least one of the mullions.

3. The exterior curtain wall system of claim 2 wherein the wall system locates at least one of the panels flush to the building frame.

4. The exterior curtain wall system of claim 2 further comprising at least one selected from the group of i) a framed decorative component which overlays a preselected portion of an exterior side of at least one of the panels, and ii) a projecting decorative component which extends outwardly from an exterior side of at least one of the panels.

5. The exterior curtain wall system of claim 2 further comprising a thermal break component wherein the thermal break component structurally attaches one of the panels to one of the mullions.

6. The exterior curtain wall system of claim 2 wherein at least some of the plurality of mullions and at least some of the plurality of panels are adapted to provide a curved facade to at least a portion of the wall system.

7. The exterior curtain wall system of claim 2 wherein at least one of the panels includes a wiring conduit.

8. The exterior curtain wall system of claim 2 wherein at least some of the plurality of mullions and at least some of the plurality of panels are adapted to form a dome.

9. The exterior curtain wall system of claim 2 wherein at least one of the panels has an interior-facing side having a finished surface that obviates the need for drywall or other coverings.

10. The exterior curtain wall system of claim 2 further comprising a plurality of pivots connections wherein at least one of the pivot connections connects at least one of the panels to at least one of the mullions.

11. The exterior curtain wall system of claim 10 wherein at least one of the pivot connections is adapted to permit two adjacent ones of the panels to be fixed at a predetermined acute or obtuse angle to one another.

12. The exterior curtain wall system of claim 1 wherein at least one of the components of one mullion of the plurality of mullions is interchangeable with at least one component of another mullion of the plurality of mullions.

13. The exterior curtain wall system of claim 1 wherein at least one of the mullions is anchored to an edge of a deck of a building.

14. The exterior curtain wall system of claim 1 wherein at least one of the mullions is adjustably attached to a deck of a building.

15. The exterior curtain wall system of claim 1 wherein the wall system is attached to an edge of a deck of the building and includes allowances for vertical slip.

16. The exterior curtain wall system of claim 1 wherein the wall system is a dual wall system having an outward wall and an inward wall wherein each of the outward wall and the inward wall are supported and spaced apart from one another by shared ones of the plurality of mullions.

17. An exterior curtain wall system for an exterior of a building comprising a plurality of mullions, wherein each of the mullion comprises:

an H-beam having a plurality of serrated legs, a first end beam having a plurality of serrated cavities into which at least one of the serrated legs of the H-beam is received allowing interfacing of serrated surfaces of the serrated cavities of the first end beam and the serrated legs of the H-beam, a second end member having a plurality of serrated cavities into which at least one of the serrated legs of the H-beam is received allowing interfacing of serrated surfaces of the serrated cavities of the first end beam and the serrated legs of the H-beam, and wherein at least one of the mullions is adapted to be anchored to an edge of a deck of a building.

18. The exterior curtain wall system of claim 17 further comprising a plurality of panels wherein at least one of the panels is attached to at least one of the mullions.

19. The exterior curtain wall system of claim 18 wherein at least one of the panels has an interior-facing side having a finished surface that obviates the need for drywall or other coverings and is selected from the group consisting of an insulating panel, a window panel, and a solar panel.

20. The exterior curtain wall system of claim 18 further comprising a plurality of pivots connections wherein at least one of the pivot connections connects at least one of the panels to at least one of the mullions.

21. The exterior curtain wall system of claim 20 wherein at least one of the pivot connections is adapted to permit two adjacent ones of the panels to be fixed at a predetermined acute or obtuse angle to one another.

22. The exterior curtain wall system of claim 18 wherein the wall system is attached to a building having a frame and the wall system is adapted to locate at least one of the panels flush to the building frame.

23. The exterior curtain wall system of claim 18 further comprising at least one selected from the group of i) a framed decorative component which overlays a preselected portion of an exterior side of at least one of the panels, and ii) a projecting decorative component which extends outwardly from an exterior side of at least one of the panels.

24. The exterior curtain wall system of claim 18 further comprising a thermal break component wherein the thermal break component structurally attaches one of the panels to one of the mullions.

25. The exterior curtain wall system of claim 18 wherein at least some of the plurality of mullions and at least some of the plurality of panels are adapted to provide a curved facade to at least a portion of the wall system.

26. The exterior curtain wall system of claim 18 wherein at least one of the panels includes a wiring conduit.

27. The exterior curtain wall system of claim 18 wherein at least some of the plurality of mullions and at least some of the plurality of panels are adapted to form a dome.

28. The exterior curtain wall system of claim 17 wherein at least one of the components of one mullion of the plurality of mullions is interchangeable with at least one component of another mullion of the plurality of mullions.

29. The exterior curtain wall system of claim 17 wherein at least one of the mullions is adjustably attached to a deck of a building.

30. The exterior curtain wall system of claim 17 wherein the wall system is attached to an edge of a deck of the building and includes allowances for vertical slip.

31. The exterior curtain wall system of claim 17 wherein the wall system is a dual wall system having an outward wall and an inward wall wherein each of the outward wall and the inward wall are supported and spaced apart from one another by shared ones of the plurality of mullions.

* * * * *